US010196872B2

(12) United States Patent
Kauffmann et al.

(10) Patent No.: US 10,196,872 B2
(45) Date of Patent: Feb. 5, 2019

(54) INSTALLATION OF AN EMERGENCY CASING SLIP HANGER AND ANNULAR PACKOFF ASSEMBLY HAVING A METAL TO METAL SEALING SYSTEM THROUGH THE BLOWOUT PREVENTER

(71) Applicant: FMC TECHNOLOGIES, INC., Houston, TX (US)

(72) Inventors: Frederic Kauffmann, East Lothian (GB); George B. Haining, Aberdeen (GB)

(73) Assignee: FMC Technologies, Inc., Houston, TX (US)

( * ) Notice: Subject to any disclaimer, the term of this patent is extended or adjusted under 35 U.S.C. 154(b) by 84 days.

(21) Appl. No.: 15/128,205

(22) PCT Filed: Mar. 31, 2014

(86) PCT No.: PCT/US2014/032416
§ 371 (c)(1),
(2) Date: Sep. 22, 2016

(87) PCT Pub. No.: WO2015/152888
PCT Pub. Date: Oct. 8, 2015

(65) Prior Publication Data

US 2017/0101840 A1 Apr. 13, 2017

(51) Int. Cl.
*E21B 33/04* (2006.01)
*E21B 23/01* (2006.01)
(Continued)

(52) U.S. Cl.
CPC ..... *E21B 33/0422* (2013.01); *E21B 19/10* (2013.01); *E21B 23/01* (2013.01); *E21B 23/06* (2013.01); *E21B 33/1212* (2013.01)

(58) Field of Classification Search
CPC ..... E01B 33/04; E01B 23/01; E01B 19/10; E01B 33/0422
See application file for complete search history.

(56) References Cited

U.S. PATENT DOCUMENTS 2,880,806 A 4/1959 Davis
4,131,287 A * 12/1978 Gunderson ..... E21B 33/04 277/328

(Continued)

FOREIGN PATENT DOCUMENTS

GB 2271793 A 4/1994
GB 2410514 A 8/2005
WO 2009111544 A2 9/2009

OTHER PUBLICATIONS

International Search Report and Written Opinion dated Feb. 12, 2015 for PCT/US2014/032416 filed on Mar. 31, 2014.

(Continued)

*Primary Examiner* — Cathleen R Hutchins
(74) *Attorney, Agent, or Firm* — Amerson Law Firm, PLLC

(57) ABSTRACT

An emergency casing packoff assembly (170) that is adapted to be installed in a wellhead (100) through a blowout preventer includes an upper packoff body (171), a lower packoff body (174) releasably coupled to the upper packoff body (171), and a metal seal ring (175) that is adapted to create a metal to metal seal between the packoff assembly (170) and a casing (110) supported in a wellhead (100) when a pressure thrust load is imposed on the packoff assembly (170). The casing packoff assembly (170) further includes a lock ring energizing mandrel (173) threadably coupled to the upper packoff body (171), wherein at least a portion of the lock ring energizing mandrel (173) is adapted to be threadably rotated relative to the upper packoff body (171) so as to lock the packoff assembly (170) into the wellhead (100)

(Continued)

while the imposed pressure thrust load is maintained on the packoff assembly (170).

32 Claims, 31 Drawing Sheets

(51) Int. Cl.

| | |
|---|---|
| ***E21B 19/10*** | (2006.01) |
| ***E21B 23/06*** | (2006.01) |
| ***E21B 33/12*** | (2006.01) |

(56) References Cited

U.S. PATENT DOCUMENTS

| | | | | |
|---|---|---|---|---|
| 4,949,786 | A | 8/1990 | Eckert et al. | |
| 5,013,187 | A * | 5/1991 | MacIntyre | E21B 33/04 166/348 |
| 5,105,888 | A | 4/1992 | Pollock | |
| 2004/0251031 | A1 | 12/2004 | Reimert | |
| 2010/0276156 | A1 * | 11/2010 | Jennings | E21B 33/04 166/379 |

OTHER PUBLICATIONS

European Extended Search Report dated May 29, 2018 for European Divisional Patent Application No. 17202328.5 filed on Nov. 17, 2017.

* cited by examiner 127
127
126s
126
126a
126t
100s
120
128
128
125
125
137u
137u
124
124
123
110r
100
100s
110s
137
137
122
110
137L
137L
131
"4B"
131
102
102
129
130
130

127
127
126s
126
100s
126a
120
126t
128
128
125
125
137u
137u
124
124
123
110r
100
100s
110s
137
137
122
110
137L
137L
"5B"
131
131
102
102
129
130
130

160
160n
162a
162b
162h
161
161p
100
161r
161r
103
161t
161t
103
100
161b
162c
163a
163s
161g
161g
162u
162u
164s
163b
162d
162d
167p
163p
164s
167u
167s
167h
100
167b
166
166b
167t
171
162d
162d
172
171r
165c
170
173c
175
173
"9E"
104
104
102
174
102
131
166c
131
100
130
130
129
110
110s 178
167b
168
167t
171
171r
162d
172s
172t
10E
172
110t
165c
173c
110s
173t
10E
173u
175
173i
173
171s
173L
173x
173s
176
173r
174c
104
174p
171c
177
177b
177e
171p
135
174g
174
174L
174h
174f
110
130
102
131

INSTALLATION OF AN EMERGENCY CASING SLIP HANGER AND ANNULAR PACKOFF ASSEMBLY HAVING A METAL TO METAL SEALING SYSTEM THROUGH THE BLOWOUT PREVENTER

BACKGROUND

1. Field of the Disclosure

The present subject matter is generally directed to systems, methods, and tools for installing emergency slip hangers, and in particular for installing an emergency slip hanger and annular packoff assembly having a metal to metal sealing system in a wellhead without removing the blowout preventer from the wellhead.

2. Description of the Related Art

In a typical oil and gas drilling operation, wellhead are used to support the various casing strings that are run into the wellbore, to seal the annular spaces between the various casing strings, and to provide an interface with the blowout preventer ("BOP"), which is generally positioned at the top of the wellhead so as to control pressure while permitting drilling fluids to flow into and out of the wellbore. In most cases, the wellhead design is generally dependent upon many different factors, including the location of the wellhead and the specific characteristics of the well being drilled, such as size, depth, and the like.

In many drilling program, a plurality of substantially concentric casing strings of different sizes, such as two, three, four, or even more casing sizes, are generally run into the well so as to support the as-drilled wellbore, to facilitate the flow of drilling fluids into and out of the wellbore, and/or to isolate the wellbore from the various producing zones that may be present in the adjacent formations. Typically, a first outermost casing, sometimes referred to as a conductor casing, is fixed in the ground, and each successive inner casing is supported from the next adjacent outer casing by the use of specially designed mechanical supports, referred to as casing hangers. Casing hangers are generally made up of an external support or landing shoulder on the inner casing that lands on, or engages with, an internal support or load shoulder on the outer casing.

In many cases, the casing hangers that are used to support the various casing strings are often fixed in position on each individual casing string and positioned in the wellhead. In this way, the wellhead is used to support a number of casing hangers, each of which generally supports the weight of an individual casing string. However, in some cases, and for a variety of different reasons, an individual casing string may become stuck in as it is being run into the wellbore, in which case the fixed casing hanger that is located in the wellhead will not be in the proper position so as to support the casing string. Accordingly, if the casing string cannot be unstuck, it is often necessary to use an emergency slip-type casing support to support the casing string instead of the fixed position casing hanger located in the wellhead.

Emergency slip supports are tapered wedges that have a series of serrations or teeth that are configured to grip the casing string by biting into, i.e., locally indenting and/or deforming, the outside surface of the casing when the slip supports are subjected to an actuating force. Packing and/or sealing assemblies are then generally used to seal the annular space, or annulus, between the outside surface of the casing and the inside surface, or bore, of the wellhead so as to contain the wellbore pressure and to prevent hydrocarbons and/or other fluids from escaping to the environment. When the casing becomes stuck, i.e., such that it cannot be pulled out or pushed further down into the wellbore, the emergency slip hangers and the annular packing system are installed after the stuck casing has been cut and trimmed to an appropriate distance above the wellhead landing shoulder. However, due to the complexity and size of the tools that are often required to perform all of the various steps necessary to properly pack off and seal the annulus—activities which can frequently occur tens of meters or even more below the top of the wellhead—it is often necessary to remove the blowout preventer from the wellhead in order to provide sufficient access to properly perform the work, which can potentially reduce overall control of the drilled wellbore.

Furthermore, and in view of the fact that the emergency slip hangers and annular packoffs that are installed in such situations are intended to substantially be permanent repairs, the seals installed with the annular packoffs must remain reliable throughout the life of the wellhead, as they cannot readily be retrieved and replaced and/or maintained. Accordingly, it has become more and more common for the annular packoffs to utilize metal to metal seals, particularly in gas producing applications, as many elastomeric seals can leak under such conditions after an extended period of time in service.

Accordingly, there is a need to develop and implement new tools, systems, and methods that may be used to install an emergency slip hanger and annular packoff having a metal to metal sealing system in a wellhead through the BOP, that is, without removing the BOP from the wellhead.

SUMMARY OF THE DISCLOSURE

The following presents a simplified summary of the present disclosure in order to provide a basic understanding of some aspects disclosed herein. This summary is not an exhaustive overview of the disclosure, nor is it intended to identify key or critical elements of the subject matter disclosed here. Its sole purpose is to present some concepts in a simplified form as a prelude to the more detailed description that is discussed later.

Generally, the present disclosure is directed to systems, methods, and tools for installing an emergency slip hanger and annular packoff with a metal to metal sealing system in a wellhead without removing the blowout preventer from the wellhead. In one illustrative embodiment, an emergency casing packoff assembly that is adapted to be installed in a wellhead through a blowout preventer is disclosed. The packoff assembly includes an upper packoff body, a lower packoff body releasably coupled to the upper packoff body, and a metal seal ring that is adapted to create a metal to metal seal between the packoff assembly and a casing supported in a wellhead when a pressure thrust load is imposed on the packoff assembly. The casing packoff assembly further includes, among other things, a lock ring energizing mandrel threadably coupled to the upper packoff body, wherein at least a portion of the lock ring energizing mandrel is adapted to be threadably rotated relative to the upper packoff body so as to lock the packoff assembly into the wellhead while the imposed pressure thrust load is maintained on the packoff assembly.

In another exemplary embodiment of the present disclosure, a hydro-mechanical running tool that is adapted to install a casing packoff assembly having a metal to metal sealing system in a wellhead through a blowout preventer is disclosed. The hydro-mechanical running tool includes, among other things, an upper tool portion having a central rotating body and an upper hydraulic housing disposed around at least a part of said central rotating body. Additionally, the disclosed hydro-mechanical running tool includes a lower tool portion that is adapted to be threadably coupled to a casing packoff assembly during installation of the casing packoff assembly in a wellhead, wherein the central rotating body is adapted to be rotated relative to the upper hydraulic housing and the lower tool portion while a pressure is imposed on at least the central rotating body and said lower tool portion. Furthermore, the hydro-mechanical running tool also includes a thrust bearing positioned between the central rotating body and the upper hydraulic housing, the thrust bearing being adapted to facilitate the rotation of the central rotating body relative to the upper hydraulic housing while the pressure is imposed.

In a further illustrative embodiment, a method is disclosed for installing a casing packoff assembly having a metal to metal sealing system in a wellhead through a blowout preventer. The disclosed method includes, among other things, removably coupling the casing packoff assembly to a hydro-mechanical running tool, lowering the casing packoff assembly and the hydro-mechanical running tool into the wellhead through the blowout preventer, and landing the casing packoff assembly on a support shoulder of a casing slip hanger. The method further includes energizing a metal seal ring of the casing packoff assembly so as to create a metal to metal seal between the casing packoff assembly and a casing supported in the wellhead by the casing slip hanger, wherein energizing the metal seal ring includes imposing a pressure on at least the hydro-mechanical running tool. Additionally, the disclosed method includes rotating at least a portion of the hydro-mechanical running tool relative to at least a portion of the casing packoff assembly while maintaining the imposed pressure.

Another exemplary embodiment of the presently disclosed subject matter is an emergency casing slip hanger assembly that is adapted to be installed in a wellhead through a blowout preventer. The illustrative slip hanger assembly includes a slip bowl that is adapted to be releasably coupled to and supported by a slip bowl protector during installation of the slip hanger assembly in a wellhead through a blowout preventer, wherein the slip bowl is further adapted to be positioned around a casing in the wellhead and landed on a support shoulder of the wellhead. The disclosed slip hanger assembly also includes a plurality of slips that are adapted to engage with and support the casing, and a plurality of first shear pins releasably coupling the plurality of slips to the slip bowl, wherein the plurality of first shear pins are adapted to be sheared by a pressure thrust load that is imposed on the slip bowl protector so as to drop the plurality of slips into contact with an outside surface of the casing.

Also disclosed herein is a slip hanger running tool assembly that is adapted to be inserted through a blowout preventer during installation of a casing slip hanger assembly in a wellhead. The disclosed slip hanger running tool assembly includes a casing slip hanger assembly that includes a slip bowl and a plurality of slips releasably coupled to the slip bowl, wherein the casing slip hanger assembly is adapted to be positioned around a casing in a wellhead and landed on a support shoulder of the wellhead. Additionally, the exemplary slip hanger running tool assembly includes a slip bowl protector releasably coupled to the casing slip hanger assembly, and a plug assembly releasably coupled to the slip bowl protector, wherein the plug assembly is adapted to uncouple the plurality of slips from the slip bowl by imposing a pressure thrust load on the slip bowl protector.

In yet another illustrative embodiment, a method for installing a casing slip hanger assembly in a wellhead through a blowout preventer includes releasably coupling a plurality of slips to a slip bowl of the casing slip hanger assembly, and releasably coupling a slip bowl protector to the casing slip hanger assembly. Furthermore, the method also includes lowering the casing slip hanger assembly into the wellhead through the blowout preventer so as to position the casing slip hanger assembly around a casing and to land the casing slip hanger assembly on a wellhead support shoulder. Additionally, the illustrative method includes, among other things, dropping the plurality of slips into contact with an outside surface of the casing, wherein dropping the plurality of slips includes imposing a pressure thrust load on the slip bowl protector so as to uncouple the plurality of slips from the slip bowl, setting the slips so as to support the casing, and retrieving the slip bowl protector from the wellhead through the blowout preventer.

In another exemplary embodiment, a method for installing an emergency casing slip hanger assembly and an emergency casing packoff assembly having a metal to metal sealing system into a wellhead through a blowout preventer is disclosed. The method includes, among other things, lowering the slip hanger assembly into the wellhead through the blowout preventer with a slip hanger assembly running tool that is supported by a tubular support so as to land the slip hanger assembly on a support shoulder of the wellhead, wherein the slip hanger assembly includes a slip bowl and a plurality of slips that are releasably coupled to the slip bowl by a plurality of first shear pins. Furthermore, the disclosed method also includes imposing a pressure thrust load on the slip hanger assembly running tool so as to shear the plurality of first shear pins and to drop the slips into contact with a casing positioned in the wellhead, setting the slips so as to support the casing, and retrieving the slip hanger assembly running tool from the wellhead through the blowout preventer. Additionally, the method further includes lowering the packoff assembly into the wellhead through the blowout preventer with a hydro-mechanical running tool so as to land the packoff assembly on a support shoulder of the slip hanger assembly, wherein the packoff assembly includes an upper packoff body and a lower packoff body that is releasably coupled to the upper packoff body with a plurality of second shear pins. Moreover, the method also includes imposing a pressure on the packoff assembly and at least a portion of the hydro-mechanical running tool so as to shear the plurality of second shear pins and to energize the metal seal ring so as to create a metal to metal seal between the packoff assembly and the casing. Finally, the disclosed method includes rotating at least a portion of the hydro-mechanical running tool relative to at least a portion of the packoff assembly so as to lock the packoff assembly into the wellhead while maintaining the imposed pressure, and retrieving the hydro-mechanical running tool from the wellhead through the blowout preventer.

BRIEF DESCRIPTION OF THE DRAWINGS

The disclosure may be understood by reference to the following description taken in conjunction with the accompanying drawings, in which like reference numerals identify like elements, and in which.

Figure 1:
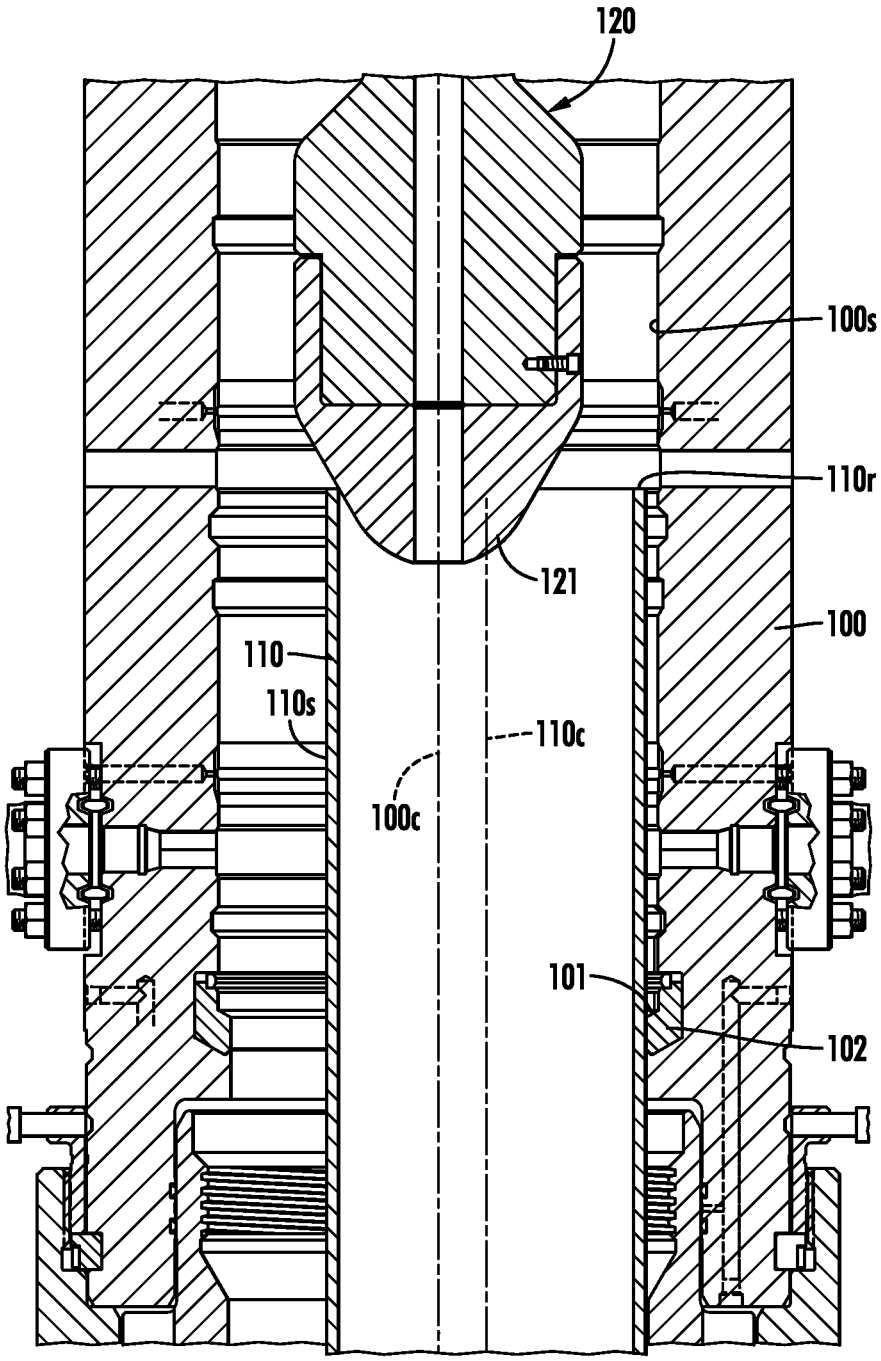
FIG. 1 is a cross-sectional view of a slumped casing stuck in a wellhead showing a casing centralizer during an initial stage of centering the casing in the wellhead.

While the subject matter disclosed herein is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION

Various illustrative embodiments of the present subject matter are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The present subject matter will now be described with reference to the attached figures. Various systems, structures and devices are schematically depicted in the drawings for purposes of explanation only and so as to not obscure the present disclosure with details that are well known to those skilled in the art. Nevertheless, the attached drawings are included to describe and explain illustrative examples of the present disclosure. The words and phrases used herein should be understood and interpreted to have a meaning consistent with the understanding of those words and phrases by those skilled in the relevant art. No special definition of a term or phrase, i.e., a definition that is different from the ordinary and customary meaning as understood by those skilled in the art, is intended to be implied by consistent usage of the term or phrase herein. To the extent that a term or phrase is intended to have a special meaning, i.e., a meaning other than that understood by skilled artisans, such a special definition will be expressly set forth in the specification in a definitional manner that directly and unequivocally provides the special definition for the term or phrase.

Generally, the subject matter disclosed herein relates to the systems, methods, and tools that may be used for installing an emergency slip hanger and annular packoff with a metal to metal sealing system in a wellhead without removing the blowout preventer from the wellhead. As described previously, such a system may be required in those instances when a casing string becomes stuck in the wellbore as it is being run into the well, and subsequently cannot be pushed further down or pulled out of the hole. For example, FIG. 1 illustrates one such instance, and is a cross-sectional view of an exemplary wellhead 100 wherein a casing 110 has become stuck in the well. As is shown in FIG. 1, the stuck casing 110 has been cut at a distance above the wellhead load shoulder 102 so as to have an upper rough cut end 110*r*, and the casing 100 is slumped to one side of the wellhead 100 such that the outside surface 110*s* of the casing 110 is close to, or possibly even in contact with, the inside surface 100*s*, or bore, of the wellhead 100. Furthermore, a casing centralizing tool 121 has been attached to the lower end of an emergency slip hanger running tool assembly 120 (see, FIGS. 2A-3), and the centralizing tool 121 has been lowered into the wellhead 100 and positioned adjacent to the upper rough cut end 110*r* on one side of the slumped casing 110.

In certain illustrative embodiments of the present disclosure, in addition to the centralizing tool 121, the emergency slip hanger running tool assembly 120 may also include a plug assembly 123 (not shown; see FIG. 3), which may be used to support an emergency casing slip hanger assembly 129 and slip bowl protector 137 (not shown; see FIGS. 2A-3) and to seal the upper end of the slip hanger running tool assembly 120 against the bore or inside surface 100*s* of the wellhead 100, as will be further described below. Furthermore, and as noted above, in at least some embodiments the slip hanger running tool assembly 120 may be lowered into the wellhead 100 without removing the blowout preventer, or BOP (not shown in FIG. 1), meaning that the slip hanger running tool assembly 120 may be lowered through the BOP, as will be further discussed with respect to FIGS. 4A and 5A below. After the centralizing tool 121 has been positioned as shown in FIG. 1, it may then be used to perform an initial rough centering operation on the casing 110 so as to bring the casing centerline 110*c* into closer alignment with the wellhead centerline 100*c*, as is shown in FIG. 2A.

Figure 2A:
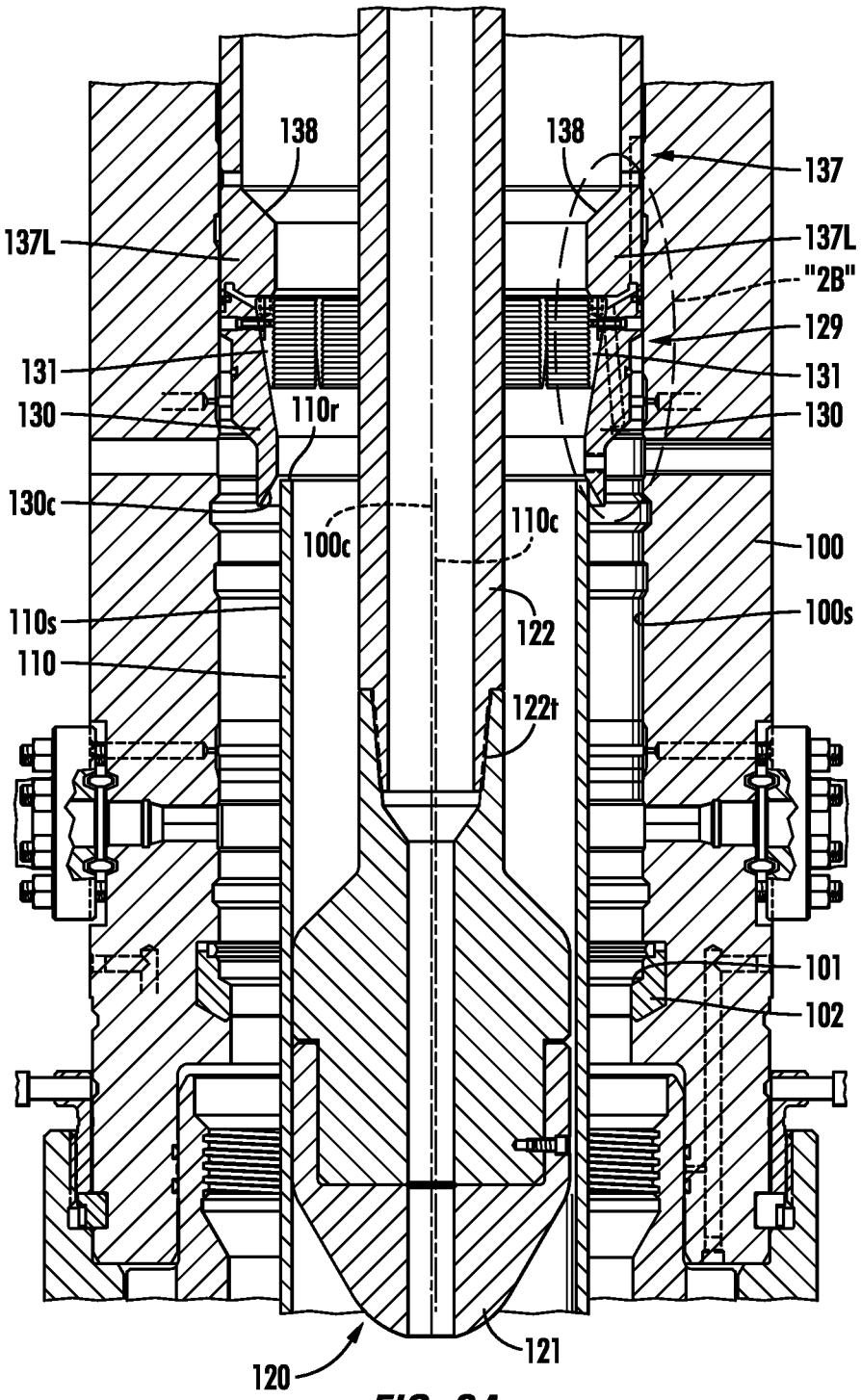
FIG. 2A is a cross-sectional view of the wellhead and stuck casing of FIG. 1 after the centralizing tool has been used to roughly center the casing in the wellhead and an illustrative emergency slip hanger assembly and slip bowl protector of the present disclosure have been positioned proximate the end of the stuck casing a final centralizing step.

FIG. 2A is a cross-sectional view of the wellhead 100 and stuck casing 110 illustrated in FIG. 1 after the centralizing tool 121 has been used to roughly center the casing 100 in the wellhead 100, thus bringing the centerline of the case 110*c* closer to the centerline 100*c* of the wellhead 100. In certain embodiments, the centralizing tool 121 of the emergency slip hanger running tool assembly 120 may be attached to the lower end of a threaded pipe 122, e.g., a drill pipe 122, along a threaded interface 122*t*. Furthermore, in certain embodiments, the emergency slip hanger running tool assembly 120 may be run further into the wellhead 100, i.e., through the BOP (not shown; see, FIGS. 4A and 5A), so that the centralizing tool 121 is lowered inside of the stuck casing 110. Additionally, and an illustrative emergency casing slip hanger assembly 129 and slip bowl protector 137 may be positioned proximate the rough cut upper end 110*r* of the stuck casing 110. As shown in FIG. 2A, the casing slip hanger assembly 129 may include a slip bowl 130, and a plurality of slips 131 may be attached to the slip bowl 130, as will be further described in conjunction with FIG. 2B below. In at least some embodiments, the slip bowl 130 may have an inside corner centralizing chamfer 130*c* at a lower end thereof, which may be adapted to contact an upper outside corner of the rough cut end 110*r* of the casing 110 as the casing slip hanger assembly 129 is being lowered into the wellhead 100. According, the lower inside corner centralizing chamfer 130*c* may thus facilitate a final fine centering operation of the casing 110 as the emergency slip hanger running tool assembly 120 is further lowered into the wellhead 100.

Figure 2B:
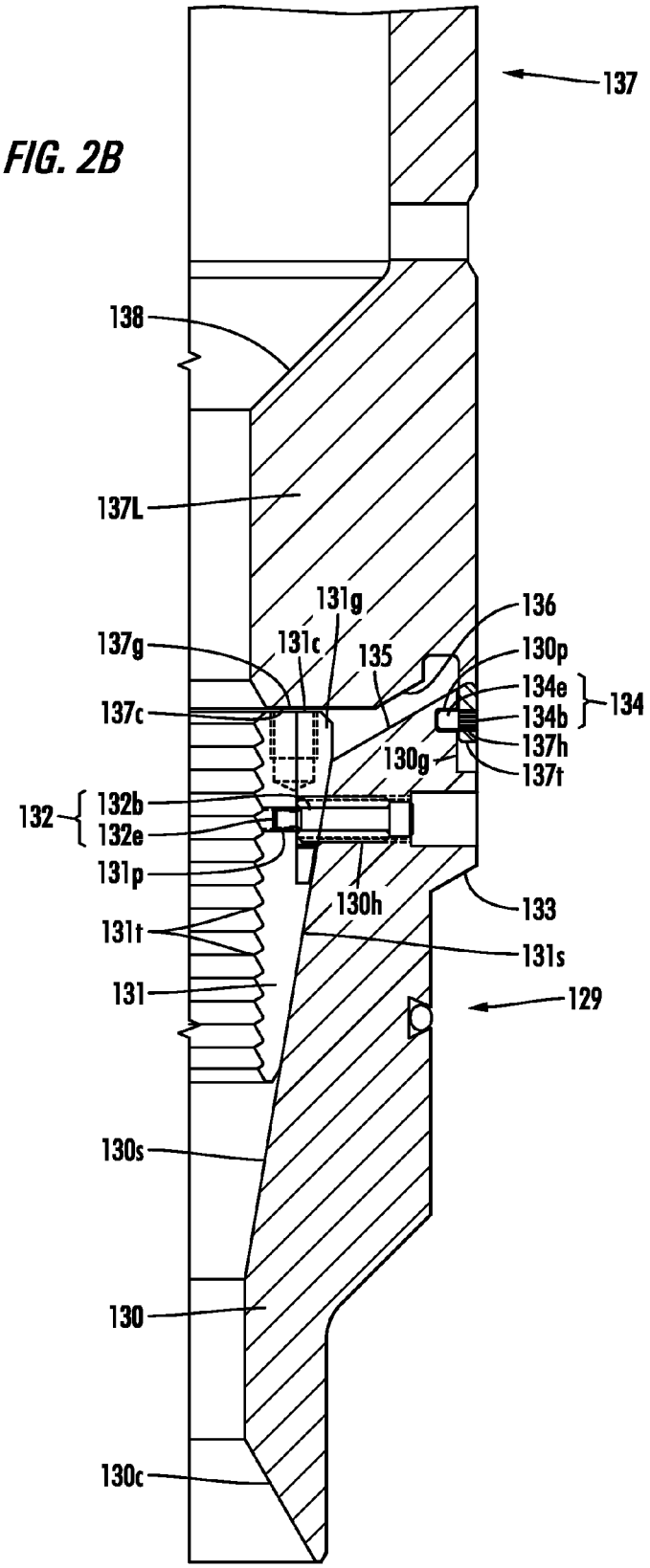
FIG. 2B is a close-up cross-sectional detail view "2B" of the illustrative slip hanger assembly and slip bowl protector shown in FIG. 2A.

FIG. 2B is a close-up cross-sectional detail view "2B" of the exemplary casing slip hanger assembly 129 and slip bowl protector 137 shown in FIG. 2A. As shown in FIG. 2B, the slip bowl protector 137 may include a lower end 137L, which may in turn have an optional upper slip bowl protector load shoulder 138, which may be used for landing additional tools during subsequent assembly steps, as will be further described with respect to FIG. 7 below.

In some embodiments, each of the plurality of slips 131 may have an outside tapered sliding surface 131*s* that is adapted to allow the plurality of slips 131 to slide down and into place against the casing 110 (not shown in FIG. 2B) along a corresponding inside tapered sliding surface 130*s* on the slip bowl 130. Additionally, each of the slips 131 may have a plurality of serrations or teeth 131*t* disposed on an inside surface thereof, which may be used to grip the casing 100 by biting into the outside surface 110*s* of the casing 110 when the slips 131 are set in place so as to support the casing 110. As shown in FIG. 2B, the plurality of slips 131 may be releasably coupled to the slip bowl 130 by, for example, a plurality of shear pins 132. Furthermore, each of the plurality of shear pins 132 may be used to releasably couple a respective one of the slips 131 to the slip bowl 130 during the initial assembly of the emergency casing slip hanger assembly 129 such that the sliding surfaces 131*s* of the slips 131 may be in contact with the sliding surface 130*s* of the slip bowl 130.

In certain exemplary embodiments, the shear pins 132 may be adapted to be sheared when a downward shearing load 128 (see, FIGS. 4A and 5A) is imposed on the slip bowl protector 137, thus causing a lower contact surface 137*c* on the slip bowl protector 137 to contact the upper contact surfaces 131*c* on each of the slips 131 and transfer the downward shearing load 128 to the slips 131 and consequently to the shear pins 132. In this way, the slips 131 may shear the shear pins 132 and be allowed to fall down, i.e., drop, along the tapered sliding surface 130*s* and 131*s* and into contact with the outside surface 110*s* of the casing 110, as will be further described in conjunction with FIGS. 4A-4B below.

In some embodiments, each shear pin 132 may have a base portion 132*b* that is adapted to be inserted into a corresponding hole 130*h* in the emergency slip bowl 130 and an end portion 132*e* that is adapted to be received by a corresponding pocket 131*p* in a slip 131. As shown in FIG. 2B, the base portion 132*b* of each shear pin may be adapted to project out of the hole 130*h*, i.e., beyond the tapered sliding surface 130*s* of the slip bowl 130, and into a corresponding vertical groove 131*g* in the back side of the slip 131, such that the base portion 132*b* is adjacent to, or even in contact with, an inside face of the groove 131*g*. Additionally, in at least some exemplary embodiments, the base portion 132*b* of each shear pin 132 that projects out of the hole 130*h* and into the groove 131*g* may be of a greater size, e.g. diameter, than the end portion 132*e* that extends into the pocket 131*p*. In this way, the smaller size, e.g., diameter, end portion 132*e* may therefore be sheared away from the large size, e.g., diameter, base portion 132*b*, by the moving slip 131 when the slip 131 is pushed down by the slip bowl protector 137.

In certain illustrative embodiments, the base portion 132*b* of the shear pins 132 may be externally threaded and may therefore be threadably engaged with a corresponding internally threaded hole 130*h*. In other embodiments, the end portion 132*e* of each shear pin may have a configuration that is adapted to engage with a correspondingly configured interface in the pocket 131*p* of each slip 131. For example, the end portion 132*e* may have one or more splines that are adapted to slidably engage one or more slots or keyways formed in the pocket 131*p*. Other engaging interface configurations may also be. Furthermore, in at least one embodiment, the end portion 132*e* and the pocket 131*p* may be adapted so that the engaging interface therebetween has a slight interference fit, thus enabling the end portion 132*e* to remain within the pocket 131*p*—i.e., with the slip 131—when the end portion 132*e* is sheared away from the base portion 132*b* of the shear pin 132.

As illustrated in FIG. 2B, the slip bowl 130 may have a lower slip bowl landing shoulder 133 that is adapted to land on and be supported by the contact surface 101 of the wellhead load shoulder 102 when the emergency casing slip hanger assembly 129 is landed in the wellhead 100. In at least some exemplary embodiments, the slip bowl 130 may be releasably coupled to the slip bowl protector 137 with, for example, a plurality of shear pins 134, each of which may be installed through a downwardly protruding ring or tab 137*t* as described below. Additionally, the slip bowl 130 may have an outer slot or groove 130*g* at an upper end thereof that is adapted to receive the tab 137*t*, and the tab may be adapted slide in the groove 130*g*. Furthermore, as with the shear pins 132, the tab 137*t* may also be adapted to shear each of the shear pins 134 when the above-noted downward shearing load 128 (see, FIGS. 4A and 5A) is imposed on the slip bowl protector 137, and consequently imposed on the shear pins 134 by the tab 137*t*, as will be further described below.

In certain illustrative embodiments, each shear pin 134 may have a base portion 134*b* that is adapted to be inserted into a corresponding hole 137*h* in the tab 137*t* and an end portion 134*e* that is adapted to be received by a corresponding groove or pocket 130*p* in the emergency slip bowl 130. Furthermore, in at least one embodiment, the base portion 134*b* of each shear pin 134 may be press fit into the corresponding hole 137*h* so as to keep the shear pin 134 in place, whereas in other embodiments there may be a splined and grooved interfaced or a threaded interface between the base portion 134*b* and the hole 137*h*, e.g., as is described above with respect to the end portion 132*e* of the shear pin 132.

In some embodiments, the tab 137*t* may represent a substantially continuous ring-like structure 137*t*, wherein each one of the plurality of shear pins 134 may extend through the continuous ring-like structure 137*t* and engage with corresponding pin holes in the slip bowl 130. In other embodiments, the tab 137*t* may represent a plurality of separate and spaced-apart tabs 137*t*, wherein each separate spaced-apart tab 137*t* may be used together with one of the plurality of shear pins 134 to connect the slip bowl protector 137 to the slip bowl 130.

As shown in FIG. 2B, when initially coupled to the slip bowl 130 with the plurality of shear pins 134, the slip bowl protector 137 may be positioned relative to each of the plurality of slips 131 such that a gap 137*g* is present between the lower contact surface 137*c* of the slip bowl protector 137 and the contact surfaces 131*c*. In such embodiments, an initial, i.e., partial, shearing of the shear pins 134 may occur under the downward shearing load 128 before that contact surface 137*c* of the slip bowl protect 137 is brought into contact with the contact surfaces 131*c* of the slips 131. However, in other embodiments, the slip bowl protector 137 and the slips 131 may be releasably coupled to the slip bowl 130 such that there is initially no gap 137*g* between the contact surfaces 137*c* and 131*c*, i.e., such that substantially all contact surfaces 137*c* and 131*c* are in contact when the emergency casing slip hanger assembly 129 is lowered into the wellhead 100 and prior to the downward shearing load 128 being imposed on the slip bowl protector 137.

In certain embodiments, the lower end 137L of the slip bowl protector 137 may have a lower slip bowl protector landing shoulder 136 that is adapted to contactingly engage an upper slip bowl load shoulder 135 on the slip bowl 130 after the downward shearing load 128 (see, FIGS. 4A and 5A) has been imposed on the slip bowl protector and the shear pins 132 and 134 have been sheared by the slips 131 and the tab 137*t*, respectively. See, FIGS. 4A-5B. Furthermore, the upper slip bowl load shoulder 135 may also be adapted to land and support an emergency casing packoff assembly 170, as is shown in FIGS. 9A-16 and discussed below. In at least some embodiments, the upper slip bowl load shoulder 135 may be further adapted to land and support additional tools during subsequent assembly steps, as will be further described with respect to FIGS. 7-8 below.

Figure 3:
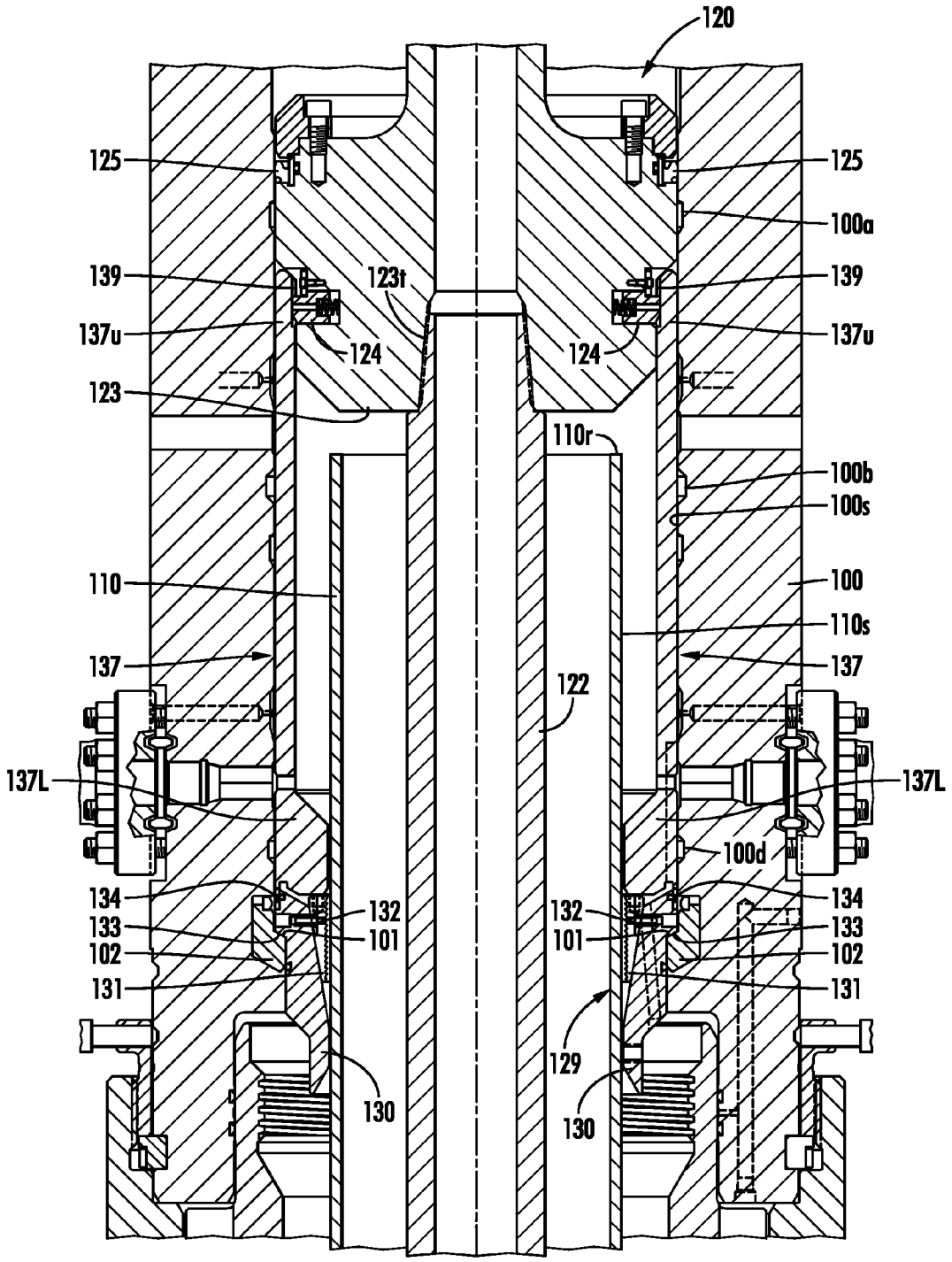
FIG. 3 is a cross-sectional view of an exemplary emergency slip hanger running tool assembly with the illustrative emergency slip hanger assembly and slip bowl protector of FIGS. 2A-2B attached thereto after the emergency slip hanger assembly has been landed on the wellhead load shoulder.

FIG. 3 is a cross-sectional view of the exemplary emergency casing slip hanger assembly 129 and slip bowl protector 137 of FIGS. 2A-2B after the casing slip hanger assembly 129 has been lowered further into the into the wellhead 100 and has been landed on the contact surface 101 of the wellhead load shoulder 102. As noted above, the upper end of the emergency slip hanger running tool 120 may include the plug assembly 123, which may be used to support the threaded pipe 122 and centralizing tool 121 (see, FIG. 2A) by way of a threaded connection interface 123*t*. As shown in FIG. 3, the plug assembly 123 may also include a plurality of spring-loaded dogs 124, which may be used to releasably couple the plug assembly 123 to the slip bowl protector 137 so as to support the casing slip hanger assembly 129 and the slip bowl protector 137 during the installation of the emergency slip hanger running tool assembly 120.

In some embodiments, the plurality of spring-loaded dogs 124 may releasably couple the plug assembly 123 to the slip bowl protector by engaging respective support tabs 139 located at an upper end 137*u* of the slip bowl protector 137. Furthermore, the plug assembly 123 may also include a seal ring 125 disposed around an outer surface thereof that is adapted to contact, and provide pressure tight seal against, the inside surface 100*s* of the wellhead 100, as will be further described with respect to FIGS. 4A and 5A below. Depending on the specific design parameters of the plug assembly 123, the seal ring 125 may be, for example, an elastomeric seal and the like, although other seal types may also be used. In at least some embodiments, the slip bowl protector 137 may extend down the wellhead 100 such that it covers a plurality of ring grooves and/or sealing surfaces 100*a-d* disposed along the inside surface 100*s* of the wellhead 100, thus protecting the surfaces 100*a-d* from damage during the ongoing work that associated with installing and setting the emergency casing slip hanger assembly 129 and the emergency casing packoff assembly 170 (see, FIGS. 9A-16).

Figure 4A:
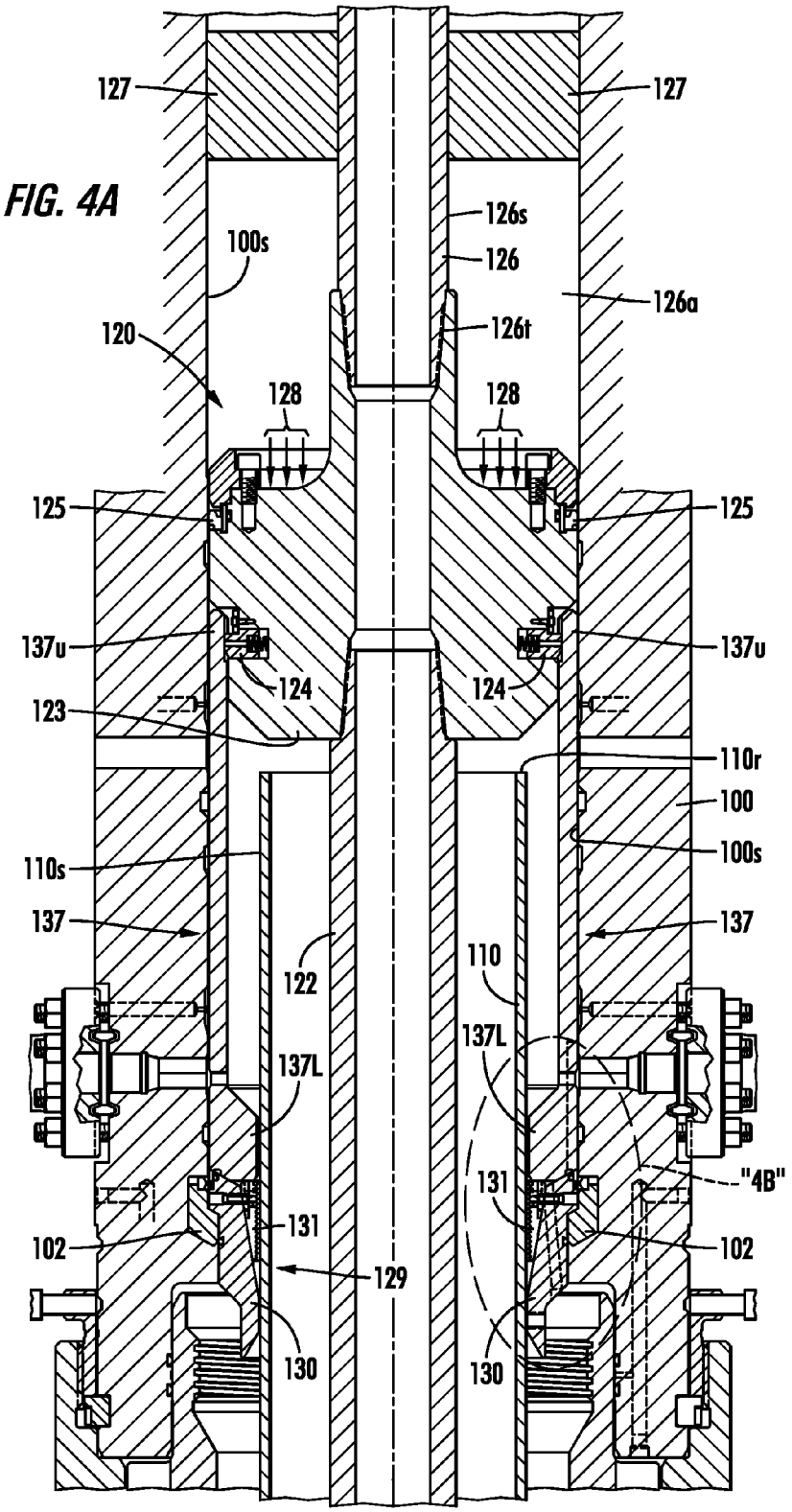
FIGS. 4A and 5A are cross-sectional views of the exemplary emergency slip hanger running tool assembly of FIG. 3 with the emergency slip hanger assembly and slip bowl protector attached thereto, showing steps for releasing the slips to move into contact with the outside of the casing.

FIG. 4A is a cross-sectional view of the illustrative slip hanger running tool assembly 120, the casing slip hanger assembly 129, and the slip bowl protector 137 of FIG. 3 in a further assembly step. As shown in FIG. 4A, the blowout preventer (BOP) rams 127 (shown schematically in FIG. 4A) have been closed around a running tool tubular support 126, e.g., a drill pipe and the like, which is adapted to support the slip hanger running tool assembly 120 during the installation of the emergency casing slip hanger 129 into the wellhead 100. For example, the drill pipe 126 may be attached to the plug assembly 123 at the threaded connection interface 126*t*. In certain embodiments, the BOP rams 127 are adapted to sealingly engage the outside surface of the drill pipe 126 so as to affect a pressure-tight seal of the annular space 126*a* that is defined between the outside surface 126*s* of the running tool drill pipe 126 and the bore or inside surface 100*s* of the wellhead 100.

After the BOP rams have been closed around the running tool drill pipe 126, a fluid, such as water and the like, may be pumped below the BOP rams 127 so as to pressurize the annular space 126*a*. Since the BOP rams 127 provide a pressure tight seal between the running tool drill pipe 126 and the wellhead 100 and the seal ring 125 provides a pressure tight seal between the plug assembly 123 and wellhead 100, the pressurized fluid in the annular space 126*a* may therefore create a downward pressure thrust or shearing load 128 on the plug assembly 123, as shown schematically in FIG. 4A. As noted previously, the downward pressure thrust or shearing load 128 on the plug assembly 123 may thus create a corresponding downward load on the slip bowl protector 137, which may in turn act to shear the shear pins 132 and 134 attaching the slips 131 and the slip bowl protector 137, respectively, to the emergency slip bowl 130. Additional details of the shear pin shearing operation will be discussed in conjunction with FIGS. 4B-5B below.

In certain embodiments, the pressure of the fluid that is pumped in the annular space 126*a* below the BOP rams 127 and above the plug assembly 123 may be established at a level that is sufficiently high so as to be able to fully shear each of the pluralities of shear pins 132 and 134. For example, the required pressure may depend on the total shear area and shear strength of the material, or materials, of the shear pins 132 and 134. Accordingly, some of the specific shear pin design parameters that may affect the requisite fluid pressure may include the total number of shear pins 132, 134, the diameter(s) of the shear pins 132, 134, and the like. In at least one embodiment, a fluid pressure of at least approximately 70 bar (1000 psi) may be used, although it should be appreciated that either lower or higher pressures may also be used, depending on the specific application.

Figure 4B:
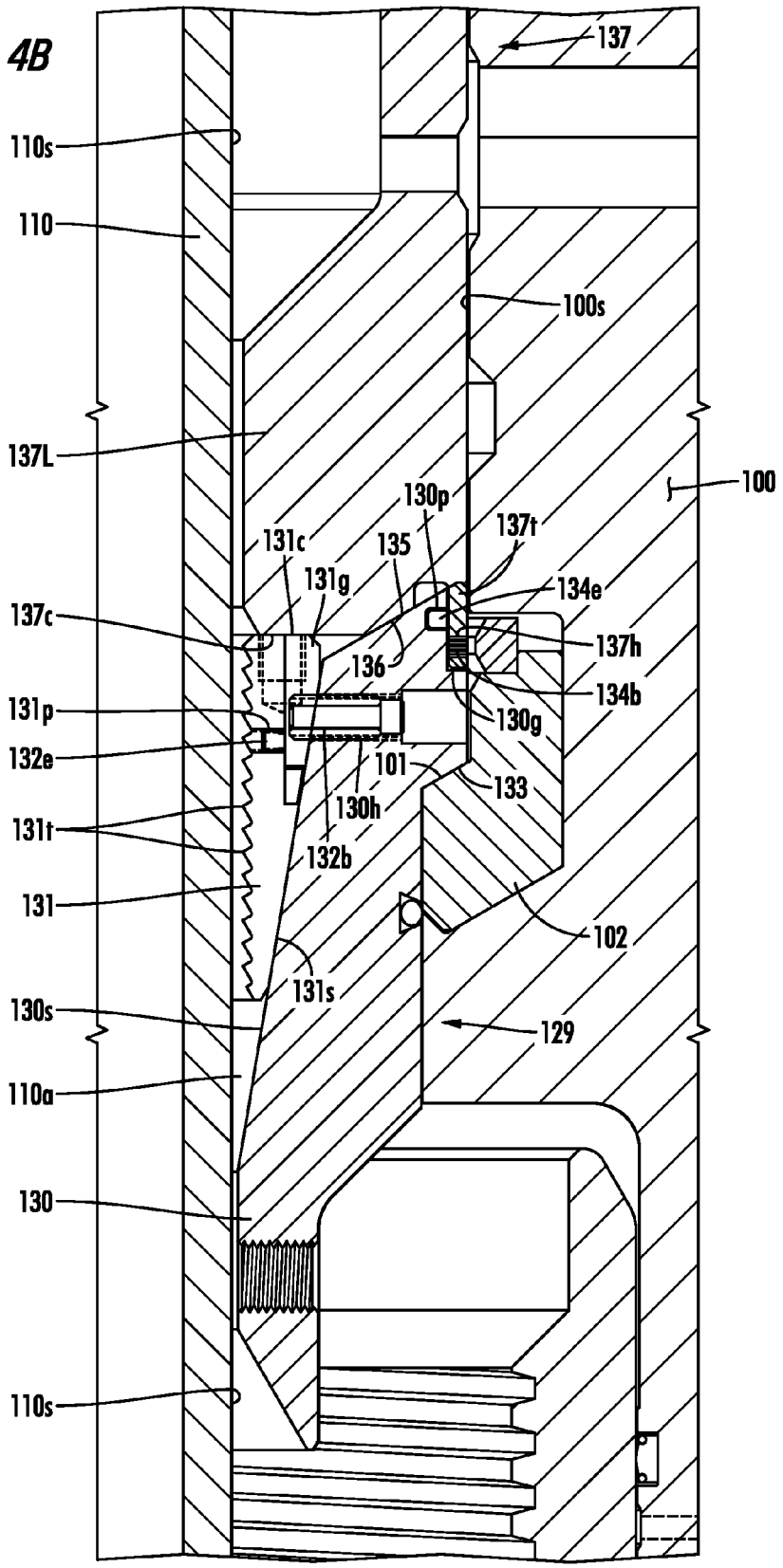
FIGS. 4B and 5B are close-up cross-sectional detail views "4B" and "5B" of the illustrative emergency slip hanger assembly depicted in FIGS. 4A and 5A, respectively, showing steps for releasing the slips to move into contact with the outside of the casing.

FIG. 4B is a close-up cross-sectional detail view "4B" of the illustrative emergency casing slip hanger assembly 129 and slip bowl protection 137 depicted in FIG. 4A after the shear pins 132 and 134 have been sheared as described above. As is shown in FIG. 4B, the contact surface 137*c* on the lower end 137L of the slip bowl protector 137 is in contact with the contact surface 131*c* of the slips 131, and the slips 131 have been pushed downward along the interface of the tapered sliding surfaces 131*s* and 130*s*. Furthermore, as the slips 131 are pushed down by the slip bowl protector 137, the end portion 132*e* of the pin 132, which remains substantially in place inside of the pocket 131*p*, is sheared away from the base portion 132*b*, which remains in place in the hole 130*h* of the slip bowl 130. As can be seen in FIG. 4B, the groove 131*g* in the back side of the slip 131 permits the slip 131 to move downward without any interference from the base portion 132.

Also as shown in FIG. 4B, the slip bowl protector 137 has been landed on the casing slip bowl assembly 129, such that the lower slip bowl protector landing shoulder 136 is in contact with the upper slip bowl load shoulder 135. Additionally, as with the shear pin 132, the shear pin 134 has also been sheared by the downward shearing load 128 (see, FIG. 4A) that is imposed on the shear pin 134 by the tab 137*t* extending from the lower end 137 of the slip bowl protector 137, and causing the tab 137*t* to slide downward within the groove 130*g* at the top end of the slip bowl 130. In this way, the end portion 134*e* of the shear pin 134, which substantially remains in the pocket 130*p*, is sheared away from the base portion 134*b*, which substantially remains in the hole 137*h* in the tab 137*t*.

Figure 5A:
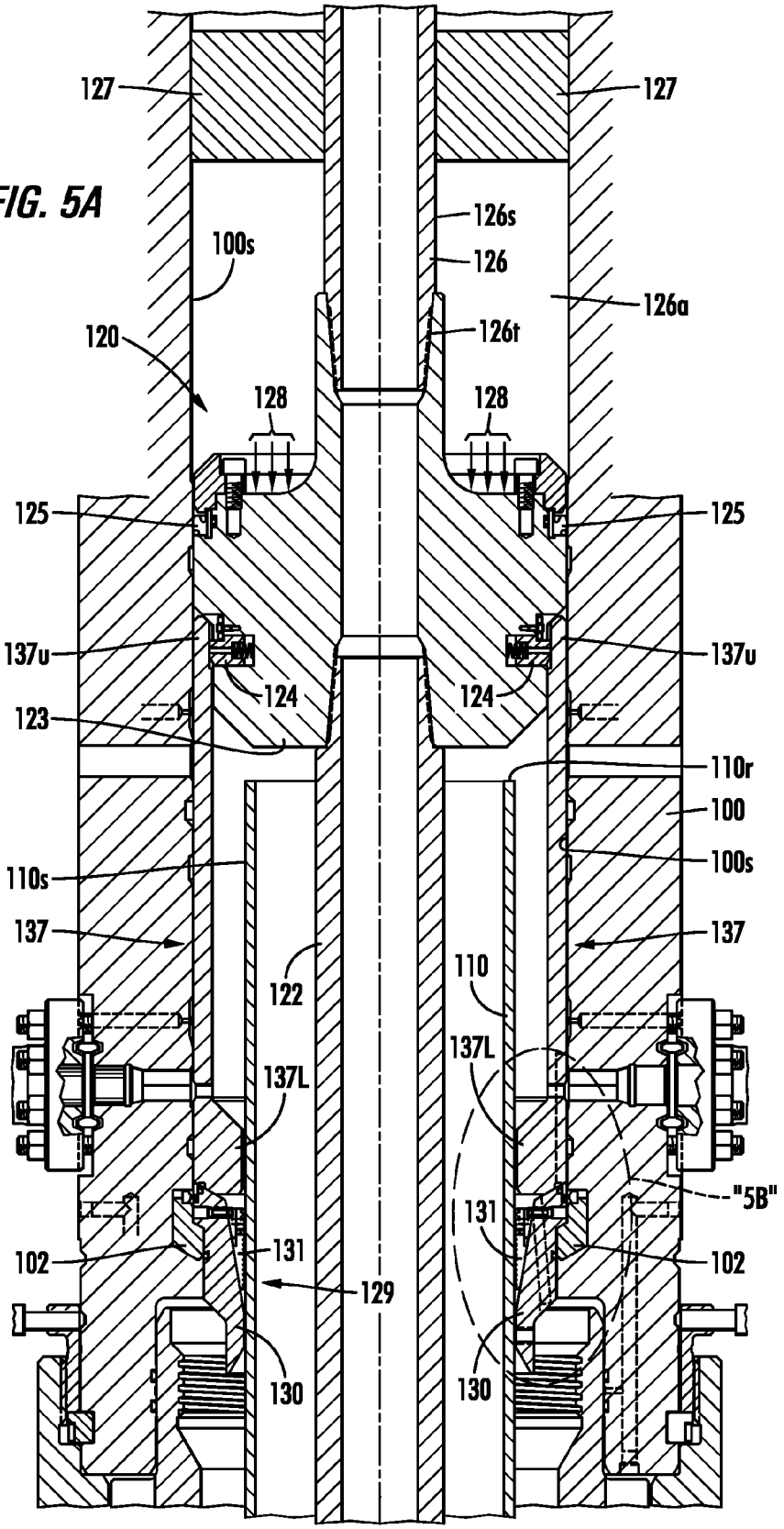
Figure 5B:
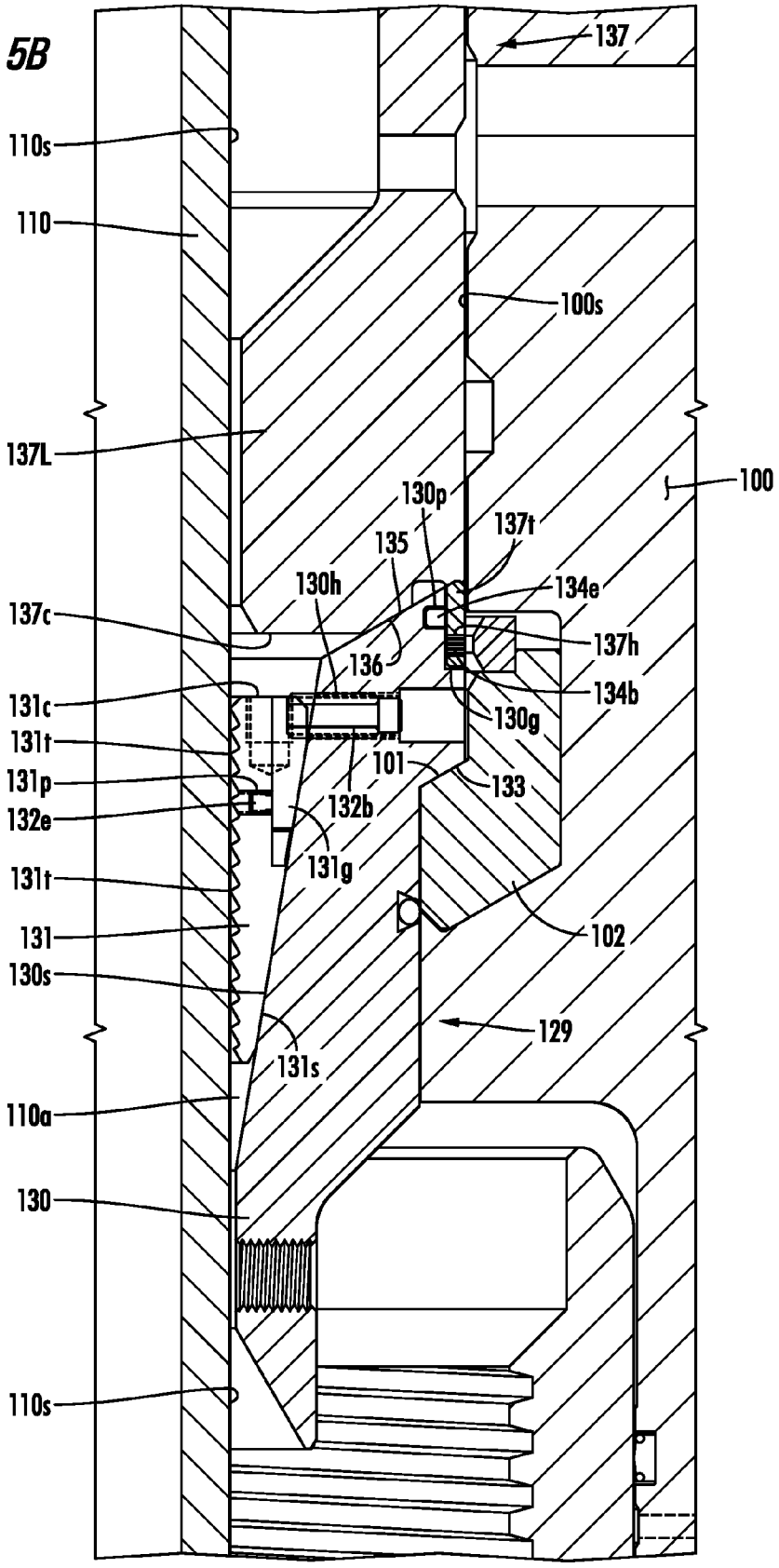

FIG. 5A is a cross-sectional view of the slip hanger running tool assembly 120, the emergency casing slip hanger assembly 129, and the slip bowl protector 137 of FIG. 4A after the shear pins 132 and 134 have been sheared and the slips 131 have fallen down and into contact with the outside surface 110*s* of the casing 110 and while the annular space 126*a* below the BOP rams 127 remains pressurized, and FIG. 5B is a close-up cross-sectional detail view "5B" of the casing slip hanger assembly 129 shown in FIG. 5A. In at least some embodiments disclosed herein, the groove 131*g* in each slip 131 allows the slips 131 to fall down in a substantially unimpeded fashion toward the lower end of the space 110*a* between the casing 110 and the tapered sliding surface 130*s* of the emergency slip bowl 130, such that the teeth 131*t* of the slips 131 are brought substantially into contact with the outside surface 110*s* of the casing 110. Furthermore, the end portion 132*e* of each shear pin 132 remains with a respective slip 131, i.e., in the pocket 131*p*. Additionally, the slips 131 have fallen away from the lower end 137L of the slip bowl protector 137 such that the contact surface 131*c* of each slip 131 is no longer in contact with the contact surface 137*c* at the lower end 137L. However, as shown in FIG. 5B, the lower slip bowl protector landing shoulder 136 remains in contact with the upper slip bowl load shoulder 135 and the tab 137*t* remains in the outer groove 130*g* at the upper end of the slip bowl 130.

Figure 6:
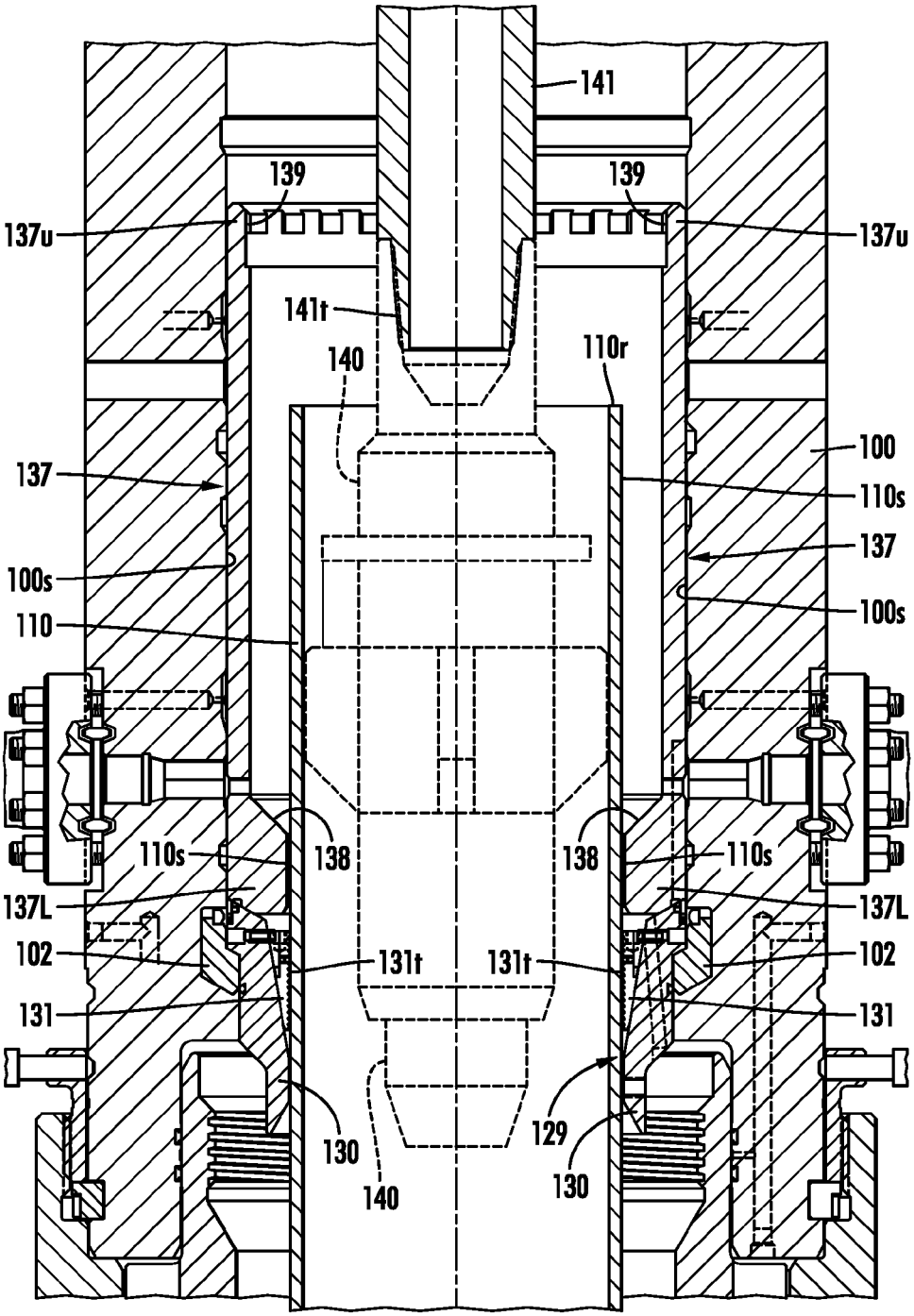
FIG. 6 is a cross-sectional view of the illustrative emergency slip hanger assembly and slip bowl protector of FIG. 5A after the emergency slip hanger running tool assembly has been removed from the wellhead and a schematically depicted casing spear has been run into the casing to set the slips.

FIG. 6 is a cross-sectional view of the wellhead 100, the casing slip hanger assembly 129, and the slip bowl protector 137 of FIG. 5A after the emergency slip hanger running tool assembly 120 has been removed from the wellhead 100. In certain embodiments, spring-loaded dogs 124 on the plug assembly 123 (see, FIGS. 4A and 5A) may be disengaged from the support tabs 139 at the upper end 137*u* of the slip bowl protector 137 by rotating the plug assembly 123 with the drill pipe 126 until each of the dogs 124 clears a respective support tab 139, and thereafter pulling the plug assembly 123 up and away from the slip bowl protector 137. Thereafter, the emergency slip hanger running assembly tool 120 may pulled out of the wellhead 100 and through the blowout preventer (not shown in FIG. 6), thus leaving the casing slip hanger assembly 129 and slip bowl protector 137 landed on the wellhead load shoulder 102.

In some illustrative embodiments, after the emergency slip hanger running tool assembly 120 has been disengaged from the upper end 137 of the slip bowl protector 137 and removed from the wellhead 100, another drill pipe 141 with a casing spear 140 (schematically depicted in FIG. 6) attached thereto along a threaded interface 141*t* may be run down inside of the wellhead 100 and the casing 110 through the BOP (not shown). Once inside of the casing 110, the casing spear 140 may be actuated so as to engage the inside surface of the casing 110, and the casing spear 140 may then be pulled upward in a manner known to those of ordinary skill in order to apply a tension load of sufficient magnitude to the casing 110 so as to set the slips 131, i.e., so that the teeth 131*t* of the slips 131 may bite into, or grab, the outside surface 110*s* of the casing 110. Thereafter, the casing spear 140 may be disengaged from the casing 110 and pulled out of the wellhead 100 through the BOP.

Figure 7:
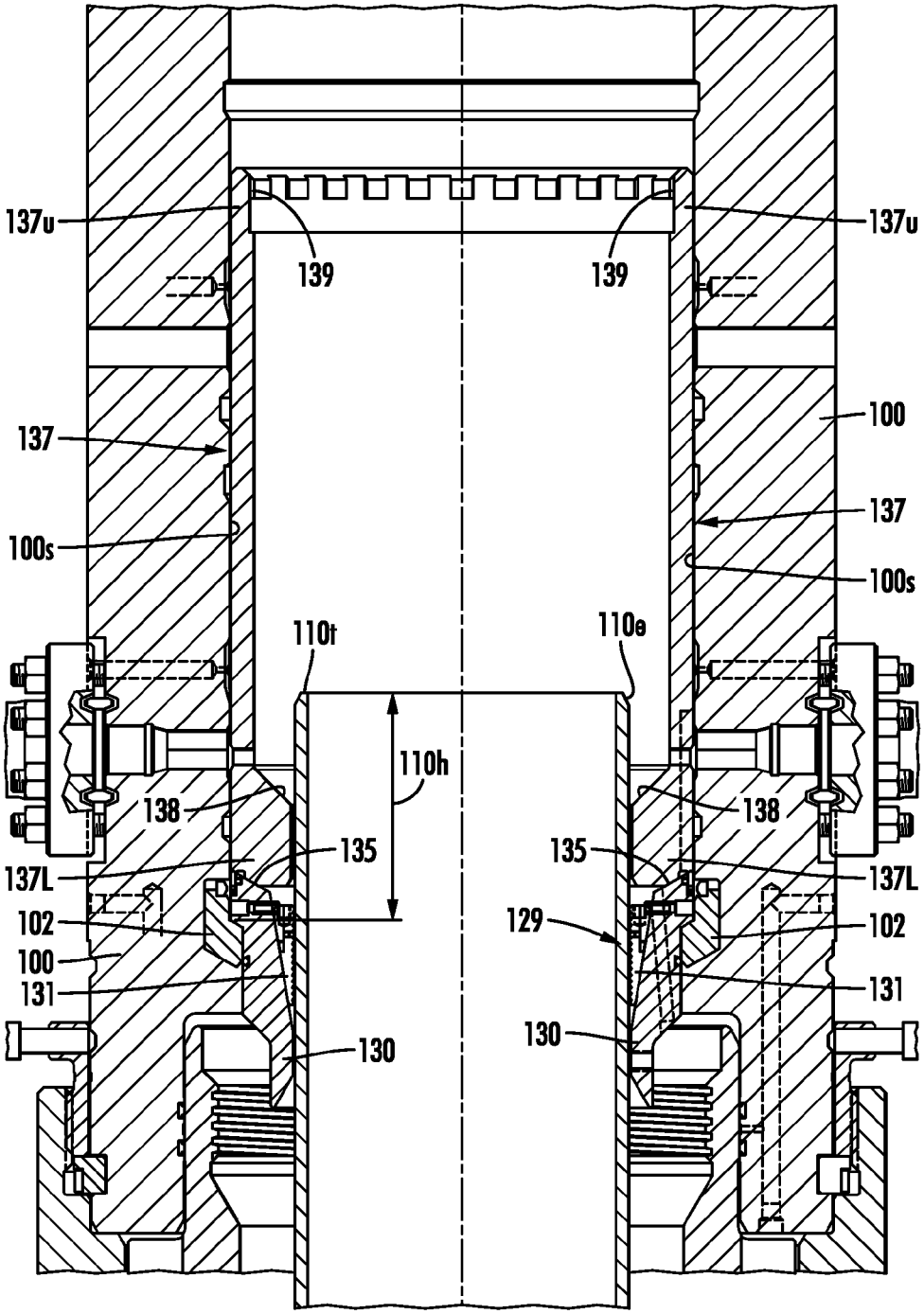
FIG. 7 is a cross-sectional view of the illustrative emergency slip hanger assembly and slip bowl protector of FIG. 6 after a milling tool has been used to trim the stuck casing to length and to prep and chamfer the upper outside edge of the casing.

FIG. 7 is a cross-sectional view of the wellhead 100, the emergency casing slip hanger assembly 129, and slip bowl protector 137 of FIG. 6 during a later operational stage, that is, after the casing spear 140 has been removed from the wellhead 100, and after the stuck casing 110 has been trimmed to a specified height 110*h* above the wellhead load shoulder 102. In some embodiments, a milling tool (not shown) may be lowered through the BOP (not shown) and rung down the wellhead 100 and over the casing 110 until the milling tool is landed on the optional upper slip bowl protector load shoulder 138. Thereafter, the milling tool may be used to trim the casing 110 such that the timed end 110*t* is positioned at the height 110*h* above the wellhead load shoulder 102, which may be established based upon the specific design of the emergency casing packoff assembly 170 (see, FIGS. 9A, 9D, and 9E) that may be used to pack the annular space between the casing 110 and the wellhead 100. Furthermore, the milling tool may also be used to chamfer the upper outside corner 110*e* of the trimmed end 110*t* of the casing 110, as may be required to guide the casing packoff assembly 170 and/or other running tools around the trimmed end 110*t*.

In other embodiments, the slip bowl protector 137 may be pulled out of the wellhead 100 and through the BOP (not shown) prior to performing the trimming and chamfering operation on the casing 110. In such cases, and depending on the specific type and/or design of the milling tool (not shown) used to trim and chamfer the casing 110, the milling tool may be run into the wellhead 100 and over the casing 110 until it is landed on the upper slip bowl load shoulder 135. Thereafter, trimming and chamfering operations on the casing 110 may proceed in a similar manner as noted above.

Figure 8:
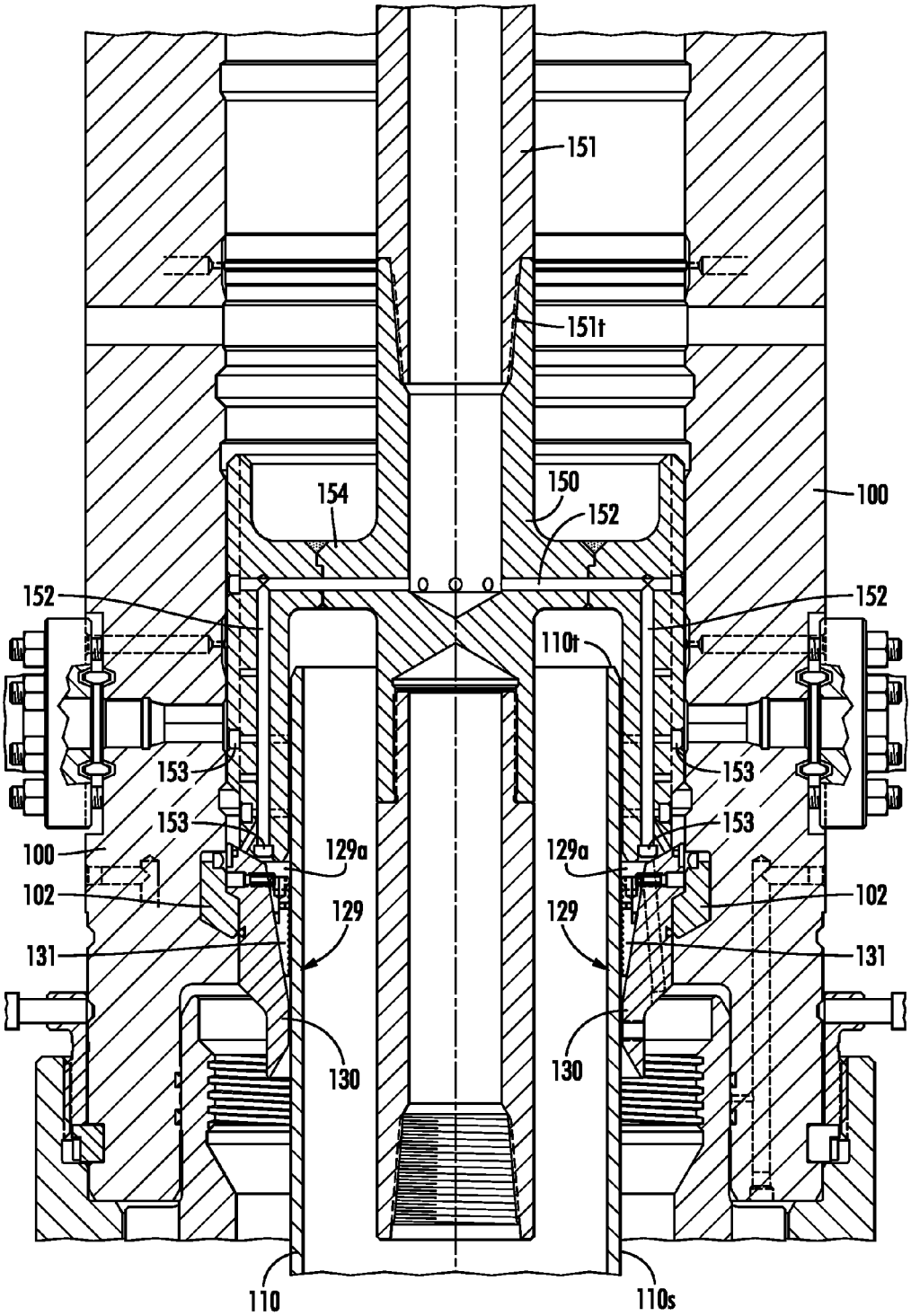
FIG. 8 is a cross-sectional view of the illustrative emergency slip hanger assembly of FIG. 7 after the slip bowl protector has been removed from the wellhead and an illustrative wash tool has been positioned above the emergency slip hanger assembly and trimmed casing to remove debris from the annular space between the trimmed casing and the wellhead.

FIG. 8 is a cross-sectional view of the wellhead 100 and the exemplary emergency casing slip hanger assembly 129 shown in FIG. 7 in a further operation stage. As is shown in FIG. 8, the slip bowl protector 137 has been pulled out of the wellhead 100 through the BOP (not shown) and an illustrative wash tool 150 has been run into the wellhead 100 through the BOP and landed on the upper slip bowl protector load shoulder 138. As will be described in further detail below, the wash tool 150 may be used to clean out any debris that may collected in the annular space 129*a* between the trimmed casing 110 and the wellhead 100 and above the emergency slip bowl 130 during the milling operation described above, such as machining shavings and the like.

In certain embodiments, the slip bowl protector 137 may be retrieved from the wellhead 100 by running the plug assembly 123 (see, FIG. 3) through the BOP (not shown) and back into the wellhead 100 so as to re-engage the spring-loaded dogs 124 on the plug assembly 123 with the support tabs 139 at the upper end 137*u* of the slip bowl protector 137. Thereafter, the plug assembly 123 may be used to pull the slip bowl protector 137 out of the wellhead 100 and through the BOP.

After the slip bowl protector 137 has been removed from above the emergency casing slip hanger assembly 129 and taken out of the wellhead 100 through the BOP (not shown), the wash tool 150 may then be run down through the BOP and into the wellhead 100 until the wash tool 150 has been positioned above the casing slip hanger assembly 129 and landed on the upper slip bowl load shoulder 135. As shown in FIG. 8, the wash tool 150 may be supported by and connected to a drill pipe 151 along the threaded interface 151*t*. In certain embodiments, the wash tool 150 may include a plurality of flow passages 152 running therethrough that are adapted to deliver a high velocity washout fluid, such as water and the like, to at least the annular space 129*a*. In operation, the washout fluid may be pumped down the drill pipe 151 and through the various flow passages 152, from which the fluid then exits at a high velocity so as wash any debris out of the annular space 129*a*. In at least some embodiments, the wash tool 150 is configured such that, due to the high velocity washing action of the washout fluid, the debris may be collected in a debris or junk basket positioned at the upper end of the wash tool 150. In other embodiments, a plurality of magnets 153 may be positioned proximate the exit ports of at least some of the flow passages 152, and the magnets 153 may be adapted to also collect a portion of the debris washed out of the annular space 129*a*.

Figure 9A:
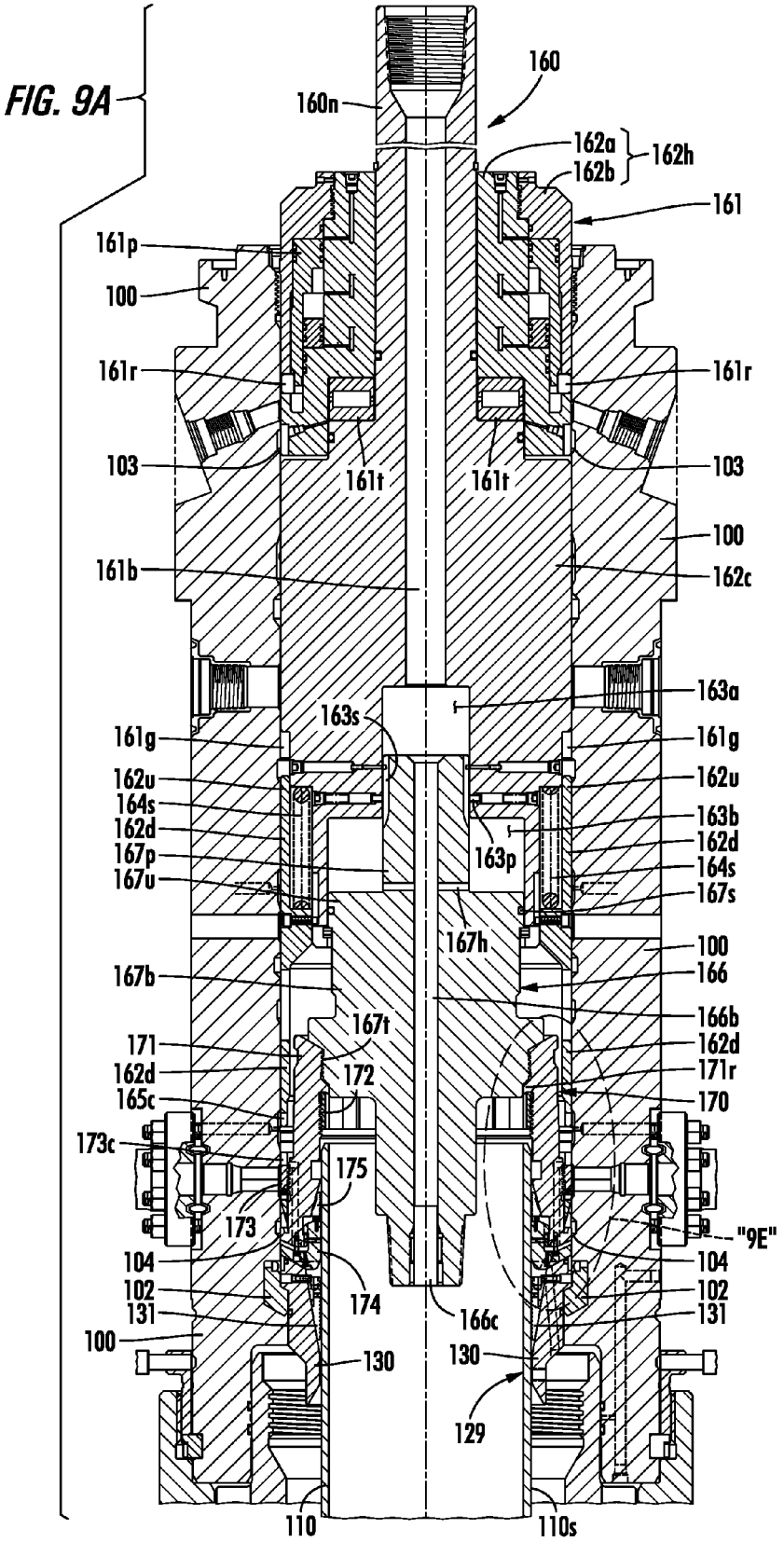
FIG. 9A is a cross-sectional view of the wellhead showing an exemplary hydro-mechanical running tool of the present disclosure landing an illustrative emergency packoff assembly disclosed herein on the illustrative emergency slip hanger assembly of FIGS. 2A-8.

FIG. 9A is a cross-sectional view of the emergency casing slip hanger assembly 129 positioned inside of the wellhead 100 during a further operational stage, after the wash tool 150 has been removed from the wellhead 150. As shown in FIG. 9A, a hydro-mechanical running tool 160 has been used to run an emergency casing packoff assembly 170 into the wellhead 100 through the blowout preventer, or BOP (not shown), and to land the casing packoff assembly 170 on the casing slip hanger assembly 129. In certain exemplary embodiments, the hydro-mechanical running tool 160 may include a lower tool portion 166 and an upper tool portion 161 that is adapted to telescopically engage the lower tool portion 166, as will be further described below. In some embodiments, the upper tool portion 161 may include, among other things, an upper hydraulic housing 162*h* that may be made up of an inner hydraulic housing 162*a* and an outer hydraulic housing 162*b*. Furthermore, the upper tool portion may also include a central rotating body 162*c* and a lower spring-loaded sleeve 162*d* coupled to the central rotating body 162*c*. In other embodiments, the lower tool portion 166 may include a lower body 167*b* and a piston 167*p* that protrudes upward from an upper end 167*u* of the lower body 167*b*. Additional details of the upper and lower tool portions 161 and 166 are illustrated in the close-up cross-sectional views depicted in FIGS. 9B-9D, which will be further described below.

Figure 9B:
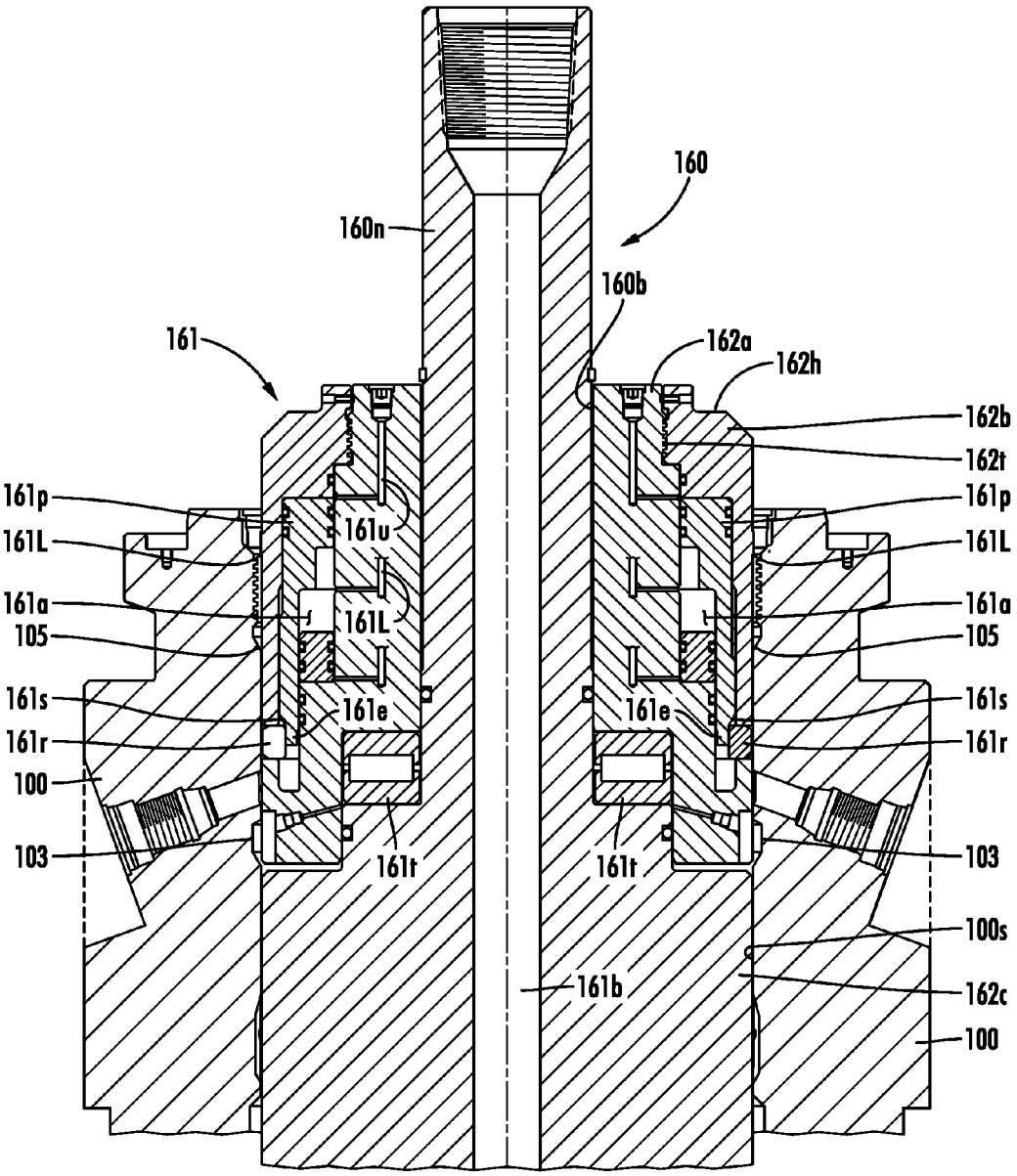
FIGS. 9B-9D are cross-sectional views showing the upper and lower tool portions of the exemplary hydro-mechanical running tool depicted in FIG. 9A.

Referring now to FIG. 9B, the inner hydraulic housing 162*a* is removably coupled to the outer hydraulic housing 162*b* along a threaded interface 162*t*. Additionally, a movable hydraulic piston 161*p* is disposed inside of a cavity 161*a* that is defined inside of the upper hydraulic housing 162*h*, i.e., between the inner and outer hydraulic housings 162*a/b*. In some embodiments, the movable hydraulic piston 161*p* may be adapted to move along a central axis of the upper hydraulic housing 162*h*, e.g., in a substantially vertical direction. The inner hydraulic housing 162*a* may include a plurality of hydraulic fluid flow paths, such as the upper and lower hydraulic flow paths 161*u* and 161L shown in FIG. 9B, which may be used to pressurize the cavity 161*a* with hydraulic fluid so as to slidably move the piston 161*p* to a desired position. For example, when the cavity 161*a* is pressurized with hydraulic fluid from above the piston 161*p* through the upper hydraulic fluid flow paths 161*u*, the piston 161*p* may be slidably moved in a vertically downward direction. Similarly, when the cavity 161*a* is pressurized from below the piston 161*p* through the lower hydraulic fluid flow paths 161L, the piston 161*p* may be slidably moved in a vertically upward direction.

In some embodiments, the outer hydraulic housing 162*b* of the upper hydraulic housing 162*h* may have a landing shoulder 161L that is adapted to land on an upper wellhead support shoulder 105 when the hydro-mechanical running tool 160 is run downward into the wellhead, and the upper wellhead support shoulder 105 may be adapted to support the hydro-mechanical running tool 160 during a subsequent operational stage, as will be further described below. Additionally, an expandable upper lock ring 161*r* may be positioned below a lower end of the outer hydraulic housing 162*b* and adjacent to a tapered surface 161*s* on the vertically movable piston 161*p* that is proximate a lower end 161*e* of the piston 161*p*. In certain embodiments, the expandable upper lock ring 161*r* may be adapted to be positioned radially adjacent to an upper lock ring groove 103 in the wellhead 100 when the landing shoulder 161L on the outer hydraulic housing 162*b* is landed on the upper wellhead support shoulder 105. Furthermore, the expandable upper lock ring 161*r* may be radially expandable into the upper lock ring groove 103 when the vertically movable piston 161*p* is actuated by a hydraulic fluid pressure 162P (see, FIG. 11) that may be provided via the upper hydraulic fluid flow paths 161*u*, thus causing the piston 161*p* to be moved vertically downward through the cavity 161*a*, as will be further described with respect to FIG. 11 below.

In certain exemplary embodiments, the central rotating body 162*c* may include an upper neck 160*n* that protrudes vertically through a bore 160*b* of the inner hydraulic housing 162*a* of the upper hydraulic housing 162*h*, such that the upper hydraulic housing is disposed around the neck 160*n*. As shown in FIG. 9B, the central rotating body 162*c* may also have a bore 161*b* that runs for substantially the entire length of the central rotating body 162*c*, including the neck 160*n*. See also, FIG. 9C. Furthermore, in at least some embodiments, the central rotating body 162*c* may be adapted to rotate relative to the upper hydraulic housing 162*h* and the lower tool portion 166 during at least some operational stages, such as the operational stage depicted in FIGS. 13A-13D and described below. Accordingly, as is shown in FIG. 9B, a thrust bearing 161*t* may be positioned between the central rotating body 162*c* and the inner hydraulic housing 162*a* of the upper hydraulic housing 162*h* so as to facilitate the rotation of the central rotating body 162*c* relative to the upper hydraulic housing 162*h* while a pressure is being applied to at least the central rotating body 162*c* and the lower tool portion through the bore 161*b*, as will be further described below in additional detail.

Figure 9C:
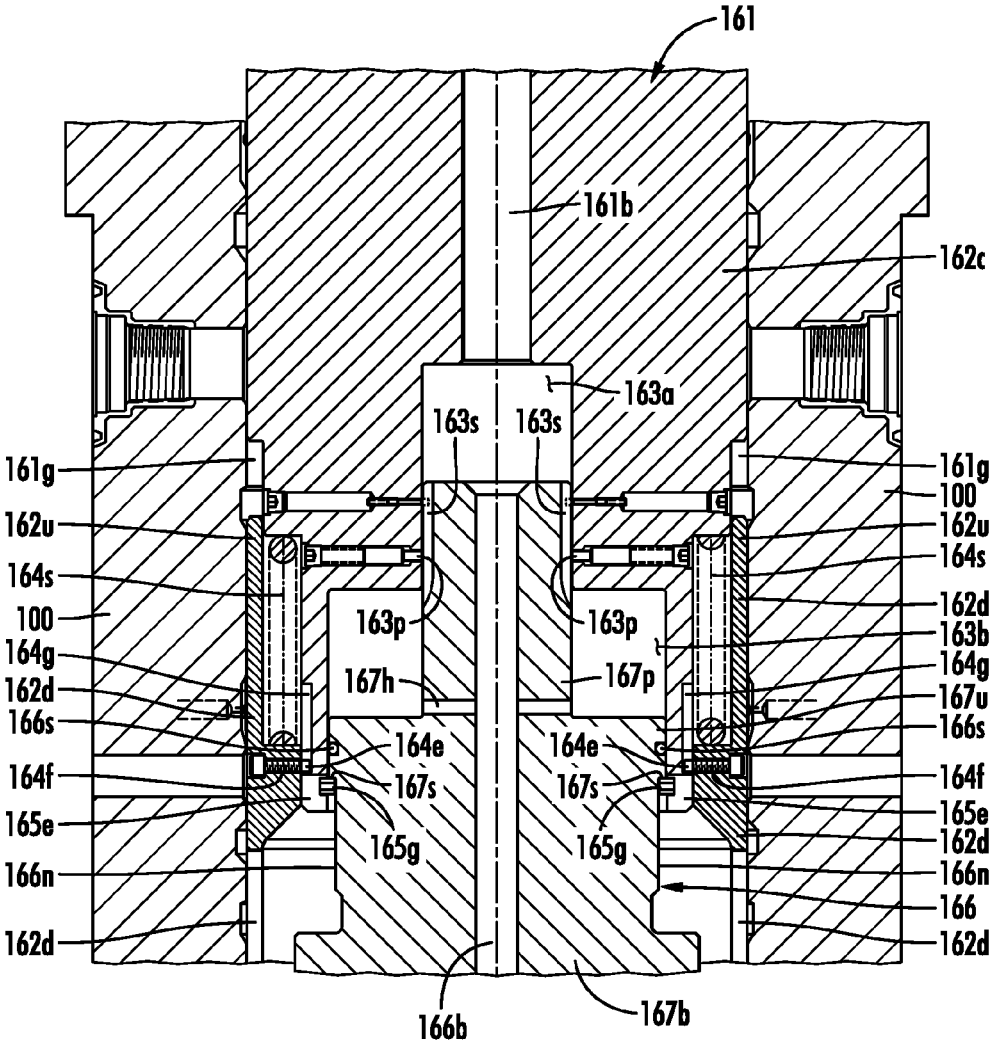

FIG. 9C is a close-up cross-sectional of the telescoping interface between the upper and lower tool portions 161 and 166 of the hydro-mechanical running tool 160. As shown in FIG. 9C, the lower tool portion 166 may include a lower body 167*b* (see also, FIG. 9D) and a piston 167*p* protruding vertically upward from the upper end 167*u* of the lower body 167*b*. Additionally, the lower tool portion 166 may also have a bore 166*b* that runs through both the piston 167*p* and the lower body 167*b*, i.e., for substantially the entire length of the lower tool portion 166. In some embodiments, the piston 167*p* of the lower tool portion 166 may be adapted to be received by and slide, or telescope, substantially vertically within an upper rotating body cavity 163*a* of the central rotating body 162*c*. Additionally, the upper end 167*u* of the lower body 167*b* may be adapted to be received by a lower rotating body cavity 163*b* of the central rotating body 162*c*. Furthermore, the upper end 167*u* may also be adapted to slide, or telescope, substantially vertically within the lower rotating body cavity 163*b*. In at least some embodiments, a seal ring 166*s*, such as, for example, an elastomeric seal ring and the like, may be positioned in a groove that is located proximate the upper end 167*u* of the lower body 167*b*, and the seal ring may be adapted to affect a pressure-tight seal between the lower body 167*b* and the inside surface of the lower rotating body cavity 163*b* as the piston 167*p* slides within the upper rotating body cavity 163*a* and the upper end 167*u* of the lower body 167*b* slides with the lower rotating body cavity 163*b*.

In certain embodiments, the bore 161*b* running through the central rotating body 162*c* of the upper tool portion 161 may be in direct fluid communication with the upper rotating body cavity 163*a*. Furthermore, the upper rotating body cavity 163*a*, the bore 166*b* running through the piston 167*p*, and one or more radially oriented holes 167*h* extending from the bore 166*b* to the outer surface of the piston 167*p* may also provide indirect fluid communication between the bore 161*b* and the lower rotating body cavity 163*b*. In this way, the lower rotating body cavity 163*b* may be pressurized so as to impart a downward load on the telescoping lower tool portion 166, as will be further discussed below.

As is further shown in FIG. 9C, an upper end 162*u* of the lower spring-loaded sleeve 162*d* may be adapted to be received within an outer slot or groove 161*g* in the central rotating body 162*c*. Additionally, the groove 161*g* may be adapted to permit a sliding movement of the upper end 162*u* of the lower spring-loaded sleeve 162*d* relative to the central rotating body 162*c* during at least the telescoping movement of the lower tool portion 166 relative to the upper tool portion 161. In some embodiments a spring 164*s* (schematically depicted in FIG. 9C) may be coupled to both the central rotating body 162*c* and the lower spring-loaded sleeve 162*d*, and the spring 164*s* may be adapted to slidably move the upper end 162*u* of the lower spring-loaded sleeve 162*d* within the groove 161*g*.

In certain illustrative embodiments, a plurality of pins or fasteners 164*f* may be used to slidably and removably attach the lower spring-loaded sleeve 162*d* to the central rotating body 162*c*. For example, the fasteners 164*f*, which may be, e.g., socket head cap screws and the like, may be threadably engaged into corresponding threaded holes in the lower spring-loaded sleeve 162*d* such that an end 164*e* of each of the fasteners 164*f* extends into a slot or groove 164*g* in an outer surface of the central rotating body 162*c* and proximate a lower end 165*e* thereof. When engaged in this fashion, the fasteners 164*f* may act to keep the lower spring-loaded sleeve 162*d* attached to the central rotating body 162*c*, and furthermore may permit a sliding movement of the ends 164*e* within the groove 164*g* as the upper end 162*u* of the lower spring-loaded sleeve 162*d* is received by, and slidably moved within, the groove 161*g*.

In at least some embodiments, a removable guide ring 165*g*, such as a split ring and the like, may be attached to the central rotating body 162*c* proximate the lower end 165*e* thereof, and may be used to support the lower tool portion 166 from the upper tool portion 161 as the hydro-mechanical running tool 160 is run into the wellhead 100. For example, the guide ring 165*g* may be adapted to contactingly engage a support shoulder 167*s* on the lower body 167*b*, thus transferring the dead load of the lower tool portion 166 to the support shoulder 167*s*. The guide ring 165*g* may be further adapted to facilitate and maintain alignment between the central rotating body 162*c* and a neck 166*n* of the lower body 167*b* as the guide ring 165*g* slidably moves along the neck 165*n* during the telescoping movement between the upper tool portion 161 and the lower tool portion 166.

As is depicted in the illustrative embodiment of the hydro-mechanical running tool 160 shown in FIG. 9C, the central rotating body 162*c* of the upper tool portion 161 may include a plurality of spring-loaded pins 163*p* that extend radially inward from the outside of the central rotating body 162*c*. In certain embodiments, the spring-loaded pins 163*p* may be adapted to be extended into corresponding vertical grooves or slots 163*s* in the piston 167*p* so as to transfer a torque, or rotational load, to the lower tool portion 166 during a subsequent operational stage, as will be further described in conjunction with FIGS. 13A-13D below.

Figure 9D:
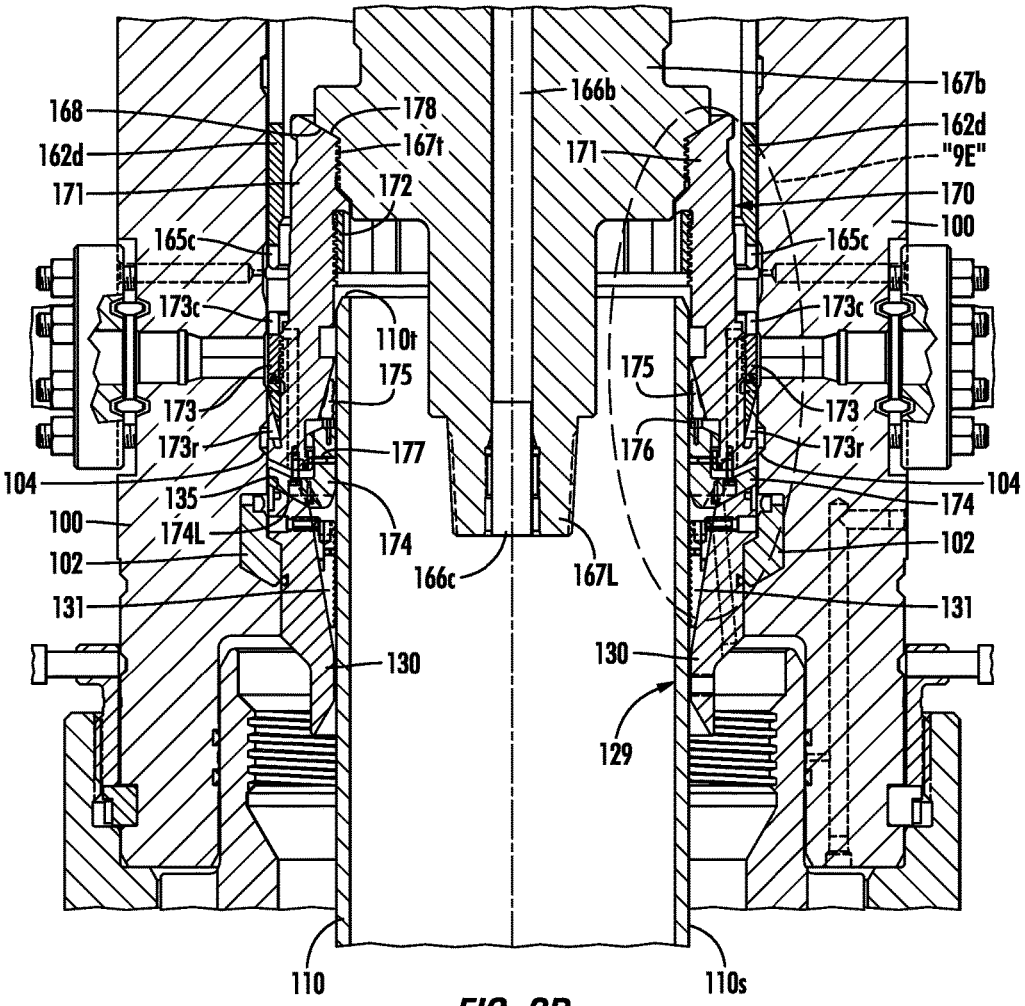

Referring now to FIG. 9D, the emergency casing packoff assembly 170 may be removably coupled to and supported by the lower tool portion 166 of the hydro-mechanical running tool 160 along the threaded interface 167*t*. In certain embodiments, the lower body 167*b* of the lower tool portion 166 may be threadably engaged with the casing packoff assembly 170 such that a lower body landing shoulder 168 of the lower tool portion 166 contactingly engages an upper packoff body support shoulder 178 of the casing packoff assembly 170. Furthermore, the emergency casing packoff assembly 170 may have a lower packoff assembly landing shoulder 174L that, in the operational stage depicted in FIG. 9D, is landed on and supported by the upper slip bowl load shoulder 135. Also as is shown in FIG. 9D, a check valve 166*c* may be coupled to a lower end 167L of the lower body 167*b* and inside of the bore 166*b*, and which may be adapted to maintain pressure within the bore 166*b* of the lower tool portion 166 and within the bore 161*b* and the upper and lower rotating body cavities 163*a/b* of the upper tool portion 161 during a subsequent operational stage, as discussed below.

In some embodiments, the lower spring-loaded sleeve 162*d* may have a plurality of castellations 165*c* at a lower end thereof that are adapted to engage with a corresponding plurality of castellations 173*c* on an upper end of a lock ring energizing mandrel 173 so as to transfer a torque, or rotational motion, to the lock ring energizing mandrel 173 during a later operational stage. In this way, the lock ring energizing mandrel 173 may be actuated so as to expand a lower lock ring 173*r* into a corresponding lower lock ring groove 104 in the wellhead 100, thus locking the casing packoff assembly 170 into place inside of the wellhead 100, as will be further described below with respect to FIGS. 13A-13E.

Figure 9E:
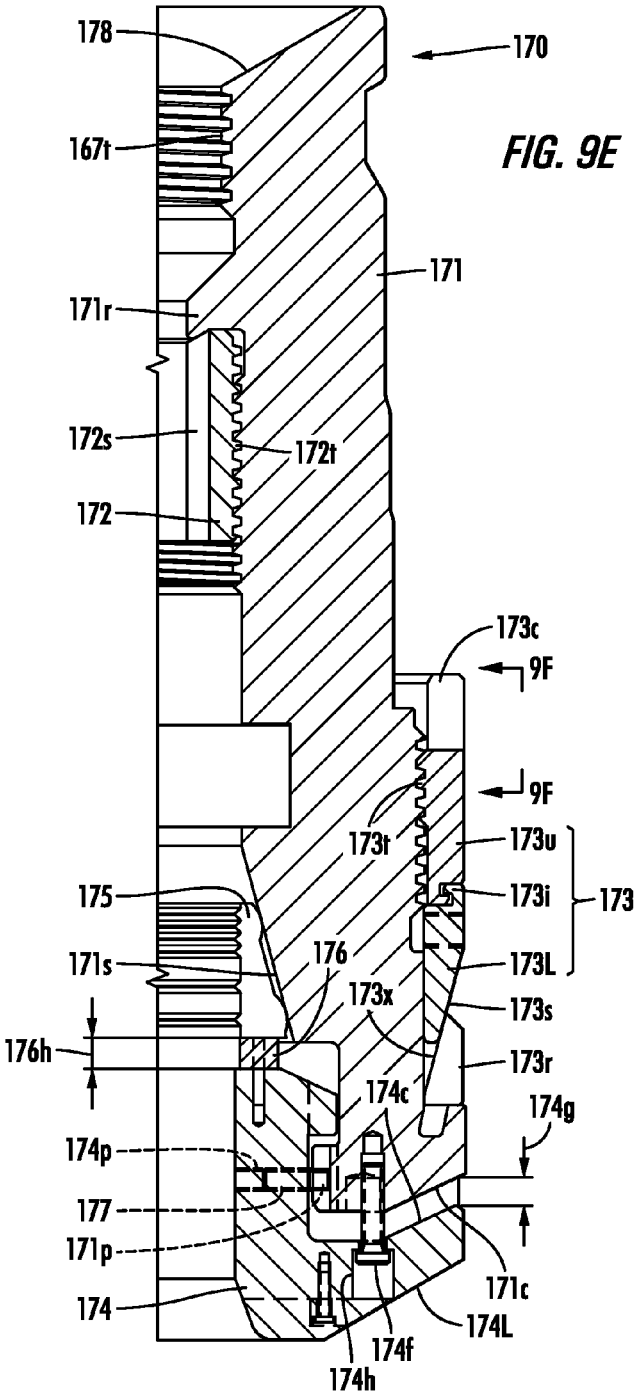
FIG. 9E is close-up cross-sectional detail view "9E" of the illustrative emergency packoff assembly shown in FIGS. 9A and 9D.
Figure 9F:
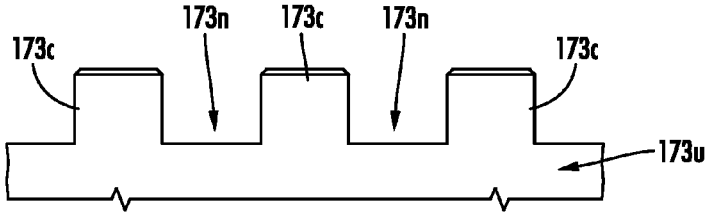
FIG. 9F is a close-up side elevation detail view "9F-9F" of the castellated interface of the exemplary upper lock ring energizing mandrel depicted in FIG. 9E.

FIG. 9E is close-up cross-sectional view "9E" of the illustrative emergency casing packoff assembly 170 shown in FIGS. 9A and 9D. As shown in FIG. 9E, the casing packoff assembly 170 may include an upper packoff body 171 and a lower packoff body 174, and the lower packoff body 174 may have a lower packoff assembly landing shoulder 174L that may be adapted to land on and be supported by the upper slip bowl load shoulder 135. See, FIG. 9D. In certain embodiments, the casing packoff assembly 170 may include a rigidizing sleeve 172 that is threadably attached to the upper packoff body 171 along the threaded interface 172*t* and below a rigidizing shoulder 171*r*. In some embodiments, the rigidizing sleeve 172 may include a plurality of slots 172*s*, each of which may be adapted to engage a rigidizing tool 180 (see, FIGS. 14 and 15), as will be further described below. Furthermore, the casing packoff assembly 170 may also include a metal seal ring 175, such as a rough casing metal seal, or "RCMS," which may be used to affect a pressure-tight metal to metal seal between a seating surface 171*s* on the upper packoff body 171 of the emergency casing packoff assembly 170 and the outside surface 110*s* of the casing 110 (see, FIG. 9D).

In some embodiments, the lower packoff body 174 may be coupled to the upper packoff body 171 with, for example, a plurality of shear pins 177, each of which may be adapted to be inserted into and through a corresponding pin hole 174*p* in the lower packoff body 174 and into a corresponding pocket in the upper packoff body 171. In certain embodiments, the shear pins 177 may be adapted to be sheared, and an upper contact surface 174*c* of the lower packoff body 174 may be brought into contact with a lower contact surface 171*c* of the upper packoff body 171, when the metal seal ring 175, e.g., a rough casing metal seal (RCMS) 175, is seated or energized during a later operational stage, as will be further described below. Additionally, in order to stabilize the position of the pinned lower packoff body 174 as the emergency casing packoff assembly 170 is being lowered through the BOP and into the landed position above the emergency casing slip hanger assembly 129, the lower packoff body 174 may be attached to the upper packoff body 171 with a plurality of fasteners, such as socket head cap screws and the like. In this way, a load may be imposed on each of the plurality of shear pins 177 by the sidewalls of the pin holes 174*p* and the pockets 171*p*, thus holding each of the shear pins 177 in place.

In at least some embodiments, such as when the fasteners 174*f* have been used to attach and stabilize the lower packoff body 174, the head of each fastener 174*f* may be countersunk into a counterbored hole 174*h* of the lower packoff body 174. Accordingly, when the shear pins 177 are sheared during the subsequent seating operation of the RCMS 175 (described below), the head of each fastener 174*f* may be allowed to move in a vertical direction within the counterbored hole 174*h* so that the upper and lower contact surfaces 174*c* and 171*c* may be brought into contact in a substantially unrestricted manner.

As is shown in the exemplary embodiment of the casing packoff assembly 170 illustrated in FIG. 9E, the lower packoff body 174 may initially be vertically separated from the upper packoff body 171 by an initial gap 174*g*. The size of the initial gap 174*g* may depend on at least some of the various design parameters of the casing packoff assembly 170, including the nominal size and/or thickness of the casing 110, the type and configuration of the rough casing metal seal (RCMS) 175, the anticipated operating conditions (pressure and/or temperature) of the wellhead 100, and the like. For example, in at least some illustrative embodiments, the initial gap 174*g* may be in the range of approximately 6-9 mm (¼" to ⅜"), although other gap sizes may also be used, depending on the various packoff assembly design parameters, as noted above. Furthermore, in order to establish the requisite initial gap 174*g*, a shim 176 may be positioned between the RCMS 175 and the lower packoff body 174, wherein, in certain embodiments, the height 176*h* of the shim 176 may substantially correspond to the size of the initial gap 174*g*.

As noted previously, the emergency casing packoff assembly 170 may also include a lock ring energizing mandrel 173, which may be threadably coupled to the upper packoff body 171 at the threaded interface 173*t*. As noted previously, the lock ring energizing mandrel 173 may be adapted to energize, or expand, the lower lock 173*r* into the corresponding lower lock ring groove 104 in the wellhead 100 (see, FIG. 9D). As shown in FIG. 9E, the lock ring energizing mandrel 173 may include an upper mandrel sleeve 173*u*—which may be threadably attached to the upper packoff body 171 as noted above—and a lower mandrel sleeve 173L. In some exemplary embodiments, the upper mandrel sleeve 173*u* may have a castellated interface that may be made up of a plurality of castellations 173*c*, each of which may be separated by corresponding notches 173*n*, as is illustrated in the close-up side elevation view "9F-9F" of the castellated interface of FIG. 9F. In other embodiments, the upper mandrel sleeve 173*u* may engage the lower mandrel sleeve 173L at a slidable interlocking interface 173*i*. Furthermore, the slidable interlocking interface 173*i* may be adapted to permit the upper mandrel sleeve 173*u* to be rotated relative to the lower mandrel sleeve 173L when the upper mandrel sleeve 173*u* is threadably rotated up and/or down the threaded interface 173*t* with the upper packoff body 171 while still maintaining a sliding contact between the upper and lower mandrel sleeves 173*u* and 173L.

In certain embodiments, the lower mandrel sleeve 173L may have an outside tapered surface 173*s* at a lower end thereof that is adapted to slidably engage a corresponding inside tapered surface 173*x* of the lower lock ring 173*r*. Accordingly, as the lower mandrel sleeve 173L is pushed downward by the upper mandrel sleeve 173*u* as the upper mandrel sleeve 173*u* is threadably rotated along the threaded interface 173*t*, the outside tapered surface 173*s* of the lower mandrel sleeve 173L may be slidably moved along the inside tapered surface 173*x* of the lower lock ring 173*r*, thereby energizing, or expanding, the lower lock ring 173*r* into the lower lock ring groove 104 of the wellhead 100, as will be further described with respect to FIGS. 13A-13E below.

Figure 10A:
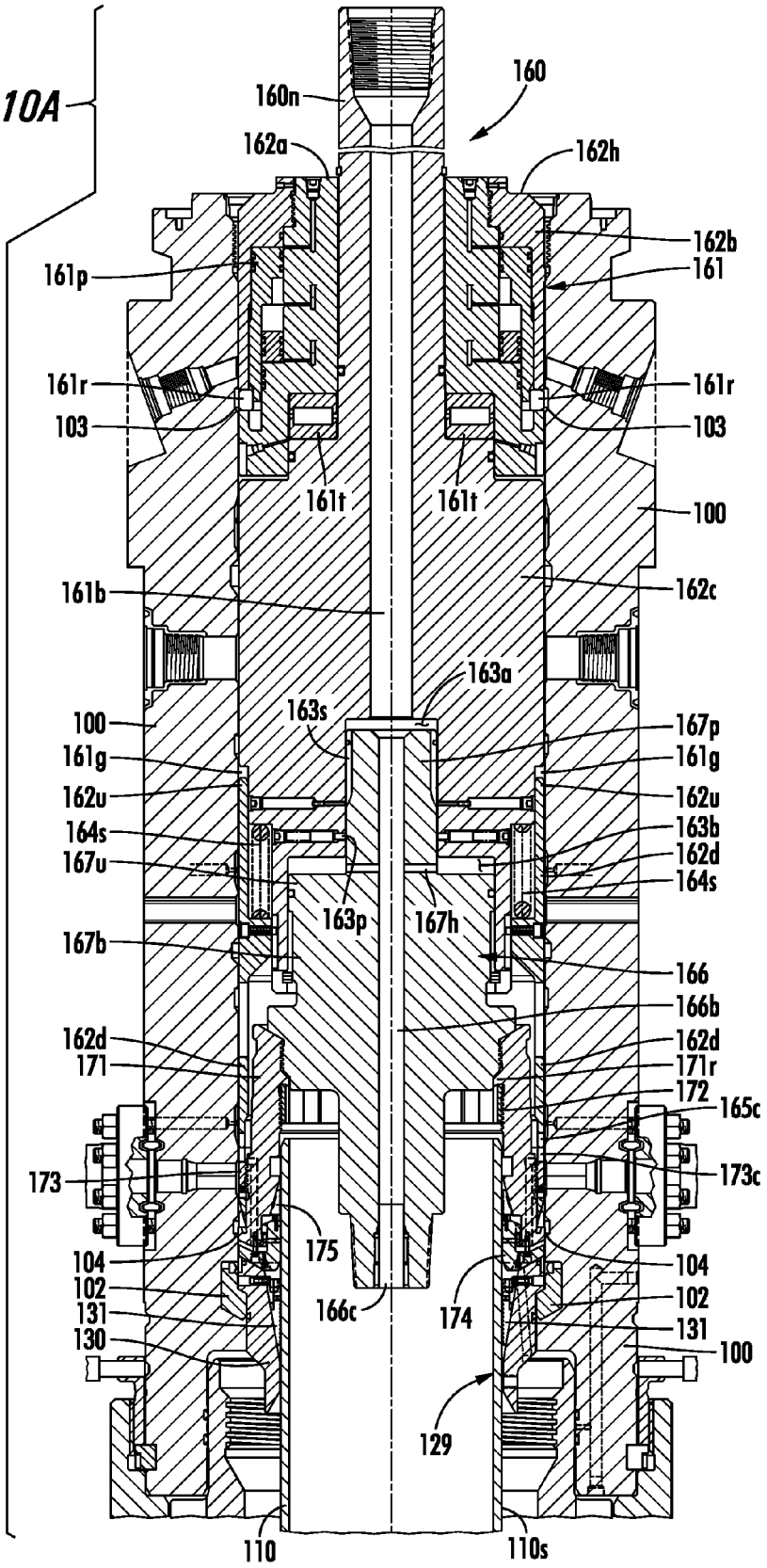
FIG. 10A is a cross-sectional view of the wellhead showing the illustrative hydro-mechanical running tool and emergency packoff assembly of FIGS. 9A-9E after the upper hydraulic housing of the hydro-mechanical running tool has been landed in the wellhead.

FIG. 10A is a cross-sectional view of the wellhead 100 showing the illustrative hydro-mechanical running tool 160 and emergency casing packoff assembly 170 of FIGS. 9A-9E in a further operational stage of installing and setting the casing packoff assembly 170. As is shown in FIG. 10A, the lower tool portion 166 and the casing packoff assembly 170 attached thereto remain substantially in place, i.e., with the lower packoff assembly landing shoulder 174L landed on and supported by the upper slip bowl load shoulder 135 of the casing slip hanger assembly 129. See, FIG. 9D. However, in the operational stage depicted in FIG. 10A, the upper tool portion 161 has been further lowered into the wellhead 100 relative to the lower tool portion 166, thus collapsing the telescoping interface between the upper and lower tool portions 161, 166. See, FIG. 10C, further described below. Moreover, in some illustrative embodiments, the upper lock ring 161*r* may be substantially aligned with the upper lock ring groove 103 of the wellhead 100, as is illustrated in further detail in FIG. 10B and discussed below.

Figure 10B:
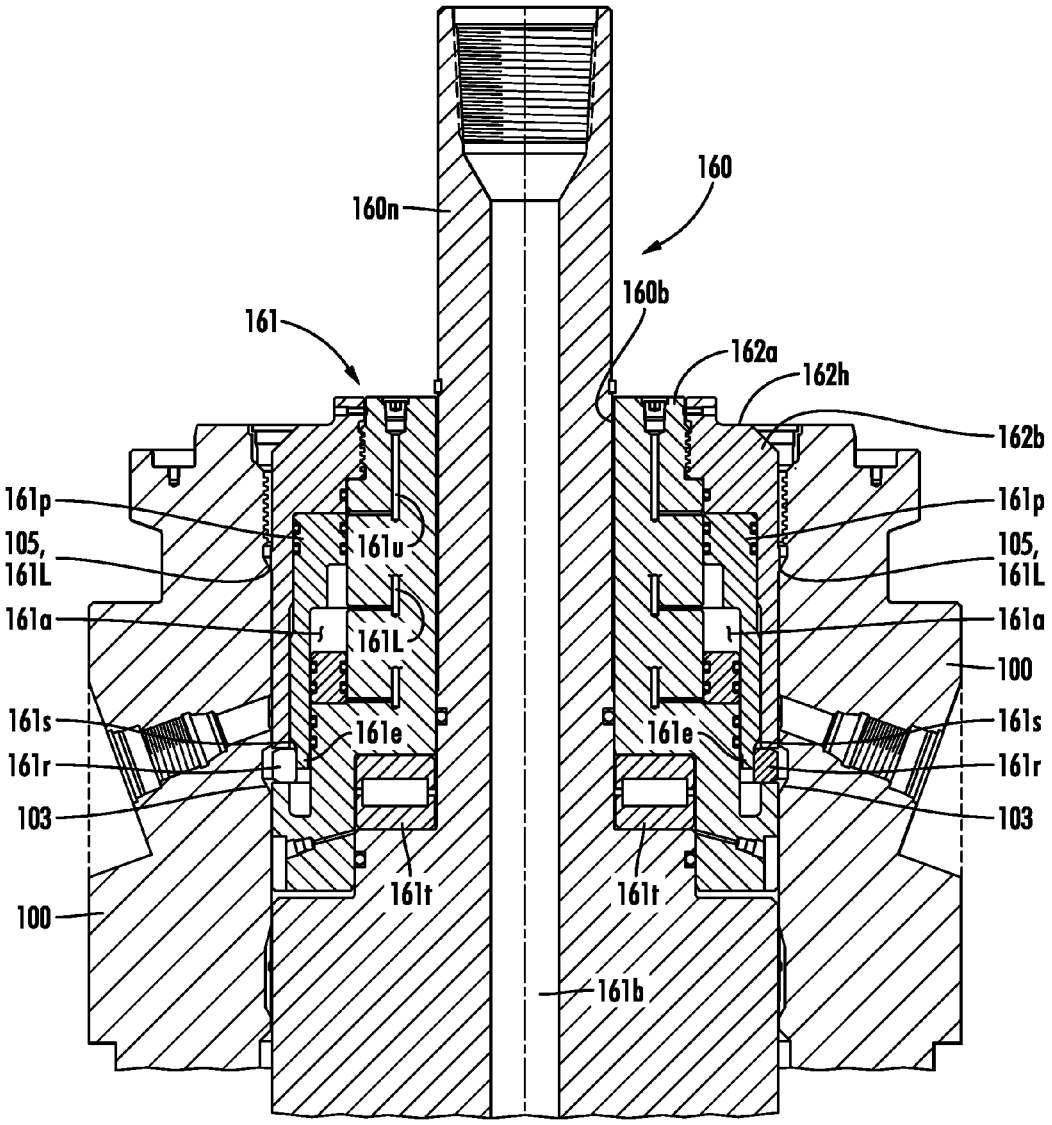
FIGS. 10B-10D are cross-sectional views showing the upper and lower tool portions of the exemplary hydro-mechanical running tool depicted in FIG. 10A.

FIG. 10B is a further detailed cross-sectional view of the telescoping interface between the upper and lower tool portions 161 and 166 of the of the hydro-mechanical running tool 160. As shown in FIG. 10B, the upper tool portion 161 has been further lowered into the wellhead 100 as previously described until the landing shoulder 161L of the outer hydraulic housing 162*b* has been landed on and supported by the upper wellhead support shoulder 105. Furthermore, in the position depicted in FIG. 10B, the upper lock ring 161*r* may be substantially aligned with the upper lock ring groove 103.

Figure 10C:
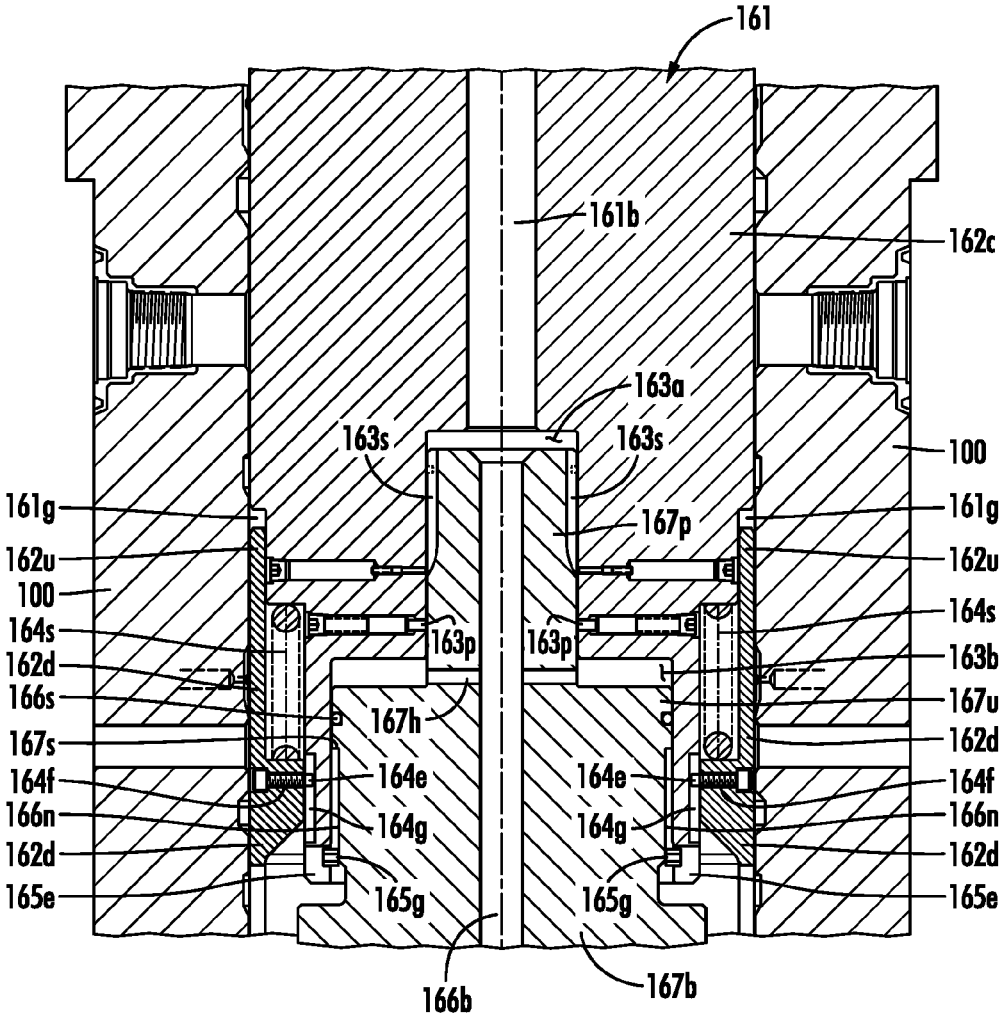

As previously noted, the telescoping action between the upper and lower tools portions 161 and 166 may allow the upper tool portion 161 to be lowered further into the wellhead 100 while the lower tool portion 166 and the emergency casing packoff assembly 170 remain substantially stationary within the wellhead 100, i.e., landed on the emergency casing slip hanger assembly 129. Referring now to FIG. 10C, as the upper tool portion 161 moves downward relative to the lower tool portion 166, the piston 167*p* and the upper end 167*u* of the lower body 167*b* may move further up into the respective upper and lower rotating body cavities 163*a* and 163*b* until the landing shoulder 161L of the outer hydraulic housing 162*b* has been landed on the upper wellhead support shoulder 105, as previously described with respect to FIG. 10B. Furthermore, during this operational stage, the spring 164*s* coupling the lower spring-loaded sleeve 162*d* to the central rotating body 162*c* may be compressed as the upper end 162*u* of the lower spring-loaded sleeve 162*d* moves further up into the groove 161*g*, the ends 164*e* of the fasteners 164*f* move upward within the groove 164*g*, and the guide ring 165*g* moves downward along the outside of the neck 166*n* of the lower body 164*b*.

Figure 10D:
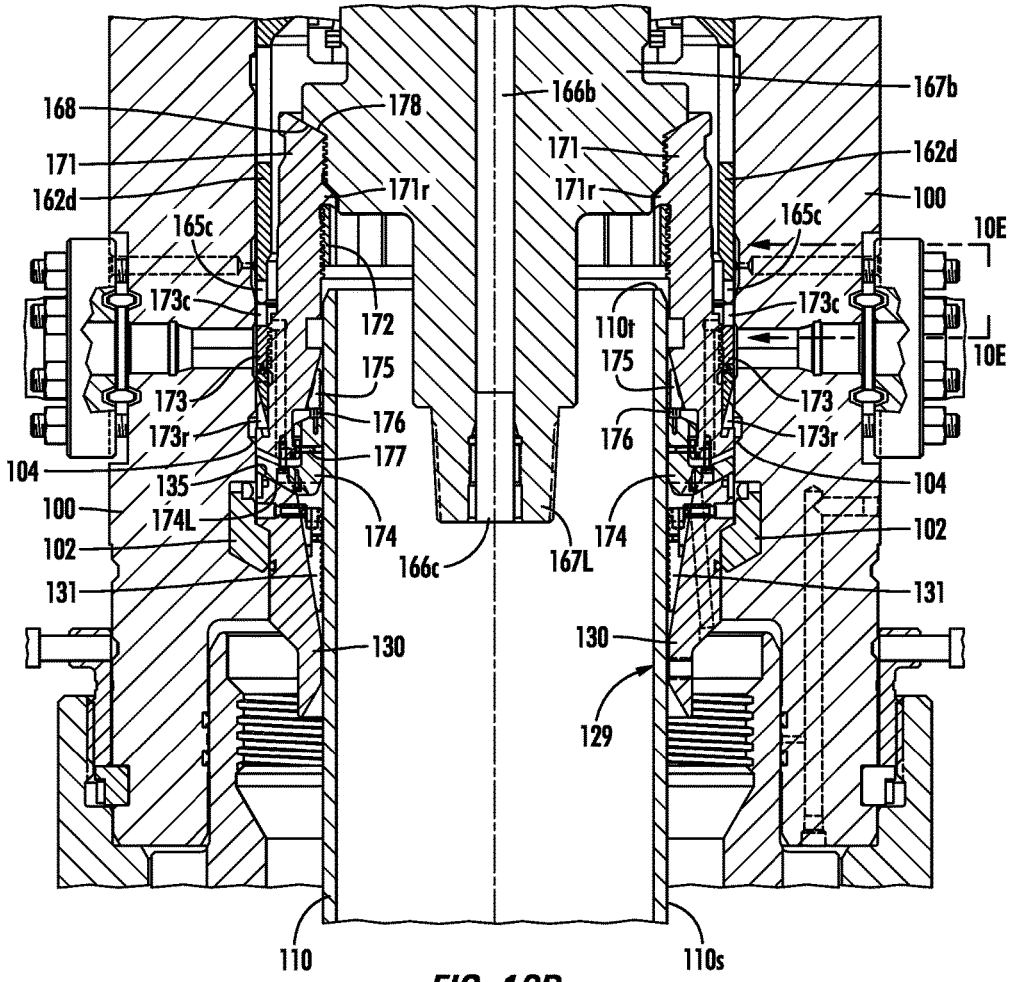

Referring now to the further detailed cross-sectional view depicted in FIG. 10D and showing the lower tool portion 166 and the casing packoff assembly 170, in the illustrative operational stage depicted in FIGS. 10A-10D, the lower end of lower spring-loaded sleeve 162*d* may be lowered proximate the lock ring energizing mandrel 173. As shown in FIG. 10D, the plurality of castellations 165*c* at the lower end of the lower spring-loaded sleeve 162*d* may be brought adjacent to, or even substantially into contact with, the plurality of castellations 173*c* on the lock ring energizing mandrel 173. Furthermore, in those embodiments wherein the castellations 165*c* are brought into contact with the castellations 173*c*, the contact therebetween may be held by action of the spring 164*s* (see, FIG. 10C), which may compress during the telescoping movement between the upper tool portion 161 and the lower tool portion 166.

Figure 10E:
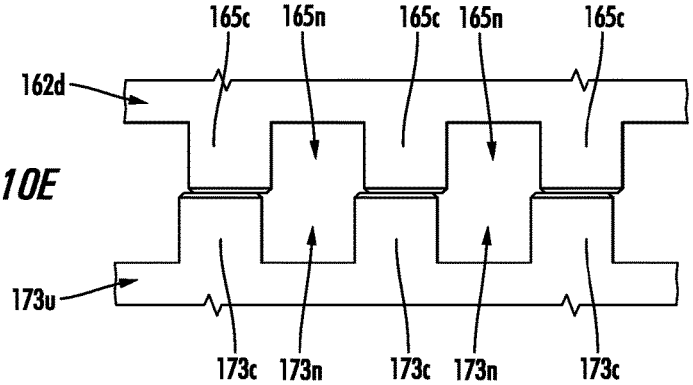
FIG. 10E is a close-up side elevation detail view "10E-10E" of FIGS. 10D and 12B showing the castellated interface of the exemplary upper lock ring energizing mandrel positioned adjacent to the castellated interface at the lower end of a lower spring loaded sleeve of the hydro-mechanical running tool.

For example, FIG. 10E illustrates a close-up side elevation view of one exemplary embodiment of the castellated interface between the lower spring-loaded sleeve 162*d* and the lock ring energizing mandrel 173 depicted in FIG. 10D when viewed along the view line "10E-10E." As shown in FIG. 10E, the lower spring-loaded sleeve 162*d* and the lock ring energizing mandrel 173 may be oriented relative to one another such that each of the castellations 165*c* on the lower spring-loaded sleeve 162*d* may be positioned above and substantially aligned with a corresponding castellation 173*c* on the upper mandrel sleeve 173*u* (see, FIG. 9E). Additionally, the notches 165*n* may also be similarly positioned and aligned with respect to the notches 173*n*. Furthermore, as is shown in the illustrative embodiment depicted in FIGS. 10D and 10E, the castellations 165*c* may be in contact with the castellations 173*c*, and may be thusly held in place by the compressed spring 164*s*, as previously noted.

Figure 11:
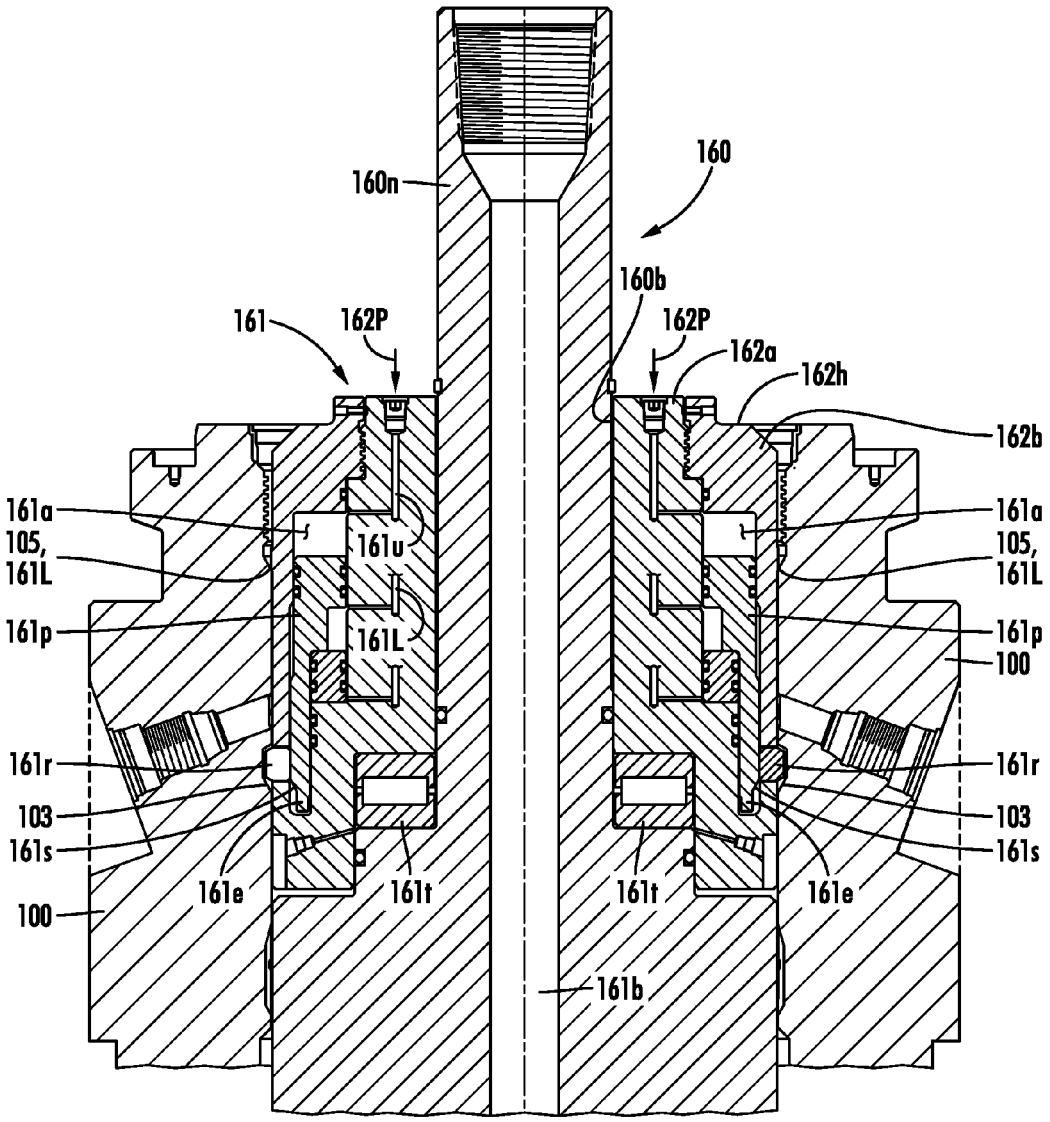
FIG. 11 is a cross-sectional view showing the exemplary inner and outer hydraulic housings of the hydro-mechanical running tool depicted in FIGS. 10A and 10B after the upper hydraulic housing has been used to lock the illustrative hydro-mechanical running tool into the wellhead.

FIG. 11 is a cross-sectional view showing the upper hydraulic housing 162*h* of the hydro-mechanical running tool 160 depicted in FIGS. 10A and 10B in a further operational stage. As is shown in FIG. 11, hydraulic fluid pressure 162P may be provided to the cavity 161*a* in the upper hydraulic housing 162*h* via the upper hydraulic fluid flow paths 161*u*, thus causing the vertically movable piston 161*p* to be moved vertically downward through the cavity 161*a*. In some embodiments, as the piston 161*p* moves vertically downward, the tapered surface 161*s* proximate the end 161*e* of the piston 161*p* may slidingly engage an upper inside corner of the upper lock ring 161*r*, which may thereby cause the upper lock ring 161*r* to expand radially outward into the upper lock ring groove 103. With the upper lock ring 161*r* in this position, i.e., expanded into the upper lock ring groove 103, the engagement between the upper lock ring 161*r* and the upper lock ring groove 103 may therefore provide a reaction point for a pressure thrust load that may be imposed on the lower tool portion 166 of the hydro-mechanical running tool 160 during a later operational stage, as will be further described with regard to FIGS. 12A-13E below. In at least some embodiments, once the vertically movable piston 161*p* had been moved downward so as to expand the upper lock ring 161*r* as described above, the hydraulic fluid pressure 162P may be released, as the piston 161*p* may remain in the down position due to gravity and/or a radial compressive load on the piston that may be caused by a tensile stresses induced in the expanded upper lock ring 161*r*.

Figure 12A:
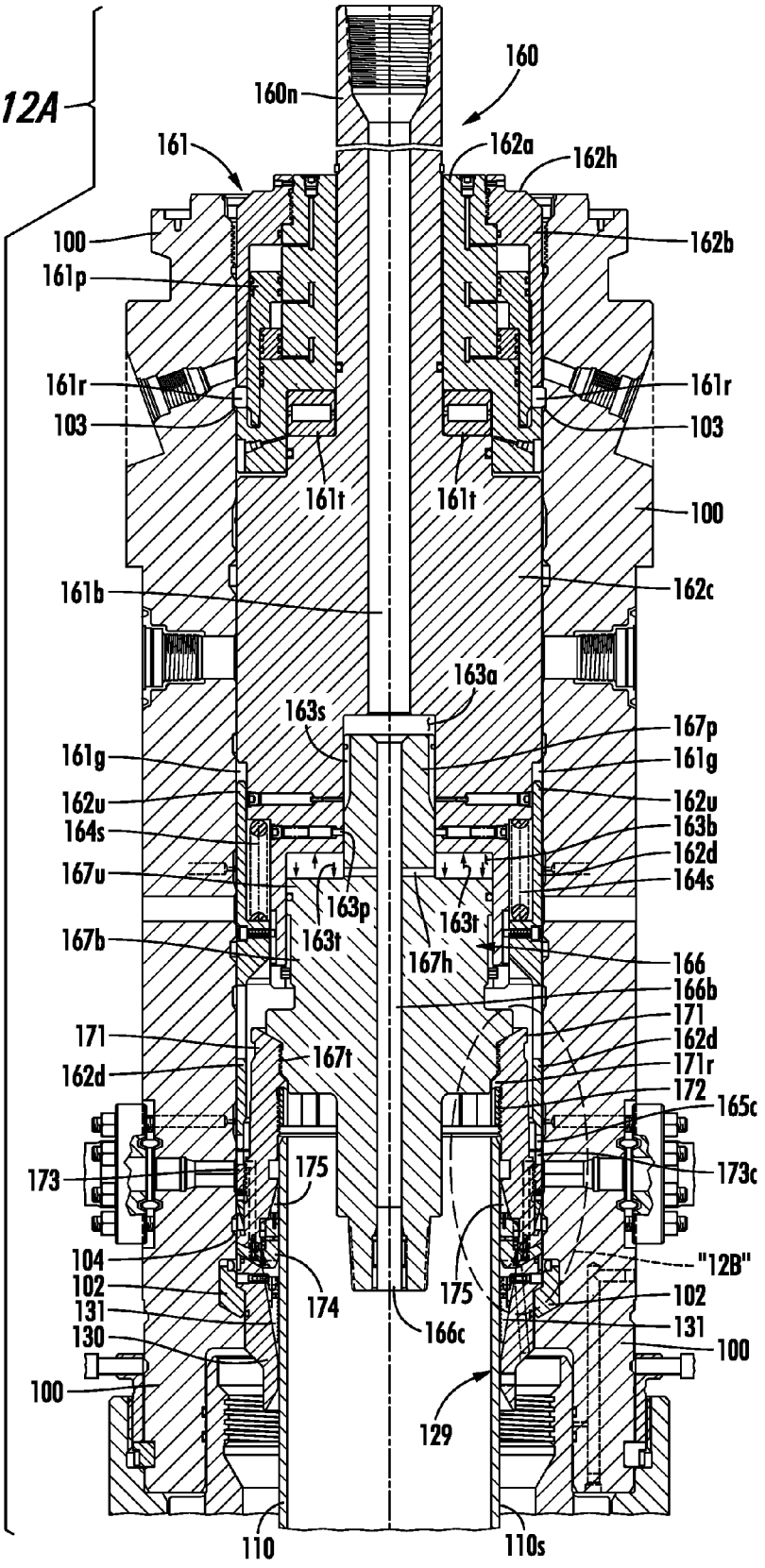
FIG. 12A is a cross-sectional view showing the illustrative hydro-mechanical running tool of FIGS. 9A-11 after pressure has been applied to seat the rough casing metal seal against the stuck casing and the emergency packoff assembly.
Figure 12B:
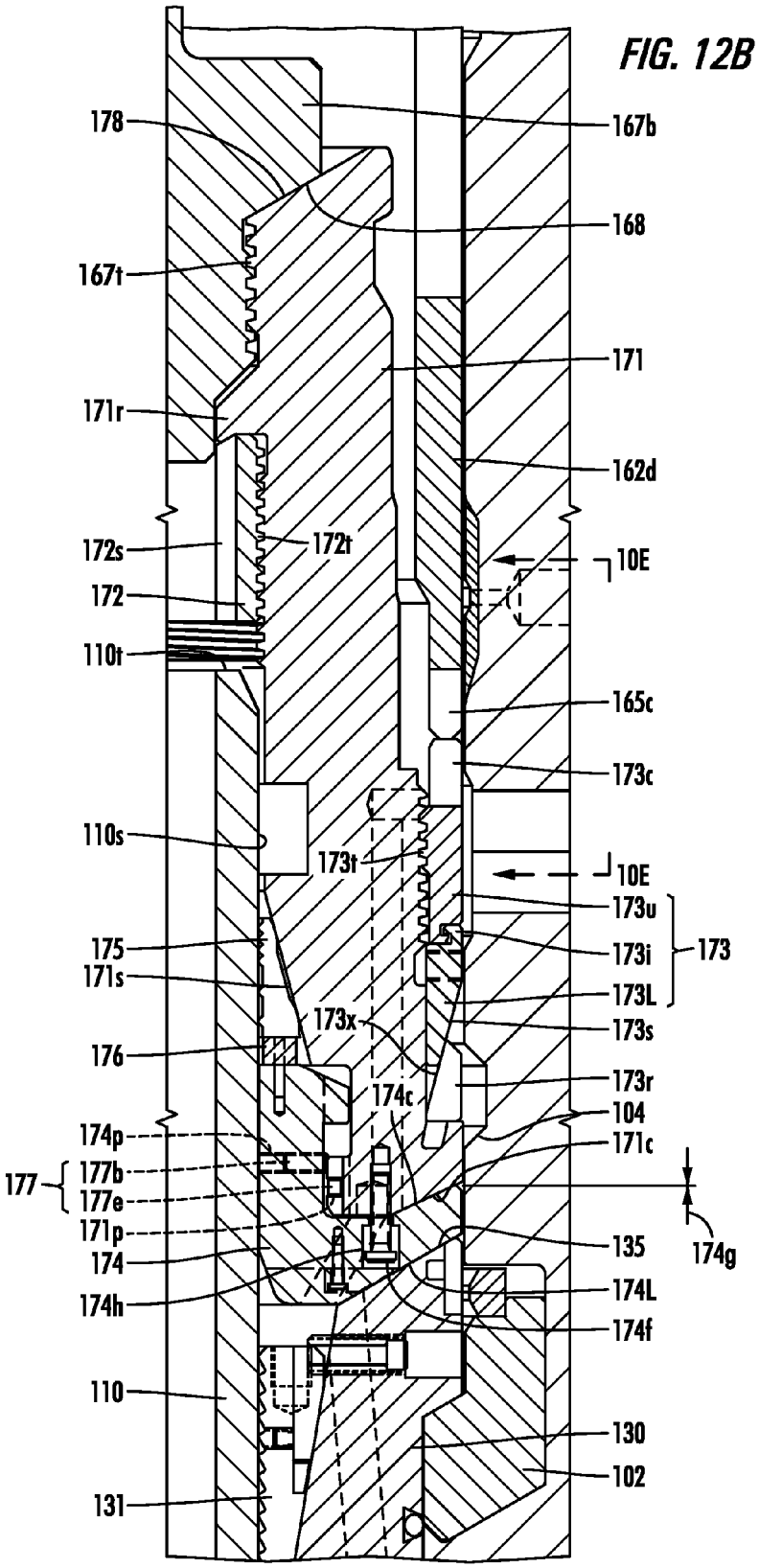
FIG. 12B is a close-up cross-sectional detail view "12B" of the illustrative emergency packoff assembly shown in FIG. 12A.

FIG. 12A is a cross-sectional view showing the illustrative hydro-mechanical running tool 160 of FIGS. 9A-11 after a seal ring energizing pressure (indicated by arrows 163*t* within the lower rotating body cavity 163*b*) has been applied to the hydro-mechanical running tool 160 so as to energize or seat the rough casing metal seal 175 against the outside surface 110*s* of the casing 110 and the seating surface 171*s* on the upper packoff body 171 of the emergency casing packoff assembly 170 (see, FIG. 12B). In certain exemplary embodiments of the present disclosure, the seal ring energizing pressure 163*t* may be introduced to the bore 161*b* of the upper tool portion 161 of the hydro-mechanical running tool 160 from, for example, a drill pipe (not shown) that may be threadably attached to the neck 160*n* of the central rotating body 162*c*. As noted with respect to FIG. 9*c* above, the pressure 163*t* in the bore 161*b* may be communicated to the lower rotating body cavity 163*b* via the upper rotating body cavity 163*a*, the bore 166*b* of the lower tool portion 166, and the plurality of radially oriented holes 167*h* extending through the piston 167*p*. In some embodiments, the energizing pressure 163*t* within the lower rotating body cavity 163*b* may thereby exert a downward pressure thrust load on the upper end 167*u* of the lower body 167*b* of the lower tool portion 166 and a corresponding upward pressure thrust load on the central rotating body 162*c*. The upward pressure thrust load on the central rotating body 162*c* may in turn be reacted by a reaction load between the upper lock ring 161*r* and the upper lock ring groove 103 in the wellhead 100, as previously described with respect to FIG. 11 above. Furthermore, in certain illustrative embodiments, the downward pressure thrust load on the upper end 167*e* of the lower body 167*b* may in turn be reacted by a reaction load between the upper and lower packoff bodies 171 and 174, and thereby also act to energize, or seat, the rough casing metal seal (RCMS) 175, as will be addressed in additional detail in conjunction with FIG. 12B below.

It should be understood by those of ordinary skill after a complete reading of the present disclosure that the level of the seal ring energizing pressure 163*t* imposed on the hydro-mechanical running tool 160 so as to seat the RCMS 175 may depend on the various design parameters of the casing packoff assembly 170 and the RCMS 175. For example, the energizing pressure level may be established based on the design and/or operation conditions (e.g., pressure and/or temperature) of the wellhead 100 and the casing 110, the specific configuration and/or material of the RCMS 175, the material and/or surface condition of the casing 110, the material strength and/or hardness of the upper packoff body 171 along the seating surface 171*s*, and the like. In at least some exemplary embodiments, the energizing pressure level may be at least approximately 700 bar (10,000 psi), although it should be understood that other energizing pressure levels, either higher or lower, may also be used depending on one or more of the various exemplary design parameters outlined above.

FIG. 12B is a close-up cross-sectional view "12B" of the illustrative emergency casing packoff assembly 170 shown in FIG. 12A after the RCMS 175 has been seated against the outside surface 110*s* of the casing 110 and against the seating surface 171*s* of the upper packoff body 171. As shown in FIG. 12B, the upper packoff body 171 has moved downward relative to the lower packoff body 174 due to the pressure thrust load on the lower body 167*b* of the lower tool portion 166, as previously described. Furthermore, the downward relative movement of the upper packoff body 171 has acted to shear the end 177*e* of each shear pin 117 away from the respective shear pin base 177*b*, such that the end 177*e* has remained in the pocket 171*p* and moved downward with the upper packoff body 171, whereas the base 177*b* has remained inside of the pin hole 174*p* and with the lower packoff body 174. Additionally, the lower contact surface 171*c* of the upper packoff body 171 may be brought into contact with the upper contact surface 174*c* of the lower packoff body 174, such that the gap 174*g* between the upper and lower packoff bodies may be substantially zero, i.e., no gap.

Also as shown in FIG. 12B, the downward movement of the upper packoff body 171 relative to the lower packoff body 174 may result in the head of each fastener 174*f* moving vertically downward within the counterbored hole 174*h*, as previously discussed with respect to FIG. 9E above. Furthermore, in at least some illustrative embodiments, the plurality of castellations 165*c* at the lower end of the lower spring-loaded sleeve 162*d* may remain in contact with the plurality of castellations 173*c* on the upper mandrel sleeve 173*u* (see, FIG. 10E) throughout the downward seating movement of the upper packoff body 171. For example, the castellations 165*c* and 173*c* may remain in contact due at least in part to the amount compression that may be induced in the spring 164*s* as a result of the telescoping movement between the upper and lower tool portions 161 and 166 during the operations that are performed to lock the upper tool portion 161 into place with the upper lock ring 161*r*. See, FIGS. 10A-11.

Figure 13A:
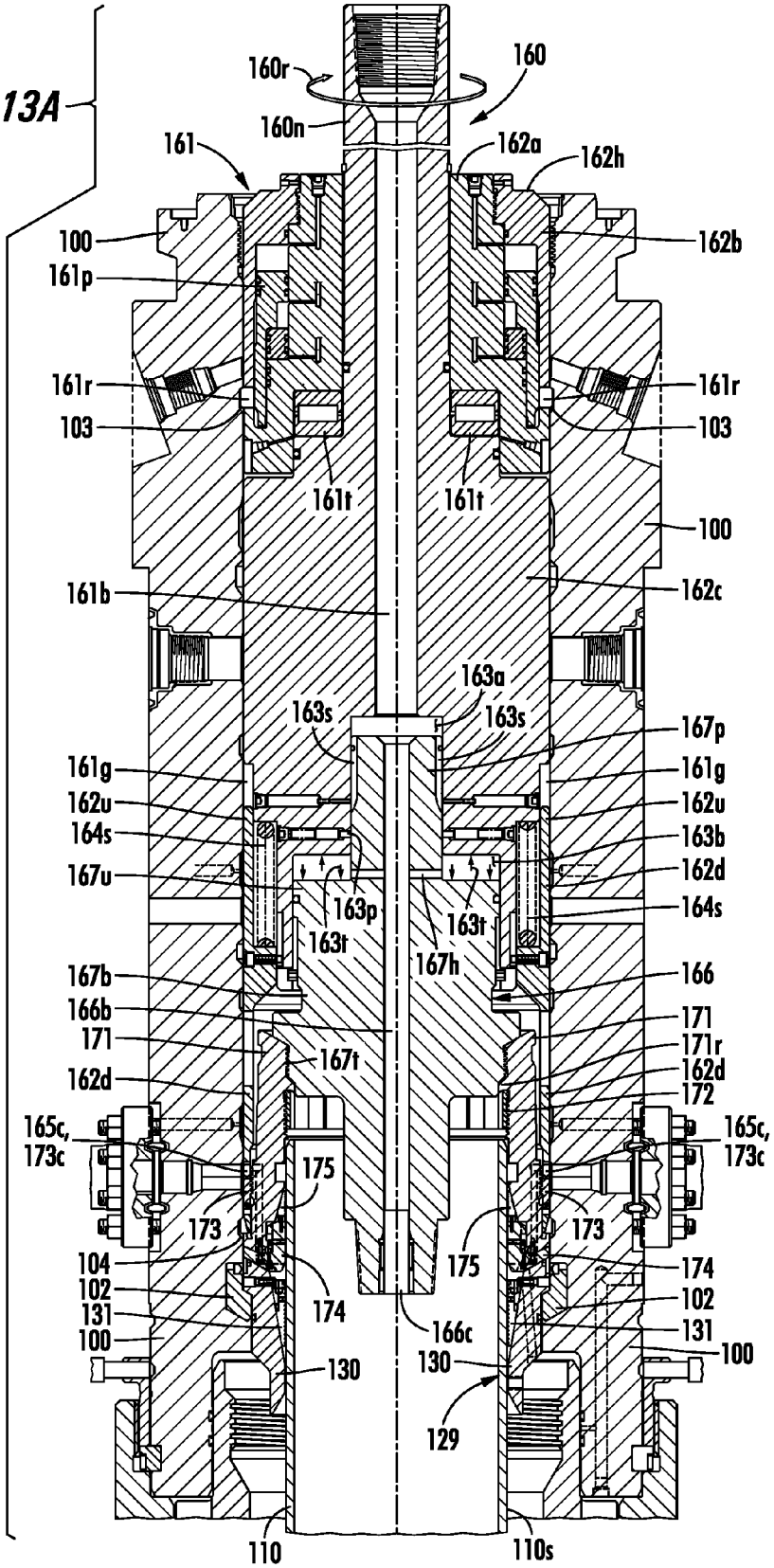
FIG. 13A is a cross-sectional view of the wellhead showing the exemplary hydro-mechanical running tool of FIGS. 12A-12B being used to set and lock the illustrative emergency packoff assembly in the wellhead while the hydro-mechanical running tool is under pressure.

FIG. 13A is a cross-sectional view of the wellhead 100 and the exemplary hydro-mechanical running tool 160 of FIGS. 12A-12B during a further operational stage of setting and locking the illustrative emergency casing packoff assembly 170 in the wellhead 100. In at least some embodiments, this packoff locking operation may be performed while the seal ring energizing pressure 163*t*, e.g., a 700 bar (10,000 psi) pressure, is maintained on the hydro-mechanical running tool 160. In this way, the downward pressure thrust seating load on the rough casing metal seal (RCMS) 175 may be substantially maintained throughout the packoff locking operation, thus providing at least some assurances that the metal to metal seal between the RCMS 175 and the surfaces 110*s* and 171*s* (see, FIG. 12B) is not relaxed and/or unseated prior to locking the casing packoff assembly 170 into place.

As is shown in FIG. 13A, a rotational load 160*r*, or torque, may be applied to the neck 160*n* of the hydro-mechanical running tool 160, for example, by way of an attached drill pipe (not shown), while the seal ring energizing pressure 163*t* is maintained thereon. In certain illustrative embodiments, the rotational load 160*r* may act to initially engage the castellated interface between the lower end of the lower spring-loaded sleeve 162*d* and the lock ring energizing mandrel 173, and thereafter cause the lock ring energizing mandrel 173 to energize, or expand, the lower lock ring 173*r* into the lower lock ring groove 104, as will be further described with respect to FIGS. 13C and 13D below.

Figure 13B:
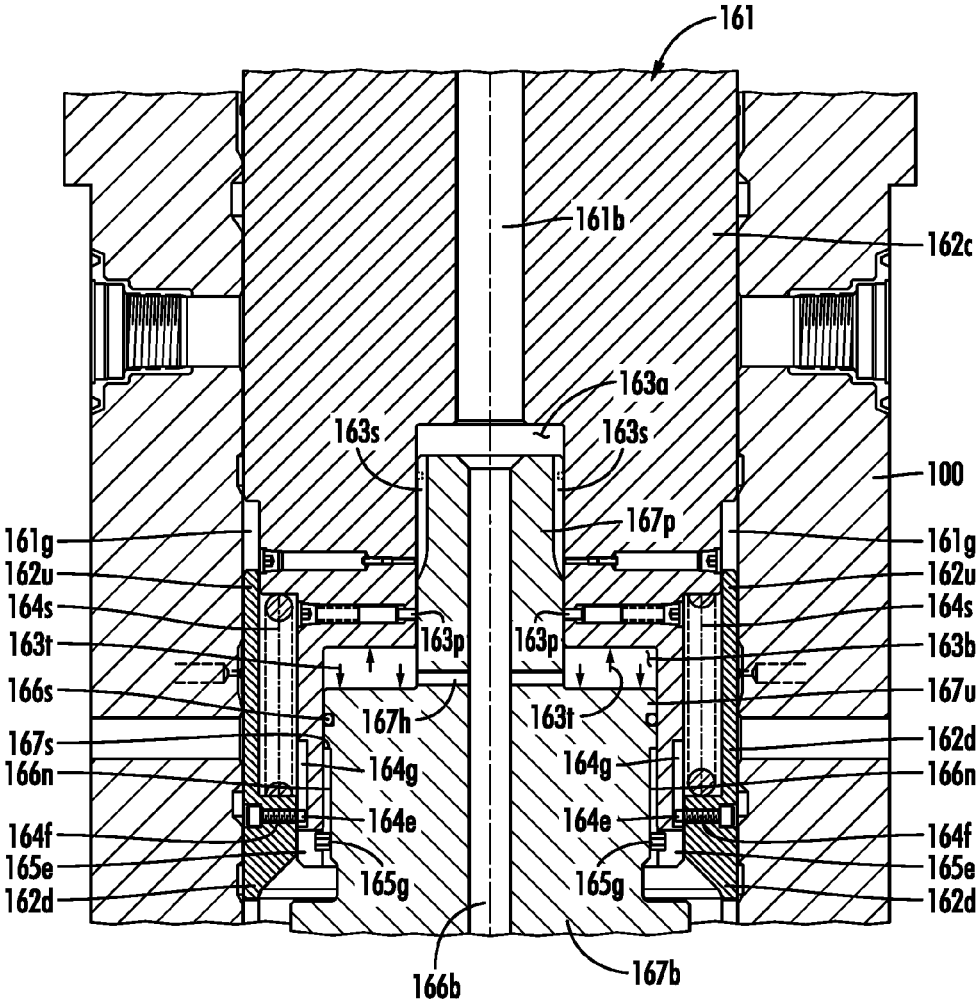
FIGS. 13B-13C are cross-sectional views showing various aspects of the upper and lower tool portions of the exemplary hydro-mechanical running tool depicted in FIG. 13A.

FIG. 13B is cross-sectional view of the hydro-mechanical running tool 160 illustrated in FIG. 13A showing additional detailed aspects of the telescoping interaction between the upper and lower tool portions 161 and 166 during an operation that may be used to set and lock the emergency casing packoff assembly 170 in the wellhead 100. As shown in exemplary embodiment depicted in FIG. 13B, the upper end 162*u* of the lower spring-loaded sleeve 162*d* may move downward within the groove 161*g* (when compared to the relative position of upper end 162*u* depicted in FIG. 10C) as the castellated interface between the lower end of the lower spring-loaded sleeve 162*d* and the lock ring energizing mandrel 173 is engaged during the rotation load 160*r*, as will be further described below. In certain embodiments, this relative downward movement of the upper end 162*u* within the groove 161*g* may be caused by the action of the spring 164*s* on the central rotating body 162*c* and the lower spring-loaded sleeve 162*d*. Similarly, the ends 164*e* of the fasteners 164*f* may also move downward within the groove 164*g*.

Figure 13C:
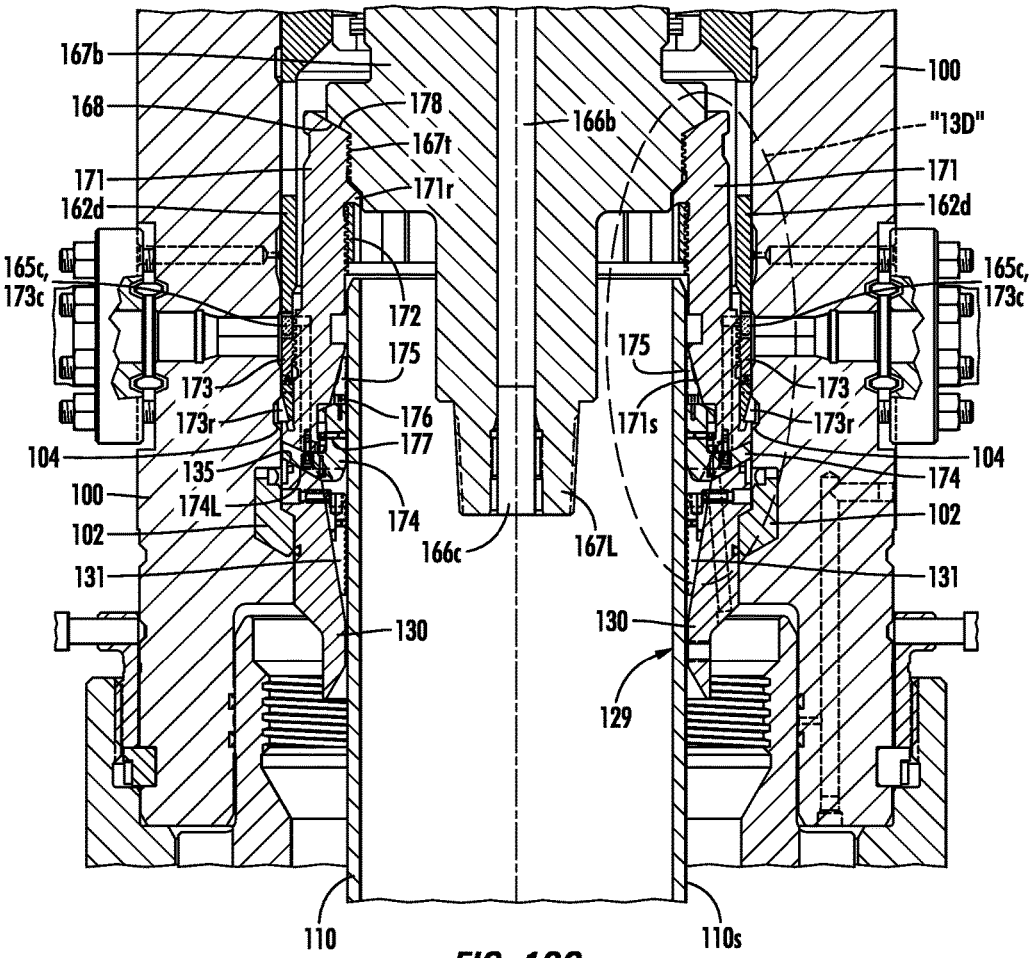

FIG. 13C is cross-sectional view of the hydro-mechanical running tool 160 shown in FIG. 13A, and depicts some additional detailed aspects of the lower tool portion 166 and the emergency casing packoff assembly 170 during the operational stage of setting and locking the packoff assembly 170 in the wellhead 100. As shown in the exemplary embodiment of FIG. 13C, the castellations 165*c* at the lower end of the lower spring-loaded sleeve 162*d* are engaged with the castellations 173*c* on the lock ring energizing mandrel 173, as indicated by the hashed interface depicted in FIG. 13C.

Figure 13D:
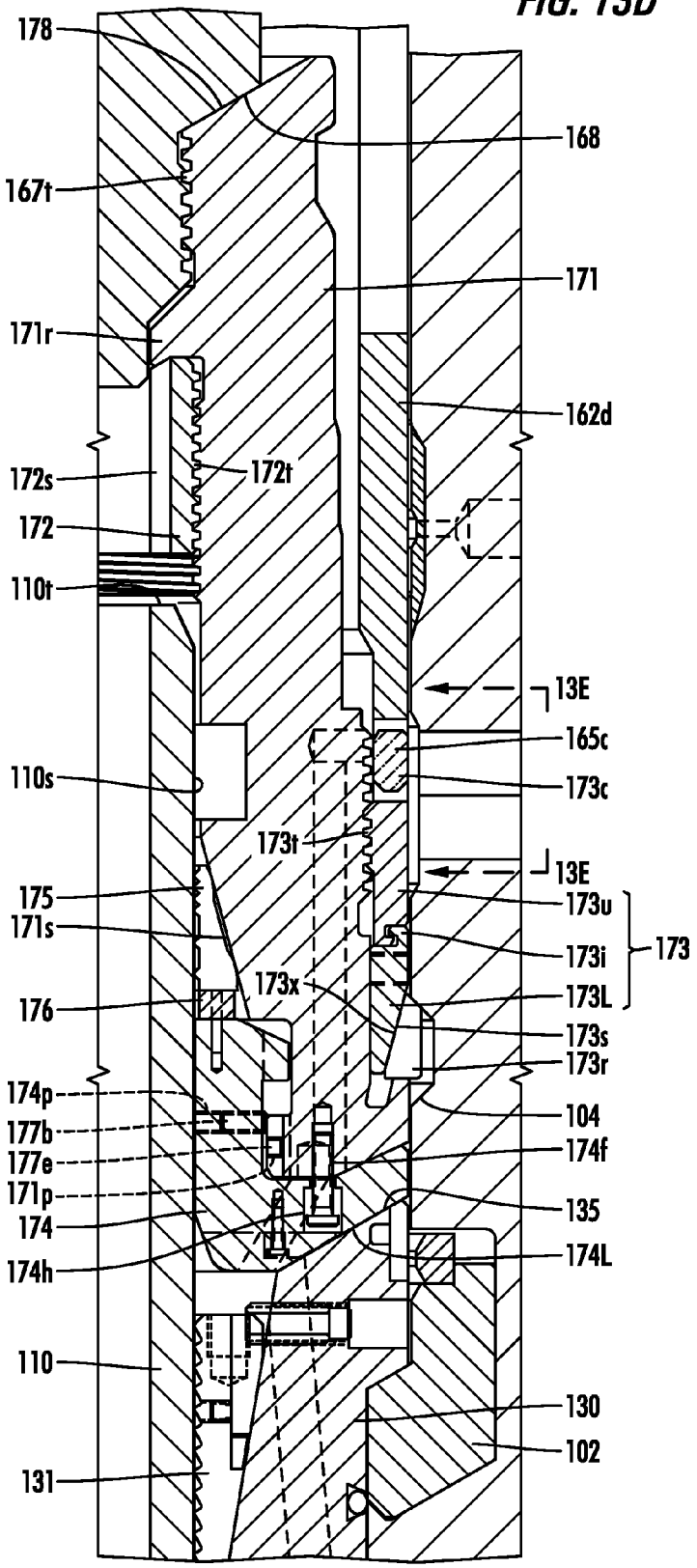
FIG. 13D is close-up cross-sectional detail view "13D" of the illustrative emergency packoff assembly shown in FIG. 13C.

FIG. 13D is close-up cross-sectional view "13D" of the illustrative casing packoff assembly 170 shown in FIG. 13C. As shown in FIG. 13D, the castellations 165*c* may become engaged with the castellations 173*c* as the rotational load 160*r* is imposed on the hydro-mechanical running tool 160. For example, as noted above, the castellations 165*c* on the lower spring-loaded sleeve 162*d* may remain in contact with the castellations 173*c* on the upper mandrel sleeve 173*u* of the lock ring energizing mandrel 173 after the downward seating movement of the upper packoff body 171. In some embodiments, this continued contact between the castellations 165*c* and 173*c* may be due to the degree of compression that is induced in the spring 164*s* by the downward telescoping movement of the upper tool portion 161 relative to the lower tool portion 166 during the operations that may be performed to set the upper lock ring 161*r* in the upper lock ring groove 103.

In certain embodiments, as the rotational load 160*r* is initially imposed on the neck 160*n* that extends upward from the central rotating body 162*c*, the central rotating body 162*c* and the lower spring-loaded sleeve 162*d* coupled thereto are rotated relative to the lower tool portion 166 as well as the emergency casing packoff assembly 170 removably, e.g., threadably, coupled thereto along the threaded interface 167*t*. For example, the lower spring-loaded sleeve 162*d* may be rotated relative to the lock ring energizing mandrel 173 until each of the castellations 165*c* is substantially aligned with a corresponding notch 173*n* on the upper mandrel sleeve 173*u* and each of the castellations 173*c* is aligned with a corresponding notch 165*n* (see, FIG. 10E).

As noted previously, in at least some embodiments, the thrust bearing 161*t* (see, FIG. 13A) may enable the central rotating body 162*c* to substantially freely rotate relative to the upper hydraulic housing 162*h* of the hydro-mechanical running tool 160 while the seal ring energizing pressure 163*t*, e.g., approximately 700 bar (10,000 psi), is maintained on the central rotating body 162*c* and the lower tool portion 166. The thrust bearing 161*t* is therefore adapted to compensate for the pressure thrust load imposed on upper hydraulic housing 162*h* by the central rotating body 162*c* while the seal ring energizing pressure 163*t* is maintained on the central rotating body 162*c*. On the other hand, due to the configuration of the telescoping interface between the lower tool portion 166 and the upper tool portion 161, no pressure thrust load is imposed on the lower tool portion 166 by the central rotating body 162*c*. Accordingly, the central rotating body 162*c* may substantially freely rotate with respect to the lower tool portion 166 without the need of a similar thrust bearing.

Figure 13E:
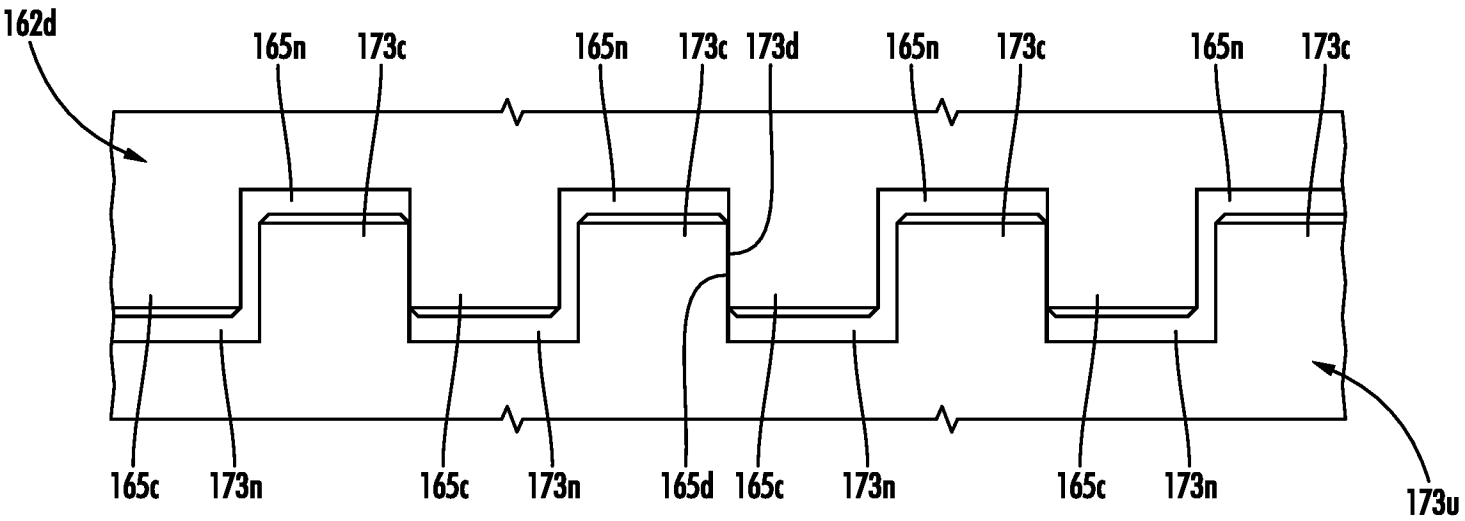
FIG. 13E is a close-up side elevation detail view "13E" of FIG. 13D showing the castellated interface of the exemplary upper lock ring energizing mandrel engaged with the castellated interface at the lower end of a lower spring loaded sleeve of the hydro-mechanical running tool while the emergency packoff assembly is set and locked in the wellhead.

Once the castellations 165*c* and notches 165*n* have been rotated into alignment with the notches 173*n* and the castellations 173*c*, respectively, the castellated interface may then be engaged as the castellations 165*c* and 173*c* move into the corresponding notches 173*n* and 165*n*, as is shown in the detailed side elevation view of the castellated interface depicted in FIG. 13E. In certain embodiments, the movement of the castellations 165*c* and 173*c* into the notches 173*n* and 165*n* may be caused by interaction of the previously compressed spring 164*s* with the central rotating body 162*c* and the lower spring-loaded sleeve 162*d*, as previously described.

In at least some exemplary embodiments, after the castellated interface between the lower spring-loaded sleeve 162*d* and the lock ring energizing mandrel 173 has been engaged in the manner described above, rotation of the central rotating body 162*c* and lower spring-loaded sleeve 162*d* relative to the emergency casing packoff assembly 170 under the rotational load 160*r* may continue so as to bring a sidewall contact face 165*d* of each castellation 165*c* into contact with a sidewall contact face 173*d* of a corresponding castellation 173*c* (see, FIG. 13E). Thereafter, as the rotational load 160*r* is continuously applied to the neck 160*n* (see, FIG. 13A) of the hydro-mechanical running tool 160, the upper mandrel sleeve 173*u* may be threaded downward relative to the stationary upper packoff body 171 along the threaded interface 173*t*, as shown in FIG. 13D, due to the contacting interaction between the castellations 165*c* and 173*c* at the contact faces 165*d* and 173*d*.

As previously noted with respect to FIG. 9E above, the upper mandrel sleeve 173*u* may be configured so as to engage the lower mandrel sleeve 173L at a slidable interlocking interface 173*i*. In certain embodiments, the slidable locking interface 173*i* may be adapted to permit the upper mandrel sleeve 173*u* to be rotated relative to the lower mandrel sleeve 173L as the upper mandrel sleeve 173*u* is threadably rotated up and/or down the threaded interface 173*t* with the upper packoff body 171 while still maintaining a sliding contact between the upper and lower mandrel sleeves 173*u* and 173L. Therefore, as the lower mandrel sleeve 173L is pushed downward over the outside of the upper packoff body 171 by the rotating screw action of the upper mandrel sleeve 173*u* along the threaded interface 173*t*, the outside tapered surface 173*s* of the lower mandrel sleeve 173L may be slidably moved along the inside tapered surface 173*x* of the lower lock ring 173*r*. In this way, the downwardly moving lower mandrel sleeve 173L may energize, or expand, the lower lock ring 173*r* into the lower lock ring groove 104 of the wellhead 100, thus locking the casing packoff assembly 170 into place in the wellhead 100.

In at least some illustrative embodiments, after the lower lock ring 173*r* has engaged the lower lock ring groove 104 so as to lock the emergency casing packoff assembly 170 into place, the rotational load 160*r* on the neck 160*n* may be adjusted so as to apply an appropriate torque load—e.g., a maximum torque load—to the lock ring energizing mandrel 173 so as to "rigidize" emergency casing packoff assembly 170. The applied torque may be established so as to reduce likelihood that movement of the rough casing metal seal (RCMS) 175 relative to the surfaces 110*s* and 171*s* may occur during subsequent drilling and/or production operations, which can sometimes act to unseat the metal to metal seal of the RCMS 175. In certain embodiments, the applied torque value may depend upon various parameters known to those having skill in the art, such as the casing diameter, wellhead design conditions (pressure and/or temperature), and the like. By way of example and not by way of limitation, in those embodiments of the present disclosure wherein the casing 110 may be a 13⅜" diameter casing, the rotational load 160*r* may be adjusted such that the torque value applied to the lock ring energizing mandrel 173 may be in the range of approximately 1500 to 3000 N-m (1000 to 2000 ft-lbs). It should be understood, however, that other torque values may be used, depending on the specific casing diameter and/or other relevant design and operating parameters.

In the illustrative embodiment of the hydro-mechanical running tool 160 shown in FIG. 13A, the rotational load 160*r* is depicted as being in a clockwise direction when viewed from above the running tool 160. In such embodiments, the clockwise direction of the rotational load 160*r* would act to screw the lock ring energizing mandrel 173 in a downward direction relative to the upper packoff body 171 (i.e., tightened, as is depicted in FIG. 13D) when the threaded interface 173*t* between the upper mandrel sleeve 173*u* and the upper packoff body 171 is a right-handed thread engagement. However, it should be appreciated by those of ordinary skill after a complete reading of the present disclosure that, due to the configuration of the castellated interface between lower end of the lower spring-loaded sleeve 162*d* and the lock ring energizing mandrel 173 (see, FIG. 13E), the emergency casing packoff assembly 170 may be readily adapted so as to have a left-handed thread engagement. In such cases, the rotational load 160*r* may be imposed on the neck 160*n* in a counterclockwise, or anticlockwise, direction, and the castellated interface between lower end of the lower spring-loaded sleeve 162*d* and the lock ring energizing mandrel 173 may also thereby transmit the counterclockwise tightening load to the left-handed thread engagement of the threaded interface 173*t*.

After an appropriate torque load has been applied to the lock ring energizing mandrel 173 as described above, the hydro-mechanical running tool 160 may be disengaged from the casing packoff assembly 170 and removed from the wellhead 100 through the blowout preventer, or BOP (not shown). For example, in some embodiments, the seal ring energizing pressure 163*t* may first be released on the hydro-mechanical running tool 160, after which a hydraulic fluid pressure may be introduced into the cavity 161*a* through the lower hydraulic fluid flow paths 161L (see, FIGS. 9B, 10B, and 11). The hydraulic fluid pressure acting on the piston 161*p* from below may thus cause the piston 161*p* to be slidably moved in a vertically upward direction within the cavity 161*a*, thus allowing the upper lock ring 161*r* to move radially inward and out of the upper lock ring groove 103, and thereby unlocking the upper tool portion 161 from the wellhead 100.

After the upper tool portion 161 has been unlocked from the wellhead 100 as noted above, the upper tool portion 161 may be raised, i.e., telescoped, relative to the lower tool portion 166 until the guide ring 165*g* contactingly engages the support shoulder 167*s* on the lower body 167*b* (see, FIGS. 9C, 10C, and 13B). In some embodiments, when the guide ring 165*g* is in contact with the support shoulder 167*s*, the upper tool portion 161 may be oriented relative to the lower tool portion 166 such that each of the spring-loaded pins 163*p* may be substantially aligned with a corresponding slot 163*s* in the piston 167*p* so that the pins 163*p* are able to extend into the slots under the action of a spring (not shown). In other embodiments, the upper and lower tool portions 161, 166 may be oriented relative to one another such that each of the spring-loaded pins 163*p* is not substantially aligned with, but may only be positioned adjacent to, a corresponding slot 163*s*, in which case the upper tool portion 161 may be rotated relative to the lower tool portion 166 until the pins 163*p* align with and extend into the slots 163*s*. Accordingly, once the spring-loaded pins 163*p* are in this configuration, i.e., extended into the slots 163*s*, each of the pins 163*p* may then be able to contact the side of a corresponding slot 163*s* when a rotational load, or torque, is applied to neck 160*n* of the hydro-mechanical running tool 160.

In certain embodiments, after the spring-loaded pins 163*p* have been extended into the slots 163*s* in the piston 167*p*, a rotational load may be imposed on the neck 160*n*, e.g., by rotating a drill pipe (not shown) attached to the neck 160*n*, so as to thereby rotate the central rotating body 162*c*. In this way, the interaction between the spring-loaded pins 163*p* and the slots 163*s* may thus cause the lower tool portion 166 to rotate together with the central rotating body 162*c*, and the lower tool portion 166 may be threadably detached from the emergency casing packoff assembly 170 by uncoupling, e.g., unscrewing, the lower body 167*b* from its threaded engagement with the upper packing body 171 along the threaded interface 167*t* (see, FIG. 13C). Once the lower tool portion 166 has been detached from the casing packoff assembly 170, the entire hydro-mechanical running tool 160 may then be removed from the wellhead 100 through the BOP (not shown).

Figure 14:
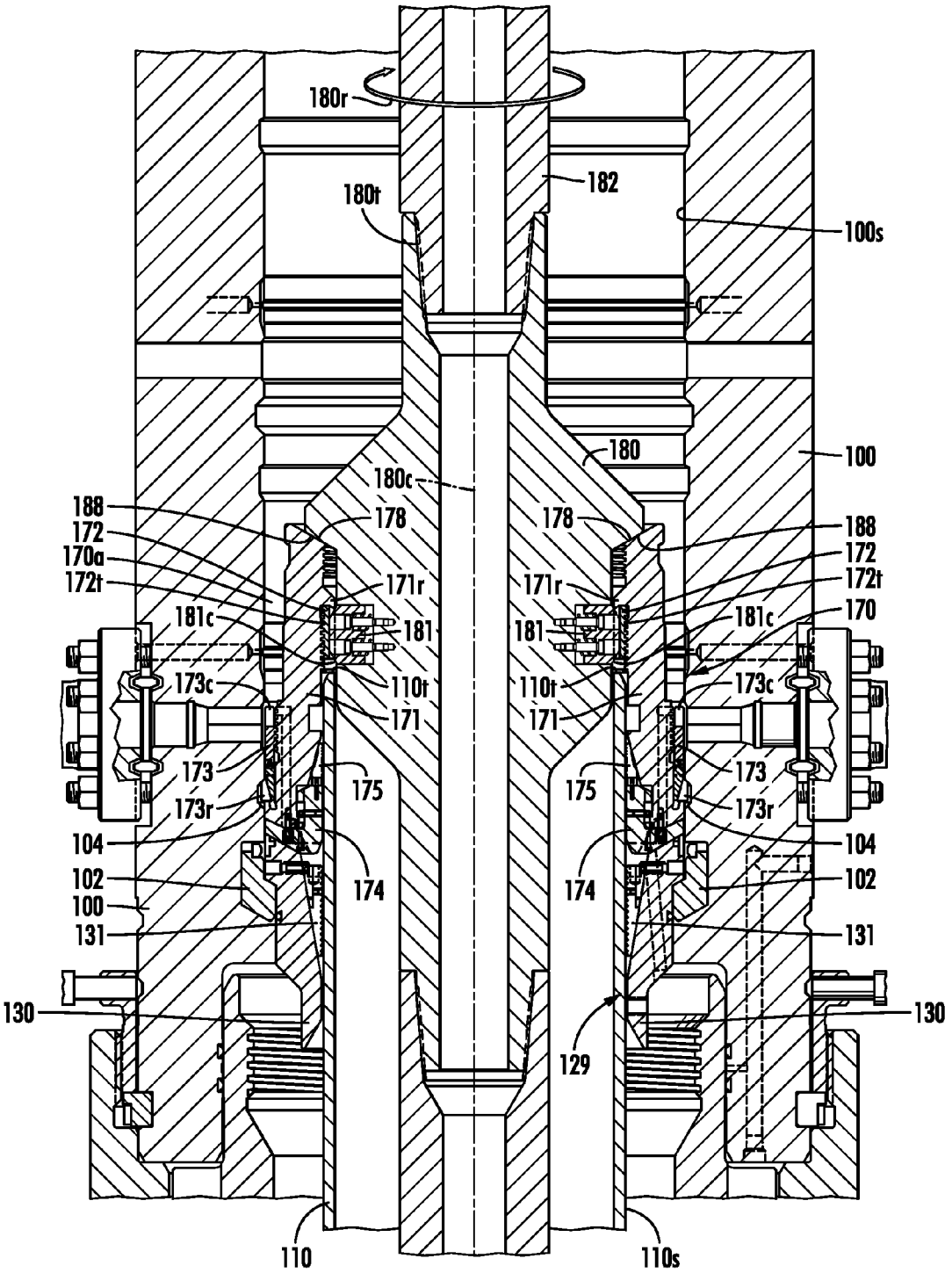
FIG. 14 is a cross-sectional view of the illustrative emergency packoff assembly shown in FIGS. 13A-13D after the exemplary hydro-mechanical running tool has been removed from the wellhead and an illustrative rigidizing tool has been run into the wellhead and engaged with the rigidizing sleeve on the emergency packoff assembly.

FIG. 14 is a cross-sectional view of the illustrative emergency casing packoff assembly 170 shown in FIGS. 13A-13D in a subsequent operational stage, i.e., after the exemplary hydro-mechanical running tool 160 has been detached from the casing packoff assembly 170 and removed from the wellhead 100. Thereafter, a rigidizing tool 180 may then be run into the wellhead 100 through the BOP (not shown), for example, at the end of a supporting drill pipe 182 that may be attached to the rigidizing tool 180 at a threaded interface 180*t*. As shown in FIG. 14, a landing shoulder 188 on the rigidizing tool 180 may be landed on the upper packoff body support shoulder 178 of the packoff assembly 170.

In certain embodiments, the rigidizing tool 180 may include a plurality of spring-loaded dogs 181, each of which may be adapted to engage a corresponding one of the plurality of slots 172*s* (see, FIGS. 9E, 12B, and 13D) formed in the rigidizing sleeve 172. Furthermore, each spring-loaded dog 181 may have an upper tapered or chamfered lower corner 181*c* that is adapted to contactingly interface with the rigidizing shoulder 171*r* on the upper packoff body 171 as the rigidizing tool 180 is being lowered into the wellhead 100. In some embodiments, the angled surfaces of the chamfered lower corners 181*c* and the rigidizing shoulder 171*r* may cause the spring on each of the spring-loaded dogs 181 to compress as the chamfered lower corners 181*c* contact the rigidizing shoulder 171*r*. The spring-loaded dogs 181 may thus be forced to spring inward, i.e., toward the centerline 180*c* of the rigidizing tool 180, so as to bypass the rigidizing shoulder 171*r* and engage the slots 172*s* on rigidizing sleeve 172.

As shown in FIG. 14, in at least some embodiments, the position of the spring-loaded dogs 181 on the rigidizing tool 180 relative to the landing shoulder 188 may be established such that the spring-loaded dogs 181 may be allowed to completely bypass the rigidizing shoulder 171*r* and engage the slots 172*s* before the landing shoulder 188 lands on the upper packoff body support shoulder 178. Thereafter, once the rigidizing tool 180 has been landed on the casing packoff assembly 170, a torque, or rotational load 180*r* may be imposed on the rigidizing tool 180, e.g., by rotating the supporting drill pipe 182, so as to screw the rigidizing sleeve 172 along the threaded interface 172*t* and down into contact with the trimmed end 110*t* of the casing 110. As shown in FIG. 14, the rotational load 18*r* is depicted as being in a clockwise direction when viewed from above the rigidizing tool 180, thus indicating that threaded interface 172*t* may be a right-handed thread engagement. However, as with the threaded interface 173*t* between the lock ring energizing mandrel 173 and the upper packoff body 171 described above, it should be appreciated that the threaded interface 173*t* may also be a left-handed thread engagement, in which case the rotational load 180*r* may be in a counterclockwise, or anti-clockwise, direction.

Figure 15:
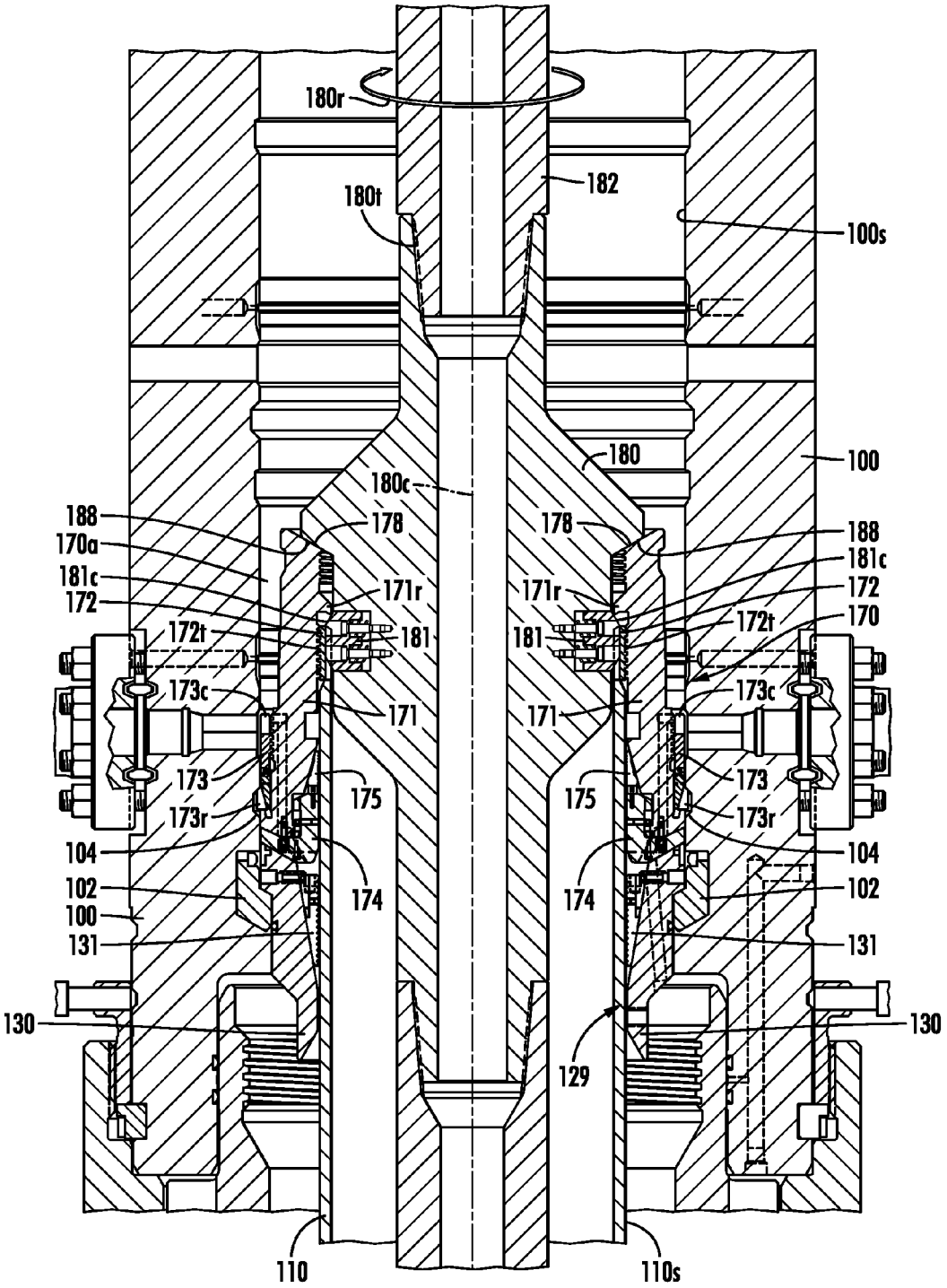
FIG. 15 is a cross-sectional view of the illustrative emergency packoff assembly shown in FIG. 14 after the illustrative rigidizing tool has been used to tighten the rigidizing sleeve against the trimmed upper surface of the stuck casing.

FIG. 15 is a cross-sectional view of the illustrative emergency casing packoff assembly 170 shown in FIG. 14 after the rigidizing tool 180 has been used to screw down and tighten the rigidizing sleeve 172 against the trimmed upper end 110*t* of the casing 110. In certain embodiments, and as with the lock ring energizing mandrel 173 above, an appropriate torque load—e.g., a maximum torque load—may be applied to the rigidizing sleeve 172 so as to "rigidize" the casing 110 and thereby reduce the likelihood that the operating conditions of the wellhead 100 may act to unseat the metal to metal seal of the RCMS 175.

The applied torque value may depend upon various parameters known to those having skill in the art, such as the diameter of the rigidizing sleeve 172 (which may be substantially the same as the diameter of the casing 110), the design conditions of the wellhead (e.g., pressure and/or temperature), and the like. By way of example and not by way of limitation, in those embodiments of the present disclosure wherein the casing 110 may be a 13⅜" diameter casing, the rotational load 160*r* may be adjusted such that the torque value applied to the rigidizing sleeve 172 may be in the range of approximately 1500 to 3000 N-m (1000 to 2000 ft-lbs). It should be understood, however, that other torque values may also be used for other casing diameters and/or other relevant design and operating parameters.

After the appropriate torque load has been applied to the rigidizing sleeve 172, the drill pipe 182 may then be used to pull the rigidizing tool 180 from wellhead 100 and through the blowout preventer (not shown). In certain embodiments, each of the plurality of spring-loaded dogs 181 may also have an tapered or chamfered upper corner 181*c*, e.g., similar to the chamfered lower corners 181*c* described above, which may contactingly interface with the rigidizing shoulder 171*r* as the rigidizing tool 180 is being pulled from the wellhead 100. Furthermore, the chamfered upper corner 181*c* of each spring-loaded dog 181 may act in similar fashion to the chamfered lower corners 181*c*, such that spring-loaded dogs once again spring inward so as to bypass the rigidizing should 171*r*.

Figure 16:
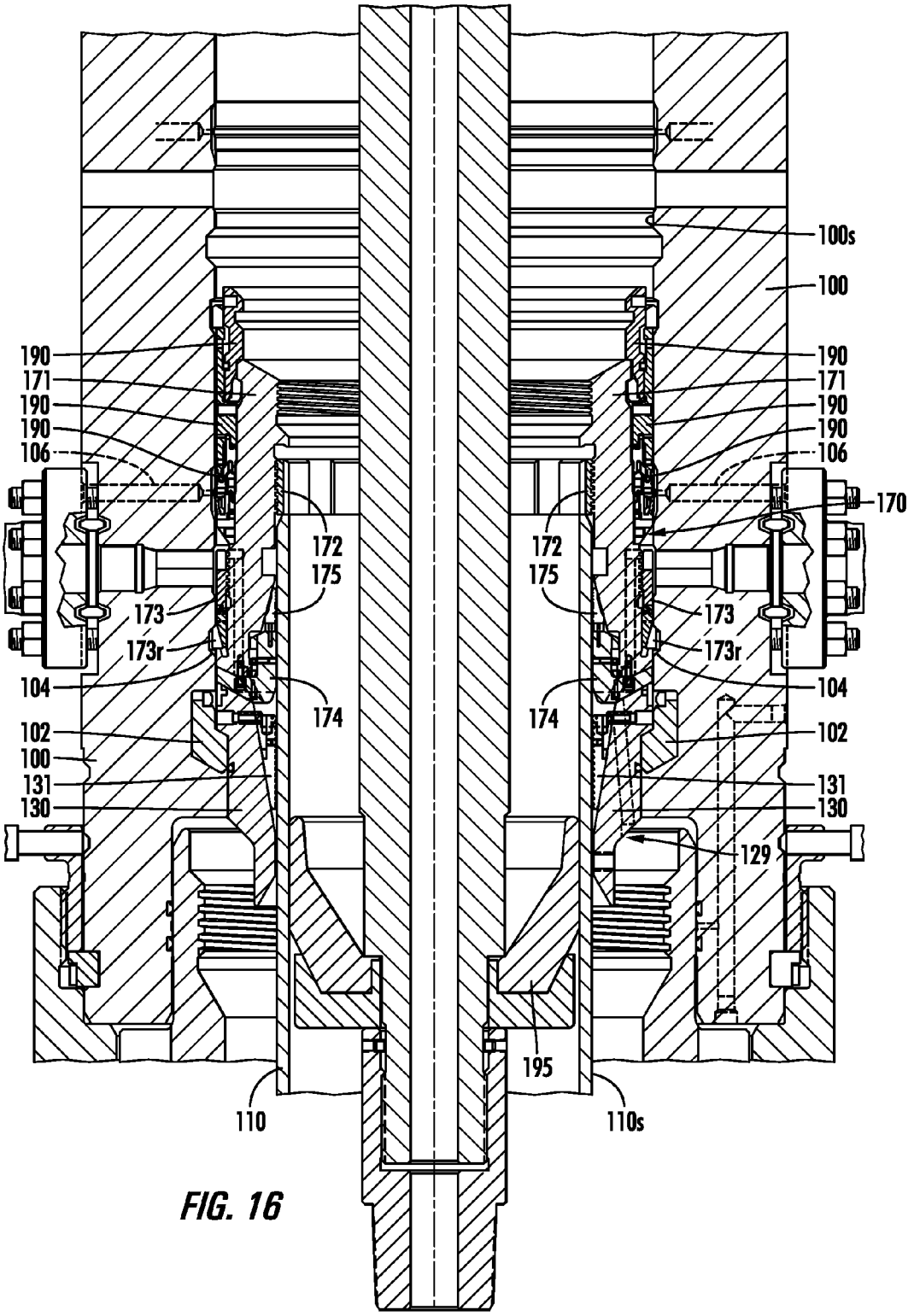
FIG. 16 is a cross-sectional view of the illustrative emergency packoff assembly shown in FIG. 15 after the illustrative rigidizing tool has been removed, an annular packoff has been installed in the annulus between the outside of the emergency packoff assembly and the wellhead, and a cup tester tool has been run into the wellbore to test the emergency packoff assembly and the annular packoff.

FIG. 16 is a cross-sectional view of the illustrative emergency casing packoff assembly 170 depicted in FIG. 15 in a subsequent operational stage, after the rigidizing tool 180 has been removed from the wellhead 100. As shown in FIG. 16, an annular packoff 190 has been installed so as to seal the annulus 170*a* (see, FIGS. 14 and 15) between the outside of the casing packoff assembly 170 and the inside surface 100*s* of the wellhead 100. The annular packoff 190 may be one of any type of design known in the art. In some exemplary embodiments, a cup tester seal 195 may thereafter be run into the wellbore 100 so as to simultaneously pressure test the casing packoff assembly 170, including the rough casing metal seal 175, as well as the annular packoff 190.

As a result, the subject matter disclosed herein provides details of some methods, systems and tools that may be used to install an illustrative emergency slip hanger and packoff assembly with a metal to metal seal in a wellhead without removing the blowout preventer from the wellhead.

The particular embodiments disclosed above are illustrative only, as the invention may be modified and practiced in different but equivalent manners apparent to those skilled in the art having the benefit of the teachings herein. For example, the method steps set forth above may be performed in a different order. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed:

1. A system, comprising:

an emergency casing packoff assembly that is adapted to be installed in a wellhead through a blowout preventer, said packoff assembly comprising:

an upper packoff body;

a lower packoff body releasably coupled to said upper packoff body;

a metal seal ring that is adapted to create a metal to metal seal between said packoff assembly and a casing supported in said wellhead when a pressure thrust load is imposed on said packoff assembly; and a lock ring energizing mandrel threadably coupled to said upper packoff body, wherein at least a portion of said lock ring energizing mandrel is adapted to be threadably rotated relative to said upper packoff body so as to lock said packoff assembly into said wellhead while said imposed pressure thrust load is maintained on said packoff assembly; and a hydro-mechanical running tool that is adapted to install said packoff assembly in said wellhead through said blowout preventer, said hydro-mechanical running tool comprising:

an upper tool portion comprising a central rotating body and an upper hydraulic housing disposed around at least a part of said central rotating body;

a lower tool portion that is adapted to be threadably coupled to said packoff assembly during installation of said packoff assembly in said wellhead, wherein said central rotating body is adapted to be rotated relative to at least one of said upper hydraulic housing and said lower tool portion while a pressure is imposed on at least said central rotating body and said lower tool portion; and a thrust bearing positioned between said central rotating body and said upper hydraulic housing, said thrust bearing being adapted to facilitate said rotation of said central rotating body relative to said upper hydraulic housing while said pressure is imposed.

2. The system of claim 1, said packoff assembly further comprising a plurality of shear pins releasably coupling said lower packoff body to said upper packoff body, wherein said plurality of shear pins are adapted to be sheared when a pressure thrust load is imposed on said packoff assembly.

3. The system of claim 2, wherein said packoff assembly is adapted to be removably coupled to said hydro-mechanical running tool and said upper packoff body is adapted to shear said plurality of shear pins when said hydro-mechanical running tool imposes a pressure thrust load on said packoff assembly.

4. The system of claim 2, wherein said metal seal ring of said packoff assembly is adapted to be energized so as to create a metal to metal seal between said packoff assembly and a casing supported in said wellhead when said plurality of shear pins are sheared by a pressure thrust load that is imposed on said packoff assembly by said hydro-mechanical running tool.

5. The system of claim 1, wherein said lock ring energizing mandrel of said packoff assembly comprises a castellated interface that is adapted to engage a castellated interface on said hydro-mechanical running tool.

6. The system of claim 5, wherein said lock ring energizing mandrel of said packoff assembly comprises an upper mandrel sleeve that is threadably coupled to said upper packoff body and a lower mandrel sleeve that is coupled to said upper mandrel sleeve at a slidable interlocking interface, said lower mandrel sleeve having a tapered surface that is adapted to slidingly interface with a tapered surface of a lock ring of said packoff assembly so as to energize said lock ring into a lock ring groove of said wellhead.

7. The system of claim 5, wherein said at least said portion of said lock ring energizing mandrel of said packoff assembly is adapted to be threadably rotated along a threaded interface with said upper packoff body by said hydro-mechanical running tool when said hydro-mechanical running tool engages said castellated interface of said lock ring energizing mandrel, said lock ring energizing mandrel being further adapted to energize said lock ring into a lock ring groove in said wellhead during said threadable rotation of at least said portion of said lock ring energizing mandrel.

8. The system of claim 7, wherein said at least said portion of said lock ring energizing mandrel of said packoff assembly is adapted to be threadably rotated along a threaded interface with said upper packoff body by said hydro-mechanical running tool while said pressure is imposed on said hydro-mechanical running tool and said packoff assembly.

9. The system of claim 1, said packoff assembly further comprising a shim positioned between said metal seal ring and said lower packoff body, wherein a thickness of said shim is adapted to establish a seal ring seating gap distance between said upper and lower packoff bodies prior to energizing said metal seal ring so as to create a metal to metal seal between said packoff assembly and said casing supported in said wellhead.

10. The system of claim 1, wherein said lower tool portion of said hydro-mechanical running tool comprises a piston that is adapted to telescopically move within a central cavity defined in said central rotating body of said upper tool portion of said hydro-mechanical running tool.

11. The system of claim 10, wherein said piston is adapted to telescopically move within said central cavity when pressure is introduced into an annular cavity defined between an outer surface of said piston and an inner surface of said central rotating body, said pressure imposing said pressure thrust load on said packoff assembly.

12. The system of claim 1, wherein said lower tool portion of said hydro-mechanical running tool is adapted to be threadably coupled to said packoff assembly by threadably engaging a first thread formed on said lower tool portion with a second thread formed on said packoff assembly.

13. A hydro-mechanical running tool that is adapted to install a casing packoff assembly having a metal to metal sealing system in a wellhead through a blowout preventer, the hydro-mechanical running tool comprising:

an upper tool portion comprising a central rotating body and an upper hydraulic housing disposed around at least a part of said central rotating body;

a lower tool portion that is adapted to be threadably coupled to a casing packoff assembly during installation of said casing packoff assembly in said wellhead, wherein said central rotating body is adapted to be rotated relative to said upper hydraulic housing and said lower tool portion while a pressure is imposed on at least said central rotating body and said lower tool portion; and a thrust bearing positioned between said central rotating body and said upper hydraulic housing, said thrust bearing being adapted to facilitate said rotation of said central rotating body relative to said upper hydraulic housing while said pressure is imposed.

14. The hydro-mechanical running tool of claim 13, further comprising a lower spring-loaded sleeve coupled to said central rotating body, wherein said lower spring-loaded sleeve is adapted to be rotated with said central rotating body relative to said lower tool portion.

15. The hydro-mechanical running tool of claim 14, wherein said lower spring-loaded sleeve is further adapted to energize a lock ring of said casing packoff assembly that is removably coupled to said lower tool portion so as to lock said casing packoff assembly into said wellhead.

16. The hydro-mechanical running tool of claim 13, wherein said central rotating body comprises a neck that extends through a central bore of said upper hydraulic housing, said neck being adapted to rotate said central rotating body.

17. The hydro-mechanical running tool of claim 13, wherein said lower tool portion is adapted to energize a metal to metal sealing system of a casing packoff assembly while a pressure is imposed on at least said central rotating body and said lower tool portion.

18. The hydro-mechanical running tool of claim 13, wherein said upper hydraulic housing comprises an inner hydraulic housing and an outer hydraulic housing coupled to said inner hydraulic housing, said inner and outer hydraulic housings defining a cavity in said upper hydraulic housing.

19. The hydro-mechanical running tool of claim 18, wherein said upper hydraulic housing comprises a piston disposed in said cavity, said piston being adapted to move within said cavity in a substantially axial direction.

20. The hydro-mechanical running tool of claim 18, wherein said upper hydraulic housing further comprises a lock ring that is adapted to lock said hydro-mechanical running tool into said wellhead while a pressure is imposed on at least said central rotating body and said lower tool portion and while said central rotating body is rotated relative to said upper hydraulic housing and said lower tool portion.

21. The hydro-mechanical running tool of claim 13, wherein said lower tool portion comprises a piston that is adapted to telescopically move within a central cavity defined in said central rotating body of said upper tool portion.

22. The hydro-mechanical running tool of claim 21, wherein said piston is adapted to telescopically move within said central cavity when said pressure is introduced into an annular cavity defined between an outer surface of said piston and an inner surface of said central rotating body.

23. The hydro-mechanical running tool of claim 13, wherein said lower tool portion is adapted to be threadably coupled to said casing packoff assembly by threadably engaging a first thread formed on said lower tool portion with a second thread formed on said casing packoff assembly.

24. A hydro-mechanical running tool that is adapted to install a casing packoff assembly having a metal to metal sealing system in a wellhead through a blowout preventer, the hydro-mechanical running tool comprising:

an upper tool portion comprising a central rotating body and an upper hydraulic housing disposed around at least a part of said central rotating body;

a lower tool portion that is adapted to be threadably coupled to a casing packoff assembly during installation of said casing packoff assembly in said wellhead, wherein said central rotating body is adapted to be rotated relative to said upper hydraulic housing while a pressure is imposed on at least said central rotating body and said lower tool portion; and a thrust bearing positioned between said central rotating body and said upper hydraulic housing, said thrust bearing being adapted to facilitate said rotation of said central rotating body relative to said upper hydraulic housing while said pressure is imposed.

25. The hydro-mechanical running tool of claim 24, wherein said central rotating body comprises a neck that extends through a central bore of said upper hydraulic housing, said neck being adapted to rotate said central rotating body.

26. The hydro-mechanical running tool of claim 24, wherein said lower tool portion is adapted to energize a metal to metal sealing system of a casing packoff assembly while a pressure is imposed on at least said central rotating body and said lower tool portion.

27. The hydro-mechanical running tool of claim 24, wherein said upper hydraulic housing comprises an inner hydraulic housing and an outer hydraulic housing coupled to said inner hydraulic housing, said inner and outer hydraulic housings defining a cavity in said upper hydraulic housing.

28. The hydro-mechanical running tool of claim 27, wherein said upper hydraulic housing comprises a piston disposed in said cavity, said piston being adapted to move within said cavity in a substantially axial direction.

29. The hydro-mechanical running tool of claim 27, wherein said upper hydraulic housing further comprises a lock ring that is adapted to lock said hydro-mechanical running tool into said wellhead while a pressure is imposed on at least said central rotating body and said lower tool portion and while said central rotating body is rotated relative to said upper hydraulic housing and said lower tool portion.

30. The hydro-mechanical running tool of claim 24, wherein said lower tool portion comprises a piston that is adapted to telescopically move within a central cavity defined in said central rotating body of said upper tool portion.

31. The hydro-mechanical running tool of claim 30, wherein said piston is adapted to telescopically move within said central cavity when said pressure is introduced into an annular cavity defined between an outer surface of said piston and an inner surface of said central rotating body.

32. The hydro-mechanical running tool of claim 24, wherein said lower tool portion is adapted to be threadably coupled to said casing packoff assembly by threadably engaging a first thread formed on said lower tool portion with a second thread formed on said casing packoff assembly.

* * * * *